US005859627A

United States Patent [19]

Hoshiya et al.

[11] Patent Number: 5,859,627

[45] Date of Patent: Jan. 12, 1999

[54] DRIVING CIRCUIT FOR LIQUID-CRYSTAL DISPLAY DEVICE

[75] Inventors: Takayuki Hoshiya; Kenichi Nakabayashi; Masafumi Itokazu; Hiroshi Murakami, all of Kawasaki, Japan

[73] Assignee: Fujitsu Limited, Kanagawa, Japan

[21] Appl. No.: 980,199

[22] Filed: Nov. 28, 1997

Related U.S. Application Data

[63] Continuation of Ser. No. 339,288, Nov. 10, 1994, abandoned, which is a continuation of Ser. No. 138,008, Oct. 19, 1993, abandoned.

[30] Foreign Application Priority Data

Oct. 19, 1992 [JP] Japan ..... 4-279910
Mar. 15, 1993 [JP] Japan ..... 5-054140

[51] Int. Cl.[6] ..... G09G 3/36

[52] U.S. Cl. ..... 345/100; 345/98; 345/93

[58] Field of Search ..... 345/93, 98, 99, 345/100, 90, 87; 348/790, 792, 793; 349/54, 55, 48

[56] References Cited

U.S. PATENT DOCUMENTS

| | | | |
|---|---|---|---|
| 2,910,584 | 10/1959 | Steele | 307/441 |
| 3,201,701 | 8/1965 | Maitra | 307/441 |
| 3,226,569 | 12/1965 | James | 307/441 |
| 3,917,933 | 11/1975 | Scheuneman | 371/10.2 |
| 4,092,733 | 5/1978 | Coontz | 371/10.2 |
| 4,228,528 | 10/1980 | Cenker | 307/441 |
| 4,328,580 | 5/1982 | Stockham | 371/10.2 |
| 4,825,203 | 4/1989 | Tadeka | 345/100 |
| 5,028,916 | 7/1991 | Ichikawa | 345/204 |
| 5,038,368 | 8/1991 | Lee | 307/441 |
| 5,063,378 | 11/1991 | Roach | 345/93 |
| 5,103,218 | 4/1992 | Takeda | 345/100 |

FOREIGN PATENT DOCUMENTS

| | | |
|---|---|---|
| 0268380 | 5/1988 | European Pat. Off. . |
| 56-82953 | 7/1981 | Japan . |

OTHER PUBLICATIONS

Mims, III, F. "Engineer's Notebook", pp. 19,79. 1980.

Rostek, O. "Make Systems Fail–Operational by using Multiple Games with Automatic Voters to Select Best Signal" Electronic Design 17, pp. 214–215 Aug. 1969 IBM Technical Disclosure Bulletin 15(4):1145–1146.

*Primary Examiner*—Xiao Wu
*Attorney, Agent, or Firm*—Staas & Halsey

[57] ABSTRACT

A driving circuit for a liquid-crystal display device, the driving circuit including a shift register for outputting n control signals driving n signal lines coupled to display elements of the liquid-crystal display device where n is an integer, the shift register having a plurality of stages cascaded. Each of the plurality of stages includes delay elements connected in parallel, each of the delay elements having a unit delay time, and a selector for selecting, in response to a select signal commonly supplied to the plurality of stages, at least one of output signals of the delay elements and for outputting the above at least one of the output signals as a corresponding one of the n control signals.

20 Claims, 43 Drawing Sheets

NO DEFECT

11 TH EMBODIMENT

DRIVING CIRCUIT FOR LIQUID-CRYSTAL DISPLAY DEVICE

This application is a continuation, of application Ser. No. 08/339,288, filed Nov. 10, 1994, now abandoned, which is a continuation of application Ser. No. 08/138,008, filed Oct. 19, 1993, now abandoned.

BACKGROUND OF THE INVENTION

1. Field of the Invention

The present invention relates to a driving circuit for a liquid-crystal display device which is integrated on a liquid-crystal display panel of an active matrix type on which pixels (liquid-crystal display elements), arranged in rows and columns, function to store data.

2. Description of the Prior Art

A liquid-crystal display device of the active matrix type is capable of providing a display quality as high as that of a CRT display device equipped with a cathode-ray tube, and is hence attractive as a replacement of CRT display devices.

The liquid-crystal display device needs a driving circuit which drives data lines or scanning lines. A liquid-crystal display device of the active matrix type in which the driving circuit is integrated on a liquid-crystal display panel thereof has become in practical use. For example, such a liquid-crystal display device is used for a view finder of a video camera.

The liquid-crystal display device having the driving circuit integrated on the liquid-crystal display panel is superior, in terms of device miniaturization, feature size reduction and cost reduction, to a liquid-crystal display device in which the driving circuit is externally mounted on the liquid-crystal display panel by means of a mounting process, such as a TAB (Tape Automated Bonding) scheme or a COG (Chip On Glass) scheme.

In this regard, recently, it has been strongly desired that a liquid-crystal display device of the active matrix type in which the driving circuit is integrated on the liquid-crystal display panel becomes in practical use as a display device of information terminal equipment. A liquid-crystal display device of the active matrix type which has been practically used has a display area as small as approximately one inch. Hence, the driving circuit for driving display elements arrayed in the display area may be small and a probability that a defect occurs in the driving circuit is low.

In the meantime, it is required that the liquid-crystal display device of the active matrix type for use in information terminal equipment is equipped with a large display area. Hence, a large size driving circuit is needed to drive display elements arrayed in such a large display area and a probability that a defect occurs in the driving circuit is high.

If a defect occurs in the driving circuit integrated on the display panel of the liquid-crystal display device of the active matrix type, the liquid-crystal display device itself including the liquid-crystal display panel, is considered as a defective device. Hence, it is required that the driving circuit be designed to easily avoid a defect that occurs therein and enable continuous use rather than operating as a defective device.

SUMMARY OF THE INVENTION

It is an object of the present invention to provide a driving circuit for a liquid-crystal display device in which a defect that has occurred in the driving circuit can be avoided and can be continuously used.

This object of the present invention is achieved by a driving circuit for a liquid-crystal display device, comprising: shift register means for outputting n control signals driving n signal lines coupled to display elements of the liquid-crystal display device where n is an integer, the shift register means having a plurality of stages cascaded. Each of the plurality of stages comprises: delay elements connected in parallel, each of the delay elements having a unit delay time; and selector means for selecting, in response to a select signal commonly supplied to the plurality of stages, at least one of output signals of the delay elements and for outputting the above at least one of the output signals as a corresponding one of the n control signals.

The above object of the present invention is also achieved by a driving circuit for a liquid-crystal display device, comprising: shift register means for outputting n control signals driving n signal lines coupled to display elements of the liquid-crystal display device where n is an integer, the shift register means having a plurality of stages cascaded. Each of the plurality of stages comprises: delay elements connected in parallel, each of the delay elements having a unit delay time; selector means for selecting, in response to a select signal, at least one of output signals of the delay elements and for outputting the above at least one of the output signals as a corresponding one of the n control signals; and defect detecting means for detecting a defect that occurs in at least one of the delay elements and for generating the select signal.

The above object of the present invention is also achieved by a driving circuit for a liquid-crystal display device, comprising: n primary driving voltage output circuits driving n signal lines coupled to display elements where n is an integer; n secondary driving voltage output circuits respectively provided for the n primary driving voltage output circuits; control means for controlling operations of the n primary driving voltage output circuits; defect detecting means for detecting defects in the n primary driving voltage output circuits and for generating n select signals; and selector means for selecting, at each of the plurality of stages, either the n primary driving voltage output circuits or the n secondary driving voltage output circuits in accordance with the n select signals.

The above object of the present invention is also achieved by a driving circuit for a liquid-crystal display device, comprising: n primary driving voltage output circuits driving n signal lines coupled to display elements where n is an integer; secondary driving voltage output circuits, each provided for each group including m primary driving voltage output circuits where m is less than n; control means for controlling operations of the n primary driving voltage output circuits; first switch means for selectively connecting the n primary driving voltage output circuits to said n signal lines; second switch means for selectively outputting control signals to be applied to the m primary driving voltage output circuits to one of the secondary driving voltage output circuits; third switch means for selectively connecting one of the secondary driving voltage output circuits to the signal lines related to the m primary driving voltage output circuits; and defect detecting means for detecting defects that occur in the m primary driving voltage output circuits and for controlling the first, second and third switch means so that a signal line in which a defect is detected is driven by one of the secondary driving voltage output circuits.

The above object of the present invention is also achieved by a driving circuit for a liquid-crystal display device, comprising: n driving voltage output circuits driving n signal lines coupled to display elements containing redundant display elements where n is an integer; defect detecting means for detecting defects in the n driving voltage output circuits; and control means for controlling the n driving voltage output circuits so that driving voltage output circuits other than a driving voltage output circuit which is detected as a defective circuit drive corresponding signal lines.

The above object of the present invention is also achieved by a driving circuit for a liquid-crystal display device, comprising: shift register means for outputting n control signals driving n signal lines coupled to display elements of the liquid-crystal display device where n is an integer, the shift register means having a plurality of stages cascaded. Each of the plurality of stages comprises: delay elements connected in parallel, each of the delay elements having a unit delay time; and majority-based processing means for outputting, as a corresponding one of the n control signals, an output signal having a majority among output signals of the delay elements.

BRIEF DESCRIPTION OF THE DRAWING

Other objects, features and advantages of the present invention will become more apparent from the following detailed description when read in conjunction with the accompanying drawings, in which.

DESCRIPTION OF THE PREFERRED EMBODIMENTS

A description will now be given, with reference to FIG. 1, of a liquid-crystal display device of the active matrix type.

Figure 1:
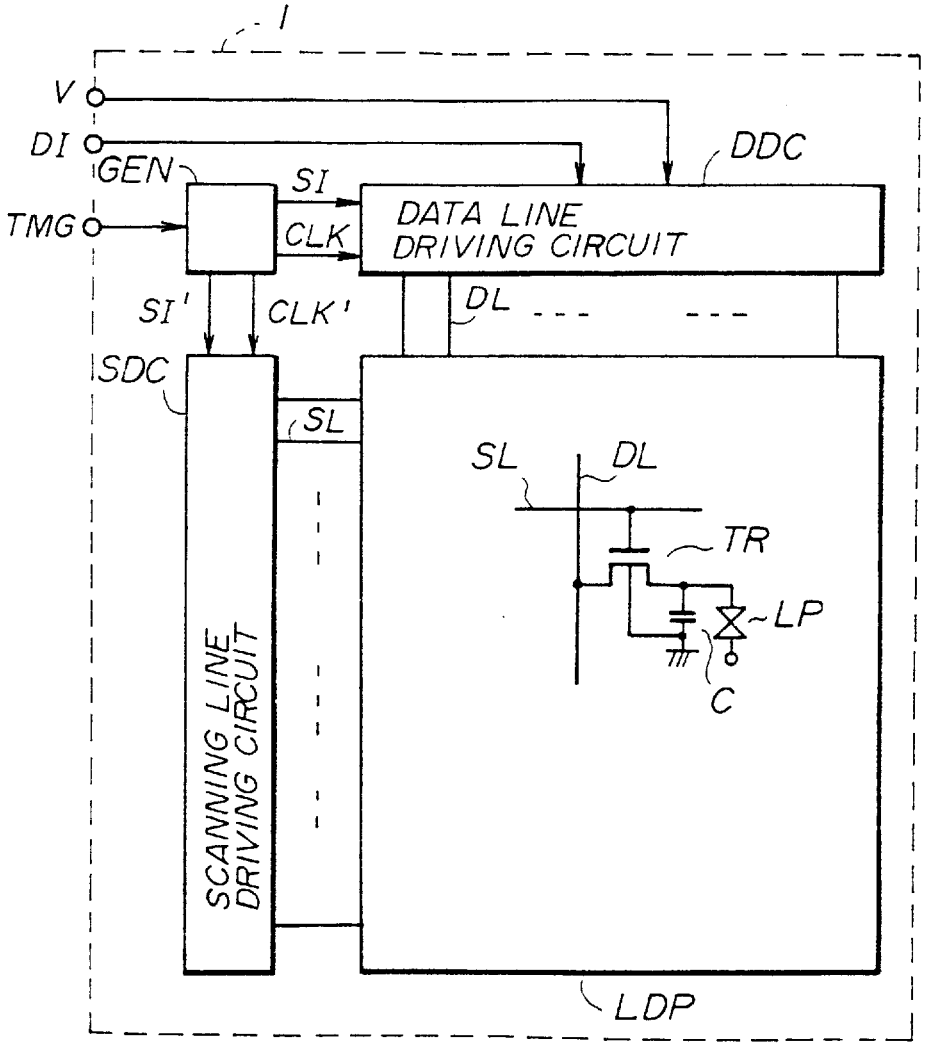
FIG. 1 is a block diagram of a liquid-crystal display device of the active matrix type.

The liquid-crystal display device shown in FIG. 1 includes a liquid-crystal display panel 1 having a liquid-crystal display part LDP, a timing generating circuit GEN, a data line driving circuit DDC, and a scanning line driving circuit SDC. A plurality of liquid-crystal display elements LP are arranged in rows and columns on the liquid-crystal display panel 1.

The timing generating circuit GEN receives a timing signal TMG from an external device, and outputs a starting signal SI and a clock signal CLK to the data line driving circuit DDC, and outputs a starting signal SI' and a clock signal CLK' to the scanning line driving circuit SDC. These signals are synchronized with each other. The data line driving circuit DDC further receives display data D and a voltage signal V, and drives data lines (column electrodes) DL connected to the display elements LP arranged in rows and columns. The circuit DDC can sequentially drive the data lines or drive the data line at once. The scanning line driving circuit SDC drives scanning line (row electrodes) SL connected to the display element LP. The circuit SDC can sequentially drive the scanning lines or drive the scanning line at once. Each of the liquid-crystal display element LP includes a transistor TR and a capacitor C. The drain of the transistor TR is connected to the corresponding data line DL, and the gate thereof is connected to the corresponding scanning line SL. The capacitor C is connected between the backgate (grounded) of the transistor TR and the source thereof. One end of the liquid-crystal display element LP is connected to the source of the transistor TR, and the other end thereof is set to a reference potential.

Figure 2:
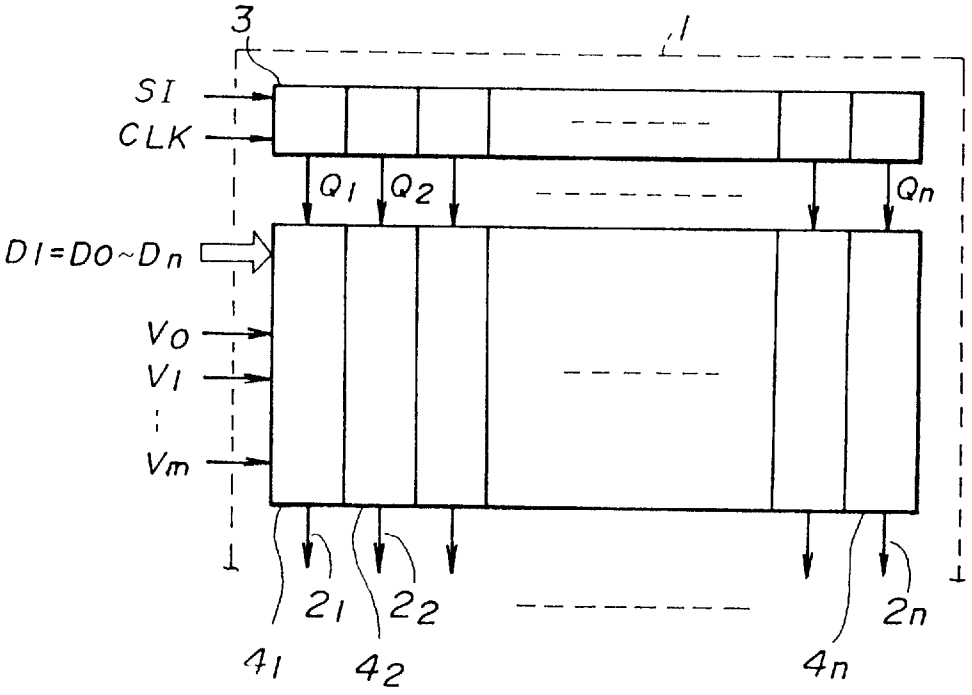
FIG. 2 is a block diagram of a conventional data line driving circuit used in the liquid-crystal display device shown in FIG. 1.

FIG. 2 is a block diagram of a conventional structure of the data line driving circuit DDC shown in FIG. 1. In FIG. 2, the data line driving circuit DDC shown in FIG. 2 includes a shift register 3 and driving voltage output circuits $\mathbf{4}_1$, $\mathbf{4}_2$, . . . , $\mathbf{4}_n$ where n is an integer. Data lines (which correspond to the data lines DL shown in FIG. 1) $\mathbf{2}_1$, $\mathbf{2}_2$, . . . , $\mathbf{2}_n$ extend from the driving voltage output circuits $\mathbf{4}_1$, $\mathbf{4}_2$, . . . , $\mathbf{4}_n$, respectively. The shift register 3 is of a serial input/parallel output type, and the data shift operation thereof is carried out so that the starting signal SI supplied every horizontal scanning period is shifted in synchronism with the clock signal CLK. The driving voltage output circuits $\mathbf{4}_1$, $\mathbf{4}_2$, . . . , $\mathbf{4}_n$ respectively receive digital image signal DI equal to one pixel in synchronism with output signals Q1, Q2, . . . , Qn of the shift register 3. Each of the driving voltage output circuits $\mathbf{4}_1$, $\mathbf{4}_2$, . . . , $\mathbf{4}_n$ receives driving voltages (gradation voltages) V0, V1, . . . , Vm (m is an integer), and selects one of these driving voltages on the basis of the digital image signal DI. The driving voltages respectively selected by the driving voltage output circuits $\mathbf{4}_1$, $\mathbf{4}_2$, . . . , $\mathbf{4}_n$ are applied to the data lines $\mathbf{2}_1$, $\mathbf{2}_2$, . . . , $\mathbf{2}_n$, respectively.

Figure 3:
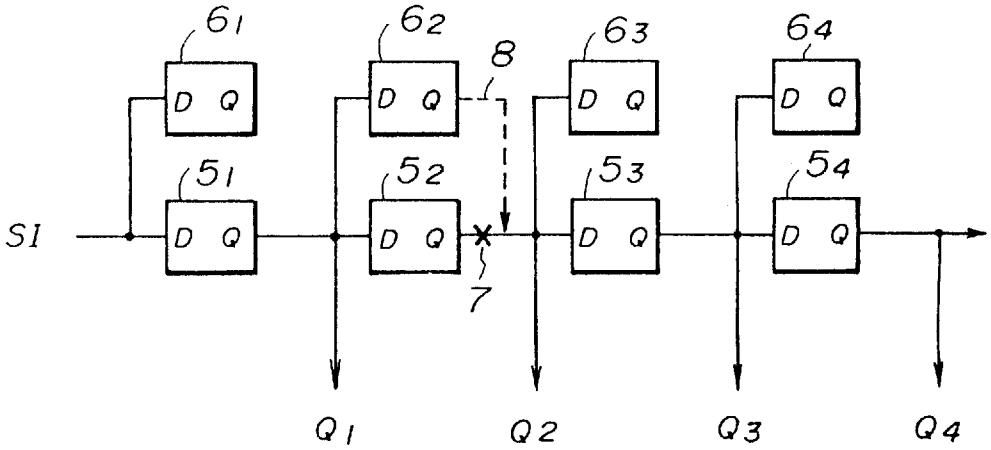
FIG. 3 is a block diagram of a conventional shift register used for configuring the data line driving circuit.

FIG. 3 shows a conventional configuration of the data line driving circuit DDC designed to avoid a defect which has occurred in the shift register 3. More particularly, FIG. 3 shows a configuration of the shift register 3 shown in FIG. 2. The shift register 3 shown in FIG. 3 are made up of primary registers $\mathbf{5}_1$ through $\mathbf{5}_{54}$, and secondary (spare or redundant) registers $\mathbf{6}_1$–$\mathbf{6}_4$ respectively provided for the primary registers $\mathbf{5}_1$ through $\mathbf{5}_4$. Each of these registers is formed with a one-bit D-type flip-flop. The primary registers $\mathbf{5}_1$ through $\mathbf{5}_4$ are cascaded. The input terminals of the secondary registers $\mathbf{6}_1$ through $\mathbf{6}_4$ are connected to the input terminals of the primary registers $\mathbf{5}_1$ through $\mathbf{5}_4$, respectively, and the output terminals of the secondary registers $\mathbf{6}_1$ through $\mathbf{6}_4$ are maintained in the open state. If there is no defect in the primary registers $\mathbf{5}_1$–$\mathbf{5}_4$, these registers are used. If one of the primary registers $\mathbf{5}_1$–$\mathbf{5}_4$ is defective, the corresponding secondary register is used instead of the defective primary register. For example, if the primary register $\mathbf{5}_2$ has a defect, the output line thereof is cut by a laser beam or the like, and output terminal of the secondary register $\mathbf{6}_2$ is connected to the input terminal of the primary register 53. Thereby, the secondary register $\mathbf{6}_2$ operates instead of the primary register $\mathbf{5}_2$.

Generally lines can be easily cut, while it is very difficult to join lines together, for example, to connect the output line of the secondary register $\mathbf{6}_3$ to the input line of the primary register $\mathbf{5}_3$.

The present invention is intended to eliminate the above disadvantage.

FIRST EMBODIMENT

Figure 4:
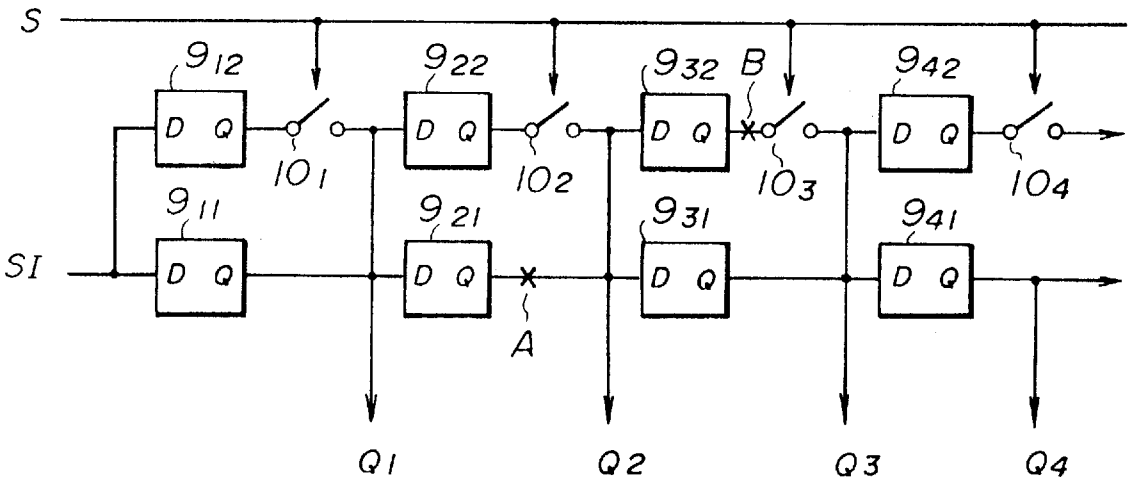
FIG. 4 is a block diagram of a first embodiment of the present invention.

FIG. 4 shows an overview of a first embodiment of the present invention. More particularly, FIG. 4 shows a shift register which can be used in the data line driving circuit DDC or the scanning line driving circuit SDC. The shift register shown in FIG. 4, receiving the starting signal SI necessary for the horizontal or vertical scanning direction includes shift registers $\mathbf{9}_{11}$ through $\mathbf{9}_{41}$, shift registers $\mathbf{9}_{12}$ through $\mathbf{9}_{42}$, and switches $\mathbf{10}_1$–$\mathbf{10}_4$, which are turned ON and OFF in response to a common control signal S. Each of the shift registers $\mathbf{9}_{11}$ through $\mathbf{9}_{41}$, and $\mathbf{9}_{12}$ through $\mathbf{9}_{42}$, is formed with a one-bit D-type flip-flop.

The shift register shown in FIG. 4 has four stages. More particularly, the first stage of the shift register is made up of the registers $\mathbf{9}_{11}$ and $\mathbf{9}_{12}$, and the switch $\mathbf{10}_1$. The second stage of the shift register is made up of the registers $\mathbf{9}_{21}$ and $\mathbf{9}_{22}$, and the switch $\mathbf{10}_2$. The third stage of the shift register is made up of the registers $\mathbf{9}_{31}$ and $\mathbf{9}_{32}$, and the switch $\mathbf{10}_3$. The fourth stage of the shift register is made up of the registers $\mathbf{9}_{41}$, and $\mathbf{9}_{42}$, and the switch $\mathbf{10}_4$.

In short, the driving circuit (more particularly, shift register) according to the first embodiment of the present invention includes a plurality of cascaded stages, in each of which a register $\mathbf{9}_{i2}$ is connected in parallel with a register $\mathbf{9}_{i1}$ via a switch $\mathbf{10}_i$ where i is a positive integer. The first stage of the driving circuit receives the starting signal SI necessary for the horizontal or vertical scanning operation. The driving circuit shown in FIG. 4 is integrated on a liquid-crystal display panel of the liquid-crystal display device of the active matrix type.

In operation, the control signal S turns OFF the switches $\mathbf{10}_1$ through $\mathbf{10}_4$. In this state, a display check of the liquid-crystal display panel is carried out. If the result of the display check does not show any defect, it is concluded that the registers $\mathbf{9}_{11}$ through $\mathbf{9}_{41}$, do not have any defect. In the normal operation, the switches $\mathbf{10}_1$ through $\mathbf{10}_4$ are held in the OFF state.

If the result of the display check shows that, for example, the register $\mathbf{9}_{21}$ is defective for example, the output line of the register $\mathbf{9}_{21}$ is cut at point A, and the switches $\mathbf{10}_1$ through $\mathbf{10}_4$ are turned ON by the control signal S. In this state, the display check is carried out. If the result of the display check shows that the register $9_{32}$ is defective, the output line of the register $9_{32}$ is cut at point B, and the display check is continued in the state in which the switches $10_1$ through $10_4$ are held in the ON state.

In the above manner, defective stages of the shift register are recovered. In this case, the normal operation needs the state in which the switches $10_1$ through $10_4$ are held in the ON state. Since the defective stages can be recovered by solely cutting the output lines of defective registers rather than making a connection, it is possible to easily recover the defective stages of the shift register and to be continuously used.

SECOND EMBODIMENT

A description will now be given of a second embodiment of the present invention.

Figure 5A:
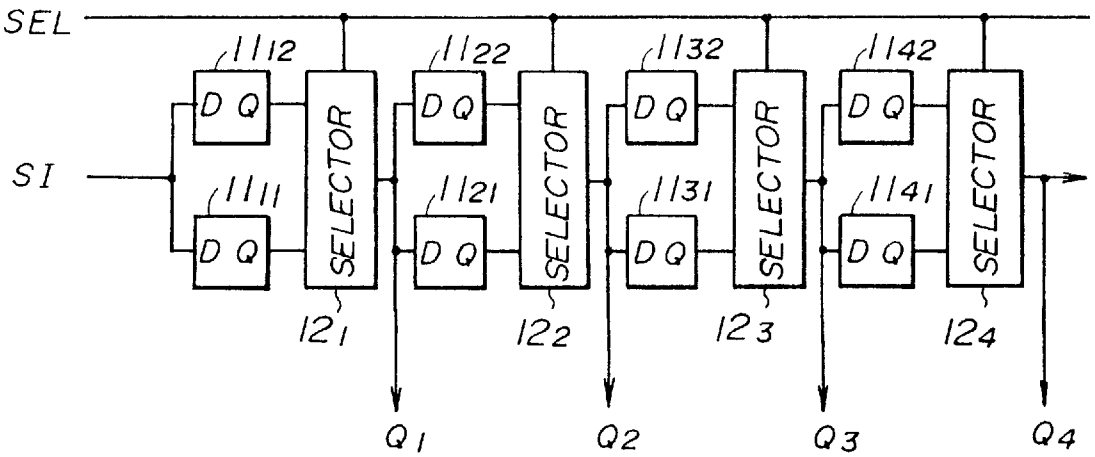
FIG. 5A is a block diagram of a second embodiment of the present invention.
Figure 5B:
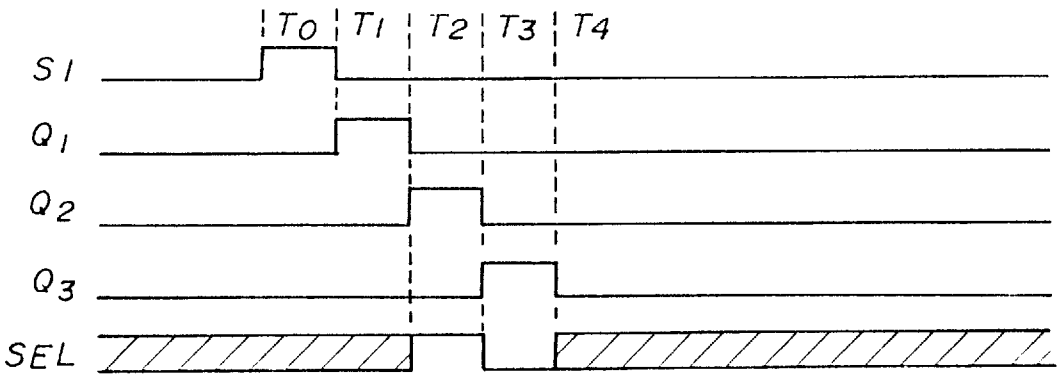
FIG. 5B is a waveform diagram showing the operation of the second embodiment of the present invention shown in FIG. 5A.

FIG. 5A shows an overview of the second embodiment of the present invention, and FIG. 5B shows the operation of the second embodiment of the present invention. More particularly, FIG. 5A shows a shift register of the serial input/parallel output type, which receives the starting signal SI necessary for the horizontal or vertical scanning operation.

The shift register shown in FIG. 5A has four stages. The first stage of the shift register is made up of two registers $11_{11}$ and $11_{12}$, and a selector $12_1$. The second stage of the shift register is made up of two registers $11_{21}$ and $11_{22}$, and a selector $12_2$. The third stage of the shift register is made up of two registers $11_{31}$ and $11_{32}$, and a selector $12_3$. The fourth stage of the shift register is made up of two registers $11_{41}$, and $11_{42}$, and a selector $12_4$. Each of the above registers is formed with a one-bit D-type flip-flop. The common select signal SEL is applied to the selectors $12_1$ through $12_4$. The starting signal SI is applied to the registers $11_{11}$ and $11_{12}$ of the first stage.

In short, the driving circuit (shift register) according to the second embodiment includes a plurality of cascaded stages, each of which is made up of two registers $11_{i1}$ and $11_{i2}$ having input terminals connected together, and a selector $12_i$ selecting either the register $11_{i1}$ or $11_{i2}$ in response to the common select signal SEL (i is a positive integer). The driving circuit shown in FIG. 5A is integrated on a liquid-crystal display panel.

A defective register is detected by a display check. If it is determined that the register $11_{21}$ of the second stage and the register $11_{32}$ of the third stage are defective, the level of the select signal is varied to control the selectors $12_1$ through $12_4$, as shown in FIG. 5B. Hence, the correct operation can be ensured.

More particularly, during period T2 in which the second stage latches and outputs the starting signal SI output from the first stage, the level of the select signal SEL is controlled so that the selectors $12_1$ through $12_4$ respectively select the registers $11_{12}$–$11_{42}$, (for example, the high level). In this state, the starting signal SI latched by the register $11_{22}$ is output via the selector $12_2$. Further, during period T3 in which the third stage latches and outputs the starting signal SI output from the second stage, the level of the select signal SEL is controlled so that the selectors $12_1$ through $12_4$ respectively select the registers $11_{11}$ through $11_{41}$, (for example, the low level). In this stage, the starting signal SI latched by the register $11_{31}$ is output via the selector $12_3$.

In a case where the output signals of the registers $11_{21}$ and $11_{32}$ are defectively held at the low level, the select signals SEL may be at the high level or the low level during periods other than the periods T2 and T3 because the output signals of the first and second stages are at the low level irrespective of whether the select signal SEL is at the high level or the low level. Hatched areas regarding the select signal SEL shown in FIG. 5B means the above. If the output signals of the registers $11_{21}$ and $11_{32}$ are defectively fixed to the high level, the polarity of the starting signal SI is inverted so that the shift register is made to operate on the negative-logic base. In this manner, the correct shift operation can be ensured.

According to the second embodiment of the present invention, the correct operation can be ensured by switching the levels of the select signal SEL rather than cutting and connecting wiring lines so that defective registers are not selected.

Figure 6:
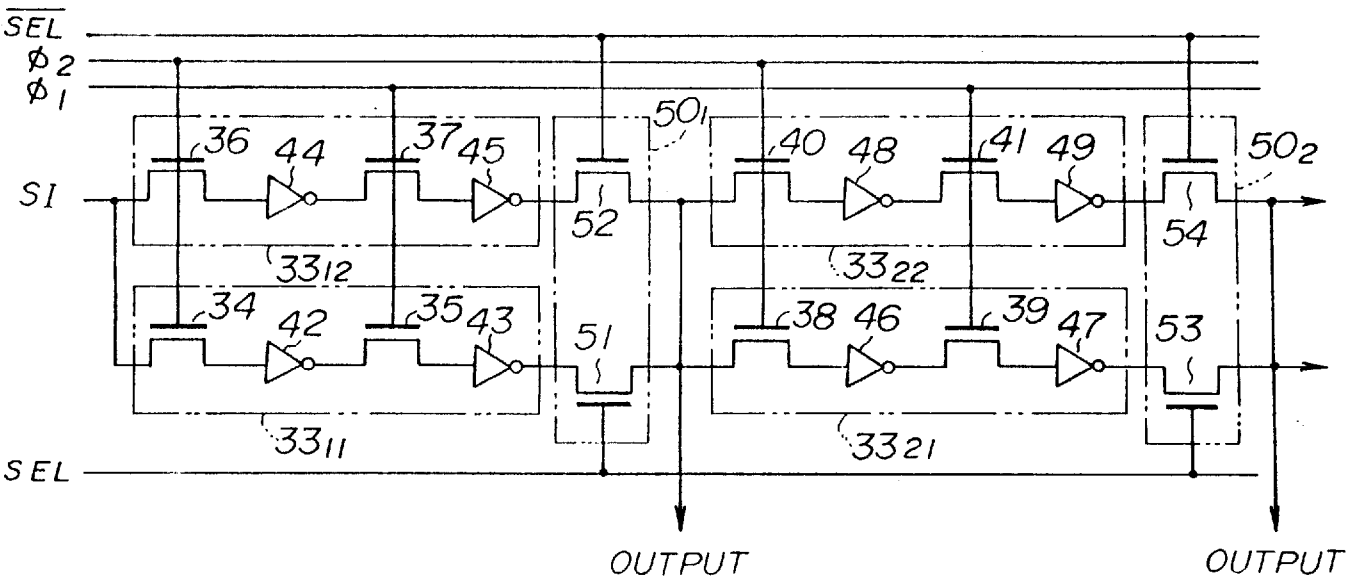
FIG. 6 is a circuit diagram of an essential part of the second embodiment of the present invention shown in FIG. 5A.

FIG. 6 shows an essential part of the second embodiment of the present invention in more detail. The first stage of the shift register shown in FIG. 6 is made up of registers $33_{11}$ and $33_{12}$ and a selector $50_1$. Similarly, the second stage of the shift register is made up of registers $33_{21}$ and $33_{22}$ and a selector $50_2$. The register $33_{11}$ is made up of two n-channel MOS transistors 34 and 35, and two inverters 42, and 43. The register $33_{12}$ is made up of two n-channel MOS transistors 36 and 37, and two inverters 44 and 45. The selector $50_1$ includes two n-channel MOS transistors 51 and 52. The register $33_{21}$ is made up of two n-channel MOS transistors 38 and 39 and two inverters 46 and 47. The register $33_{22}$ is made up of two n-channel MOS transistors 40 and 41, and two inverters 48 and 49. The selector $50_2$ includes two n-channel MOS transistors 53 and 54. Hereinafter, an n-channel MOS transistor is simply referred to as an nMOS transistor.

A register control signal $\phi_1$ is applied to the gates of the nMOS transistors 35, 37, 39 and $4_1$, and a register control signal $\phi_2$ is applied to the gates of the nMOS transistors 34, 36, 38 and 40. Further, a select signal SEL is applied to the gates of the nMOS transistors 51 and 53. A select signal /SEL ("/" corresponds to a bar shown in FIG. 6), which is an inverted version of the select signal SEL, is applied to the gates of the nMOS transistors 52 and 54.

Figure 7:
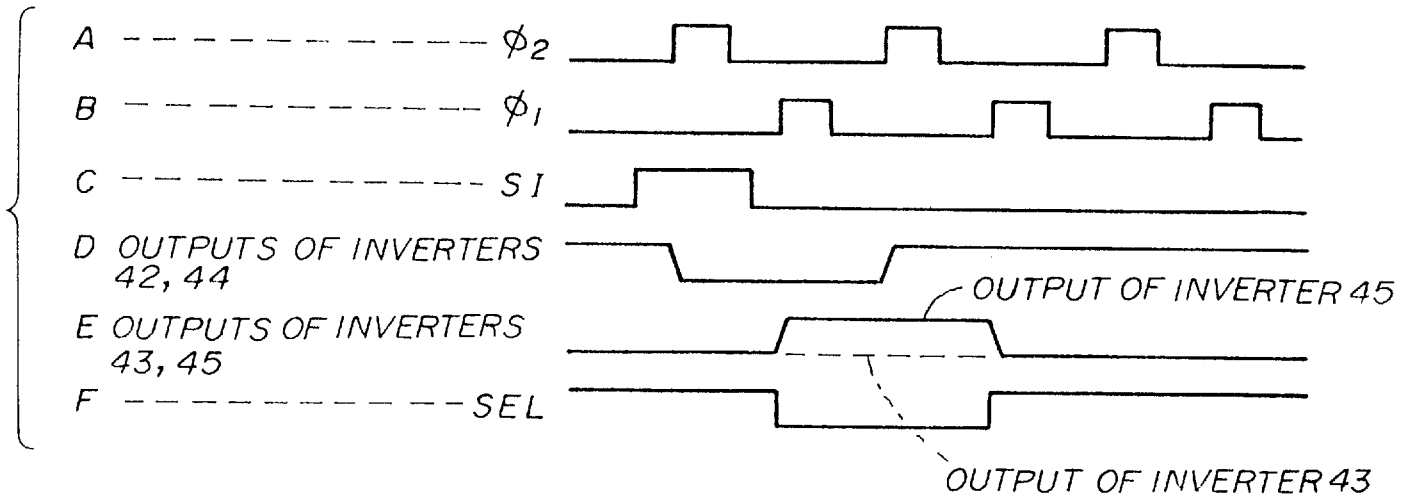
FIG. 7 is a waveform diagram showing the operation of the configuration shown in FIG. 6.

FIG. 7 is a waveform diagram showing the operation of the second embodiment of the present invention. The operation shown in FIG. 6 relates to a case where the output terminal of the inverter 43 shown in FIG. 6 is defectively fixed at a low (L) level, that is, the output signal of the register $33_{11}$ is defectively fixed at the low level. Part A of FIG. 7 shows the register control signal $\phi_2$, part B thereof shows the register control signal $\phi_1$, part C thereof shows the starting signal SI, part D thereof shows the output signals of the inverters 42, and 44, part E thereof the output signals of the inverters 43 and 45, and part F thereof shows the select signal SEL.

In the second embodiment of the present invention, the starting signal SI set to the high (H) level is input, and thereafter the register control signal $\phi_2$ switches to the high level. Hence, the nMOS transistors 34 and 36 are turned ON, and the start signal SI is input to the first stage of the shift register. Then, the output signals of the inverters 42, and 44 are switched to the low level.

When the register control signal $\phi_2$ switches to the low level and the starting signal SI switches to the low level, the register control signal $\phi_1$ is switched to the high level. Hence, the nMOS transistors 35 and 37 are turned ON. In this case, the output signal of the inverter 45 is switched to the high level. However, the inverter 43 is defectively held at the low level, and hence the output signal of the inverter 43 is not changed.

With the above in mind, the select signal SEL is switched to the low level and the select signal /SEL is switched to the high level when the output signal of the inverter 45 is switched to the high level. Thereby, the nMOS transistor 51 is turned OFF, and the nMOS transistor 52 is turned ON. Hence, the output signal of the inverter 45 is applied to the second stage of the shift register.

When the register control signal $\phi_1$ switches to the low level and the register control signal $\phi_2$ switches to the high level, the output signals of the inverters 42, and 44 are switched to the high level. When the register control signal $\phi_2$ switches to the low level and the register control signal $\phi_1$ switches to the high level, the output signal of the inverter 45 is switched to the low level.

With the above in mind, the select signal SEL is switched to the high level and the select signal /SEL is switched to the low level when the output signal of the inverter 45 is switched to the low level. Hence, the nMOS transistor 51 is turned ON and the nMOS transistor 52 is turned OFF.

In the above manner, the correct shift operation can be ensured by controlling the levels of the select signals SEL and /SEL even if the output signal of the register $\mathbf{33}_{11}$ is defectively fixed to the low level if the register $\mathbf{33}_{21}$ operates normally. That is, if either the register $\mathbf{33}_{i1}$, or $\mathbf{33}_{i2}$ is defective, the correct shift operation can be ensured by controlling the levels of the select signals SEL and /SEL so that the defective register is not selected. Hence, according to the second embodiment of the present invention, it is possible to ensure the correct operation without cutting and connecting wiring lines if the shift register has a defective register.

Figure 8:
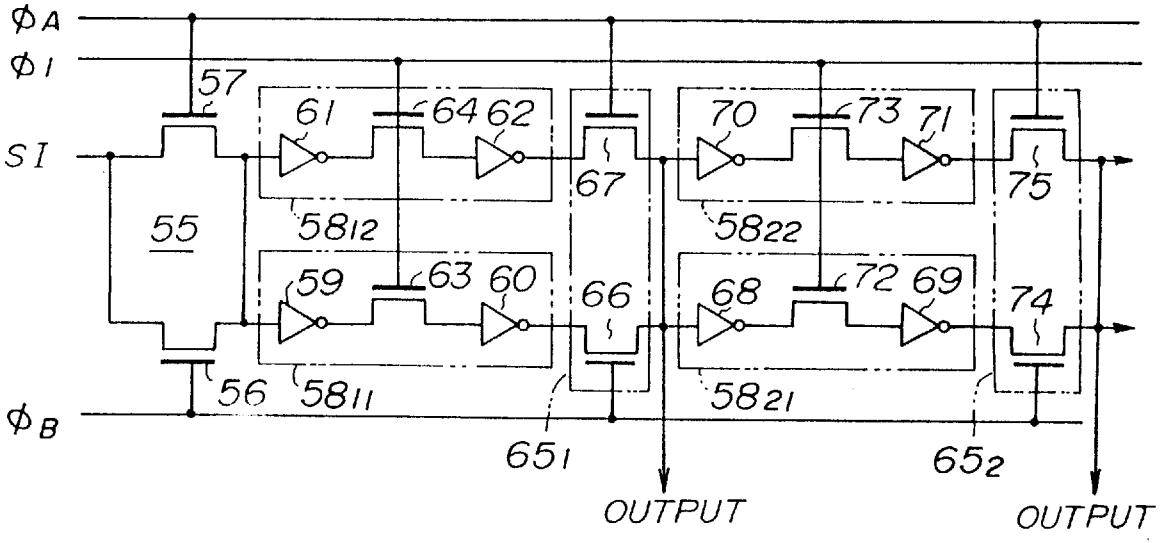
FIG. 8 is a circuit diagram of another configuration of the second embodiment of the present invention shown in FIG. 5A.

FIG. 8 shows another configuration of the essential part of the second embodiment of the present invention in more detail. The configuration shown of FIG. 8 has two stages. More particularly, the first stage of the shift register is made up of two registers $\mathbf{58}_{11}$ and $\mathbf{58}_{12}$ and a selector $\mathbf{65}_1$, and the second stage thereof is made up of two registers $\mathbf{58}_{21}$ and $\mathbf{58}_{22}$, and a selector $\mathbf{65}_2$. Further, a switch 55 made up of nMOS transistors 56 and 57 is connected to the input terminals of the registers $\mathbf{58}_{11}$ and $\mathbf{58}_{12}$. The register $\mathbf{58}_{11}$ is made up of two inverters 59 and 60, and an nMOS transistor 63, and the register $\mathbf{58}_{12}$ is made up of two inverters 61 and 62, and an nMOS transistor 64. The selector $\mathbf{65}_1$ includes two nMOS transistors 66 and 67. The register $\mathbf{58}_{21}$ is made up of two inverters 68 and 69, and an nMOS transistor 72, and the register $\mathbf{58}_{22}$ is made up of two inverters 70 and 71, and an nMOS transistor 73. The selector $\mathbf{65}_2$ includes two nMOS transistors 74 and 75. The register control signal $\phi_1$ is applied to the gates of the nMOS transistors 63, 64, 72 and 73. A select signal $\phi_A$ is applied to the gates of the nMOS transistors 57, 67 and 75, and a select signal $\phi_B$ is applied to the gates of the nMOS transistors 56, 66 and 74.

Figure 9:
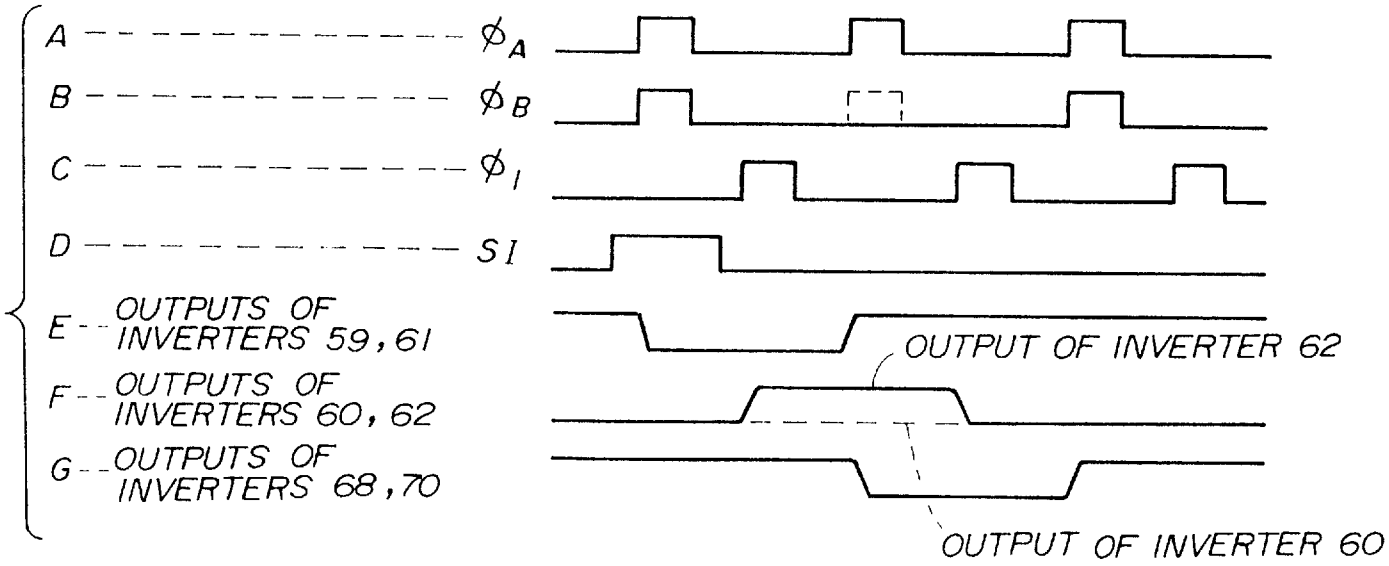
FIG. 9 is a waveform diagram showing the operation of the configuration shown in FIG. 8.

FIG. 9 is a waveform diagram showing the operation of the configuration shown in FIG. 8. More particularly, part A of FIG. 9 shows the select signal $\phi_A$, part B shows the select signal $\phi_B$, part C is the register control signal $\phi_1$ part D shows the starting signal SI, part E shows the output signals of the inverters 59 and 61, part F shows the output signals of the inverters 60 and 62, and part G shows the output signals of the inverters 68 and 70.

In operation, the starting signal set to the high level is input, and thereafter the select signals $\phi_A$ and $\phi_B$ are switched to the high level. Hence, the nMOS transistors 56 and 57 are turned ON, and the starting signal SI is input to the first stage of the shift register. Then, the output signals of the inverters 59 and 61 are switched to the low level.

When the select signals $\phi_A$ and $\phi_B$ are switched to the low level, and the starting signal SI switches to the low level, the register control signal $\phi_1$ is switched to the high level. In this case, the output signal of the inverter 62 is switched to the high level. However, the output signal of the inverter 60 is defectively fixed to the low level. Hence, the output signal of the inverter 60 is held at the low level.

Thereafter, the select signal $\phi_A$ is switched to the high level. In this case, the select signal $\phi_B$ is maintained at the low level, and the nMOS transistor 67 is ON and the nMOS transistor 66 is OFF. The output signal of the inverter 62 is output via the selector $\mathbf{65}_1$, and the starting signal SI is input to the second stage of the shift register. Hence, the output signals of the inverters 68 and 70 are switched to the low level.

Thereafter, the select signal $\phi_A$ is switched to the low level and the register control signal $\phi_1$ is switched to the high level. Hence, the output signal of the inverter 62 is switched to the low level. When the register control signal $\phi_1$ is switched to the low level and the select signals $\phi_A$ and $\phi_B$ are switched to the high level, the output signals of the inverters 68 and 70 are switched to the high level.

As described above, according to the second embodiment of the present invention, the correct operation can be ensured by controlling the levels of the select signals $\phi_A$ and $\phi_B$ even if the output signal of the register $\mathbf{58}_{11}$ is defectively fixed to the low level if the register $\mathbf{58}_{21}$ operates normally. That is, if either the register $\mathbf{58}_{i1}$ or $\mathbf{58}_{i2}$ is defective, the correct operation can be ensured by controlling the levels of the select signals $\phi_A$ and $\phi_B$ so that the defective register is not selected.

According to the second embodiment of the present invention, the correct operation can be ensured by switching the levels of the select signal SEL rather than cutting and connecting wiring lines so that defective registers are not selected.

THIRD EMBODIMENT

A description will now be given of a third embodiment of the present invention.

Figure 10:
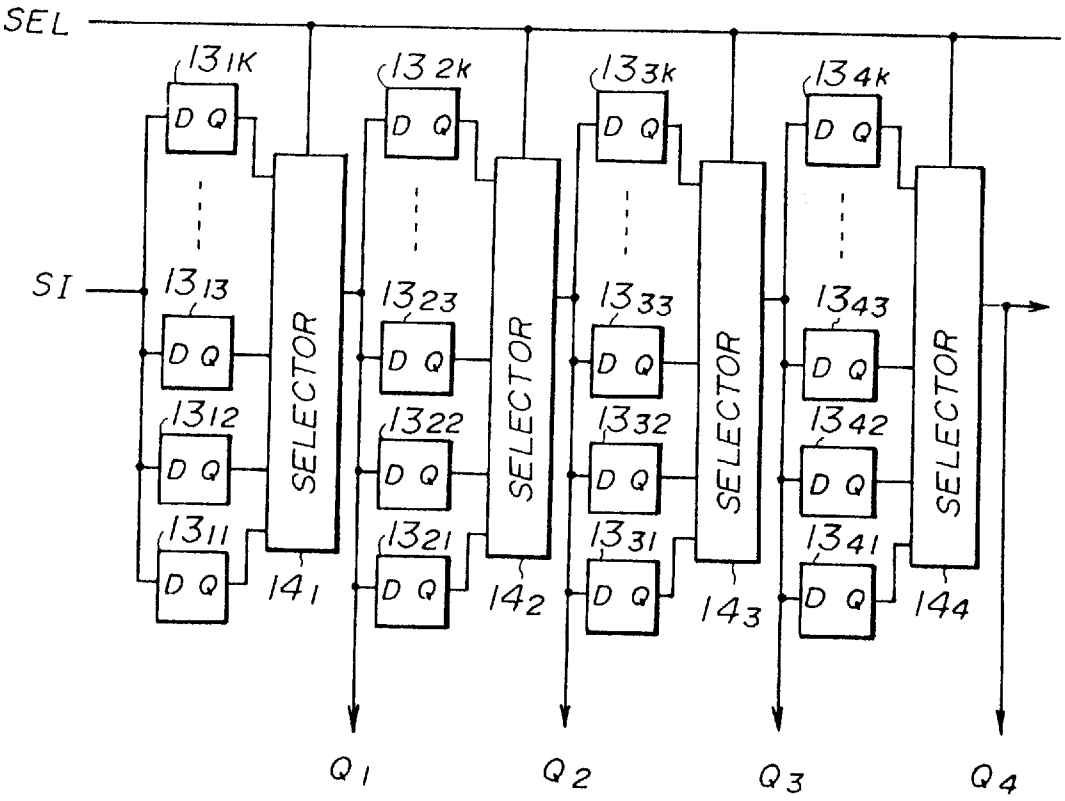
FIG. 10 is a block diagram of a third embodiment of the present invention.

FIG. 10 shows an overview of the third embodiment of the present invention, and more particularly shows the configuration of a shift register of the serial input/parallel output type, to which the starting signal SI necessary for the horizontal or vertical scanning operation is applied.

In FIG. 10, four stages of the shift register is illustrated. The first stage of the shift register is made up of a plurality of registers $\mathbf{13}_{11}$ through $\mathbf{13}_{1k}$, and a selector $\mathbf{14}_1$, and the second stage thereof is made up of a plurality of registers $\mathbf{13}_{21}$ through $\mathbf{13}_{2k}$, and a selector $\mathbf{14}_2$. Further, the third stage of the shift register is made up of a plurality of registers $\mathbf{13}_{31}$ through $\mathbf{31}_{3k}$ (k is a positive integer), and a selector $\mathbf{14}_3$, and the fourth stage thereof is made up of a plurality of registers $\mathbf{14}_{41}$, through $\mathbf{14}_{4k}$, and a selector $\mathbf{14}_4$. Each of the registers is formed with a one-bit D-type flip-flop. The common select signal SEL is applied to the selectors $\mathbf{14}_1$, through $\mathbf{14}_4$.

The input terminals of the registers $\mathbf{13}_{11}$ through $\mathbf{13}_k$ are connected to each other and receives the starting signal SI. The output terminals of the registers $\mathbf{13}_{11}$ through $\mathbf{13}_{1k}$ are connected to the selector $\mathbf{14}_1$. The input terminals of the registers $\mathbf{13}_{21}$ through $\mathbf{13}_{2k}$ are connected to the output terminal of the selector $\mathbf{14}_1$, and the output terminals thereof are connected to the selector $\mathbf{14}_2$. The output signal Q1 is output from the selector $\mathbf{14}_1$. In the configuration shown in FIG. 10, each of the stages includes the selector. Alternatively, a selector can be provided at a specific stage only.

In short, the driving circuit according to the third embodiment of the present invention includes a plurality of stages cascaded, each or some of which stages is made up of a plurlaity of registers $\mathbf{13}_{i1}$ through $\mathbf{13}_{ik}$, and a selector $_{14i}$ where i and j are positive integers.

A defective register can be detected by a display check. Even if one or more registers $\mathbf{13}_{i1}$ through $\mathbf{13}_{ik}$ of a stage having the selector $\mathbf{14}_i$ are defective, the correct operation of this stage can be ensured, if at least one normal register is available, by controlling the level of the select signal SEL so that such a normal register is selected. It will be noted that the above operation does not need the process of cutting and connecting wiring lines.

FOURTH EMBODIMENT

A description will now be given of a fourth embodiment of the present invention.

Figure 11:
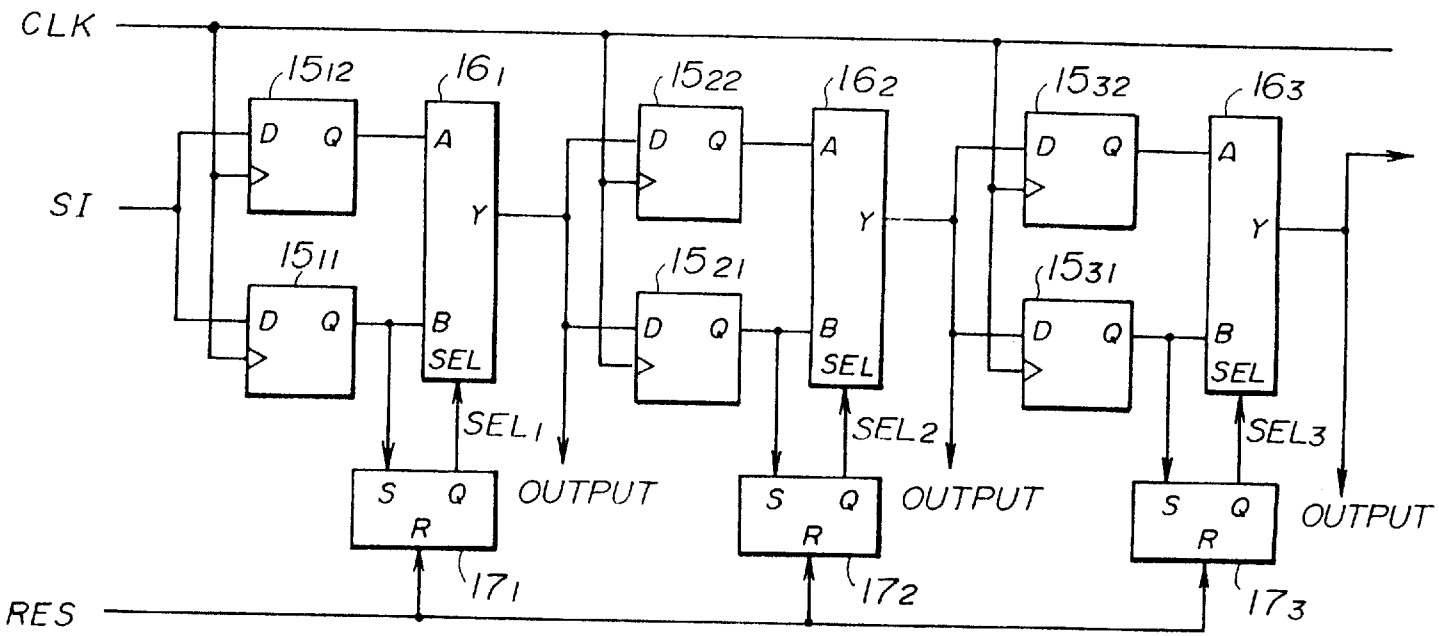
FIG. 11 is a block diagram of a fourth embodiment of the present invention.

FIG. 11 shows a configuration of the fourth embodiment of the present invention, and more particularly to a shift register of the serial input/parallel output type, to which the starting signal SI necessary for the horizontal or vertical scanning operation is applied.

In FIG. 11, three stages of the shift register are illustrated. The first stage of the shift register is made up of registers $\mathbf{15}_{11}$ and $\mathbf{15}_{12}$, a selector $\mathbf{16}_1$ and a defect detection/selector control circuit $\mathbf{17}_1$. The second stage of the shift register is made up of registers $\mathbf{15}_{21}$ and $\mathbf{15}_{22}$, a selector $\mathbf{16}_2$ and a defect detection/selector control circuit $\mathbf{17}_2$. The third stage of the shift register is made up of registers $\mathbf{15}_{31}$ and $\mathbf{15}_{32}$, a selector $\mathbf{16}_3$ and a defect detection/selector control circuit $\mathbf{17}_3$. Each of the above registers is formed with a one-bit D-type flip-flop.

The selectors $\mathbf{16}_1$ through $\mathbf{16}_3$ each have two input terminals, and are controlled by select signals SEL1, SEL2 and SEL3, respectively.

Each of the defect detection/selector control circuits $\mathbf{17}_1$ through $\mathbf{17}_3$ is formed with an RS-type flip-flop. The circuits $\mathbf{17}_1$ through $\mathbf{17}_3$ are initialized in response to a common reset signal RES. In this state, the selectors $\mathbf{17}_1$ through $\mathbf{17}_3$ cause the selectors $\mathbf{16}_1$ through $\mathbf{16}_3$ to select the registers $\mathbf{15}_{12}$ through $\mathbf{15}_{32}$, respectively. After the selectors $\mathbf{17}_1$ through $\mathbf{17}_3$ are initialized, these selectors monitor variations in the output levels of the registers $\mathbf{15}_{11}$ through $\mathbf{15}_{31}$. When variations in the output levels of the registers $\mathbf{15}_{11}$ through $\mathbf{15}_{31}$ are detected, the circuits $\mathbf{17}_1$ through $\mathbf{17}_3$ cause the selectors $\mathbf{16}_1$ through $\mathbf{16}_3$ to select the registers $\mathbf{15}_{11}$ through $\mathbf{15}_{31}$, respectively.

In short, the driving circuit according to the fourth embodiment of the present invention includes a plurality of stages cascaded, each of which stages is made up of two registers $\mathbf{15}_{i1}$ and $\mathbf{15}_{i2}$, a selector $\mathbf{16}_1$ and a defect detection/selector control circuit $\mathbf{17}_i$. When the circuit $\mathbf{17}_i$ is initialized, the circuit $\mathbf{17}_i$ causes the selector $\mathbf{16}_i$ to select the register $\mathbf{15}_{i2}$, Thereafter, the circuit $\mathbf{17}_i$ monitors a variation in the output level of the register $\mathbf{15}_{i1}$. When a variation in the output level of the register $\mathbf{15}_{i1}$ is detected, the circuit $\mathbf{17}_i$ causes the selector $\mathbf{16}_i$ to select the register $\mathbf{15}_{i1}$. Hence, even if the register $\mathbf{15}_{i1}$ is defective, the correct operation can be ensured if the register $\mathbf{15}_{i2}$ operates normally. Similarly, even if the register $\mathbf{15}_{i2}$ is defective, the correct operation can be ensured if the register $\mathbf{15}_{i1}$ operates normally. That is, either the register $\mathbf{15}_{i1}$ or $\mathbf{15}_{i2}$ operates normally, the correct operation can be ensured. In this case, the process for cutting and connecting wiring lines is not needed.

Figure 12:
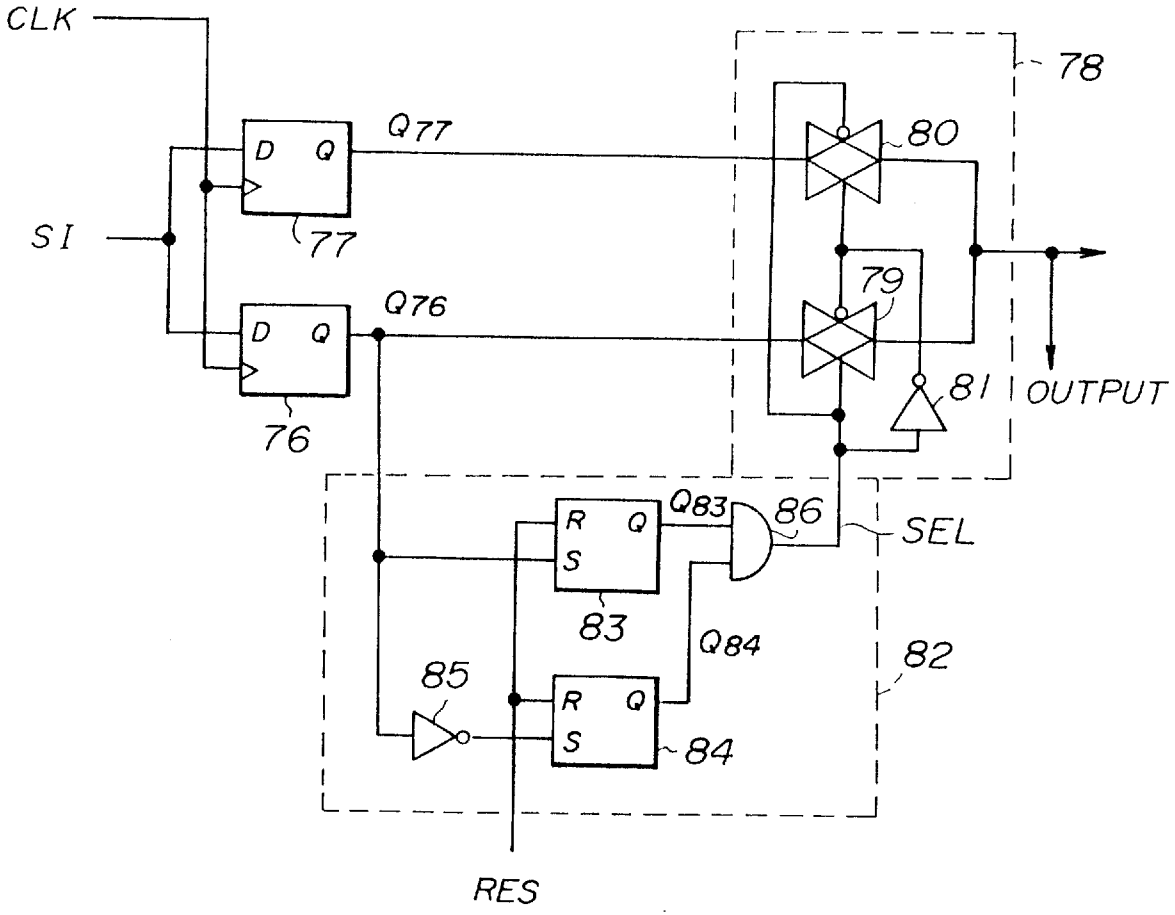
FIG. 12 is a block diagram of an essential part of the fourth embodiment of the present invention shown in FIG. 11.

FIG. 12 shows an essential part of the fourth embodiment of the present invention in more detail, and more particularly a stage of the shift register. The configuration shown in FIG. 11 includes registers 76 and 77, a selector 78 and a defect detection/selector control circuit 82. The register 76 is formed with a one-bit D-type flip-flop of a negative-edge trigger type, and functions as a primary register. The register 77 is formed with a one-bit D-type flip-flop of a positive-edge trigger type, and functions as a secondary register.

The selector 78 selects either an output signal Q76 of the register 76 or an output signal Q77 of the register 77 in accordance with a select signal SEL generated by the control circuit 82. The selector 78 includes transfer gates 79 and 80, and an inverter 81. When the select signal SEL is at the high level, the transfer gates 79 and 80 are ON and OFF, respectively, whereby the selector 78 selects the output signal Q76 of the primary register 76. When the select signal SEL is at the low level, the transfer gates 79 and 80 are OFF and ON, respectively, so that the selector 77 selects the output signal Q77 of the secondary register 77.

The defect detection/selector control circuit 82 is made up of two RS-type flip-flops 83 and 84, an inverter 85 and an AND circuit 86. When output signals Q83 and Q84 of the flip-flops 83 and 84 are at the high level, the select signal SEL is set to the high level. When the flip-flop 83 is set when the output signal Q76 of the primary register 76 is switched to the high level. Hence, the output signal Q83 of the flip-flop 83 is switched to the high level. In this state, when the reset signal RES is switched to the high level, the flip-flop 83 is reset and changes its output signal Q83 to the low level. When the output signal Q76 of the primary register 76 is switched to the low level, the flip-flop 84 is set and changes its output signal Q84 to the high level. In this state, when the reset signal RES is switched to the high level, the flip-flop 84 is reset, and causes its output signal Q84 to the low level.

Figure 13:
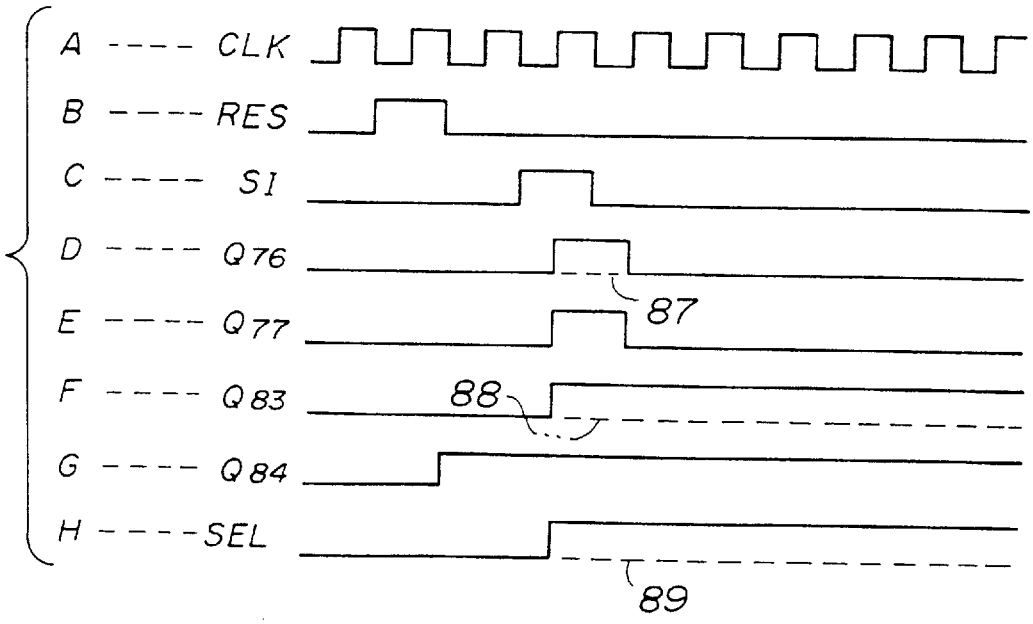
FIG. 13 is a waveform diagram showing the operation of the configuration shown in FIG. 12.

FIG. 13 is a waveform diagram showing the operation of the fourth embodiment of the present invention shown in FIG. 12. In FIG. 13, part A shows the clock signal CLK controlling the registers 76 and 77, part B shows the reset signal RES, part C shows the starting signal SI, part D shows the output signal Q76 of the primary register 76, part E shows the output signal Q77 of the secondary register 77, part F shows the output signal Q83 of the RS flip-flop 83, part G shows the output signal Q84 of the RS flip-flop 84 and part H shows the select signal SEL.

At the commencement of the operation, the reset signal RES is switched to the high level, and thereby the RS flip-flops 83 and 84 are reset and changes the output signals Q83 and Q84 to the low level. Hence, the select signal SEL is switched to the low level, whereby the transfer gates 79 and 80 are turned OFF and ON, respectively. Thus, the selector 78 is caused to select the output signal Q77 of the secondary register 77.

If the primary register does not have a defect causing its output signal Q76 to be fixed to the high level, the output signal Q76 is at the low level and the output signal of the inverter 85 is at the high level. Hence, immediately after the reset signal RES is switched to the low level, the RS flip-flop 84 is set, and changes its output signal Q84 to the high level. In this case, the RS flip-flop 83 is not set, and hence the output signal Q83 is maintained at the low level. Hence, the select signal SEL is maintained at the low level, and the selector 78 continues to select the output signal Q77 of the secondary register 77.

When the starting signal SI set at the high level is input, the starting signal SI is latched in the primary register 76 and the secondary register 77 in synchronism with the leading edge of the clock signal CLK. If the registers 76 and 77 do not have a defect causing their output signals to be fixed to the low level, the output signals Q76 and Q77 of the registers 76 and 77 are switched to the high level. Hence, the RS flip-flop 83 is set, and changes its output signal Q83 to the high level. On the other hand, the output signal of the inverter 85 is switched to the low level. The reset signal RES is maintained in the low level, and hence the output signal Q84 of the RS flip-flop 84 is maintained at the high level. As a result, the select signal SEL is switched to the high level, and the transfer gates 79 and 80 are turned ON and OFF, respectively. Hence, the selector 78 selects the output signal of the primary register 76.

If the primary register 76 is defectively fixed to the low level, the output signal Q77 of the secondary register 77 is switched to the high level in response to the starting signal SI, while the output signal of the primary register 76 is maintained at the low level, as indicated by a broken line 87 in part D of FIG. 13. Hence, the RS flip-flop 83 is not set, and the output signal Q83 thereof is maintained at the low level as indicated by a broken line 88 in part (F) of FIG. 13. Further, the select signal SEL is maintained at the low level as indicated by a broken line 80 in part H of FIG. 13. Hence, the transfer gates 79 and 80 are maintained in the OFF and ON states, respectively, and the selector 78 selects the output signal Q77 of the secondary register 77.

As described above, according to the fourth embodiment of the present invention, the correct operation can be ensured even if the primary register 77 is defective under the condition that the primary register 76 operates normally. Further, the correct operation can be ensured even if the secondary register 78 is defective under the condition that the second register 77 operates normally. That is, when either the primary or secondary register operates normally, the correct operation of the corresponding stage can be ensured. It will be noted that the above process does not need to cut and connect connecting wires. Further, it is not necessary to supply the select signal from an external device.

Figure 14:
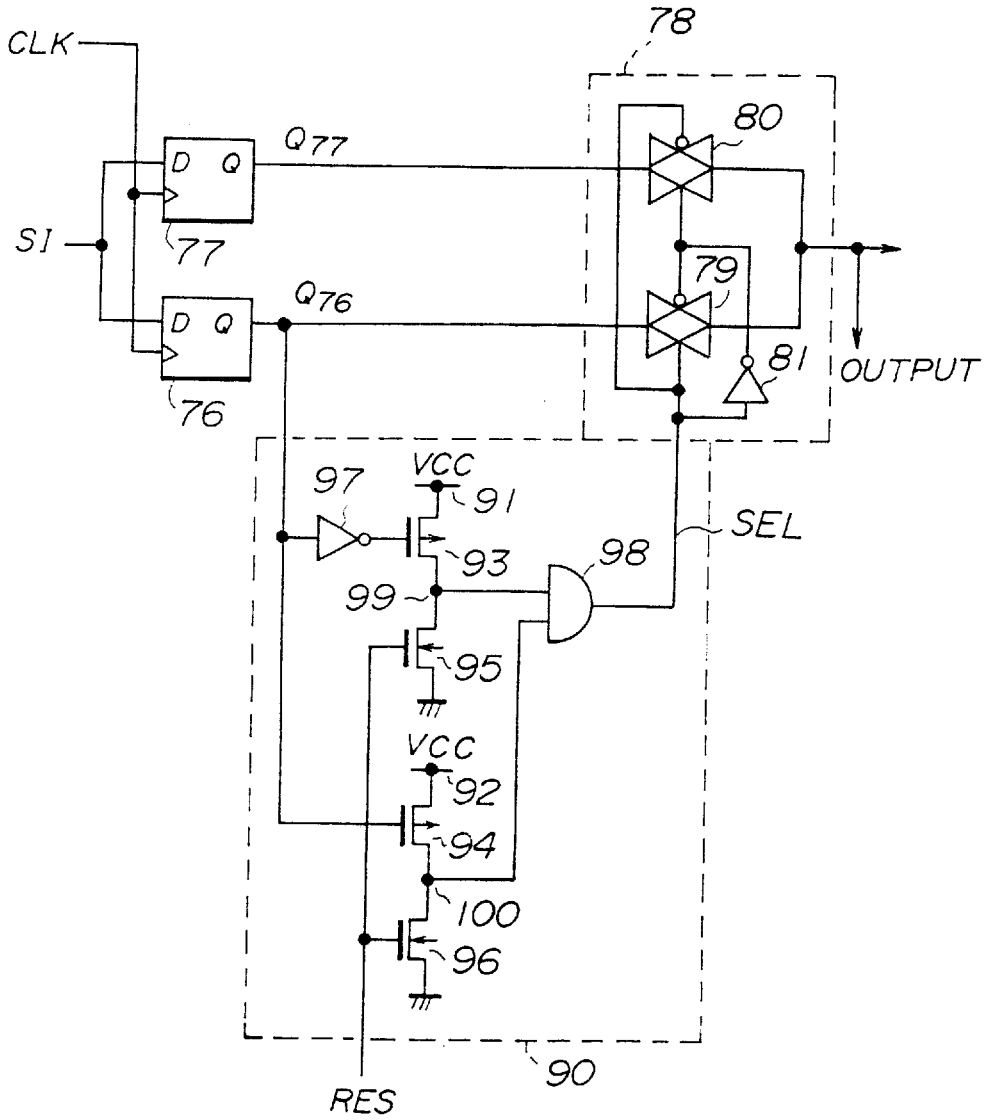
FIG. 14 is a block diagram of another configuration of the fourth embodiment of the present invention shown in FIG. 11.

FIG. 14 shows another configuration of the essential part of the fourth embodiment of the present invention, and more particularly shows a stage of the shift register. The configuration shown in FIG. 13 differs from that shown in FIG. 12 in that the former configuration has a defect detection/selector control circuit 90 instead of the circuit 82 shown in FIG. 12. The other parts of the configuration shown in FIG. 14 are the same as those of the configuration shown in FIG. 12.

The defect detection//selector control circuit 90 is made up of p-channel MOS (pMOS) transistors 93 and 94, nMOS transistors 95 and 96, an inverter 97, and an AND circuit 98. Reference numbers 91 and 92 indicate power supply lines maintained at a power supply voltage VCC.

When the output signal Q76 of the primary register 76 is at the low level, the PMOS transistors 93 and 94 are OFF and ON, respectively. In this state, when the reset signal RES is switched to the high level, the nMOS transistors 95 and 96 are turned ON, and nodes 99 and 100 are switched to the low level. Hence, the select signal SEL is switched to the low level.

When the reset signal is switched to the low level, the nMOS transistors 95 and 96 are turned OFF. In this state, the node 99 is maintained at the low level, and the node 100 is switched to the high level. Hence, the select signal SEL is maintained at the low level. Thereafter, when the output signal Q76 of the primary register 76 is switched to the high level, the pMOS transistors 93 and 94 are turned ON and OFF, respectively. Hence, the node 99 is switched to the high level, while the node 100 is maintained at the high level. Hence, the select signal SEL is switched to the high level.

As described above, the defect detection/selector control circuit 90 operates in the same manner as the defect detection/selector control circuit 92 shown in FIG. 12, so that the same advantages of the configuration shown in FIG. 12 can be obtained. That is, the correct operation can be ensured if either the primary or secondary register operates normally. It will be noted that the above process does not need to cut and connect connecting wires. Further, it is not necessary to supply the select signal from an external device.

Further, the defect detection/selector control circuit 90 is simpler than the defect detection/selector control circuit 82 shown in FIG. 12. Hence, the driving circuit using the configuration shown in FIG. 14 is simpler than that using the configuration shown in FIG. 12.

FIFTH EMBODIMENT

A description will now be given of a fifth embodiment of the present invention.

Figure 15:
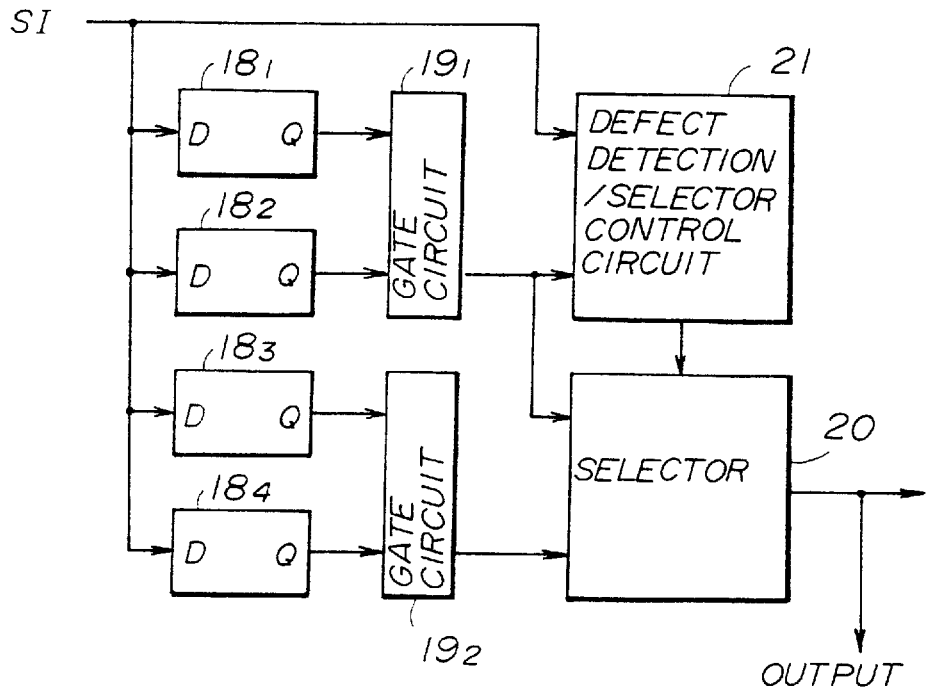
FIG. 15 is a block diagram of a fifth embodiment of the present invention.

FIG. 15 shows an overview of the fifth embodiment of the present invention, and more particularly shows a stage of the shift register of the serial input/parallel output type, to which the starting signal necessary for the horizontal or vertical scanning operation is applied.

The configuration shown in FIG. 15 is made up of four registers $\mathbf{18}_1$ through $\mathbf{18}_4$, two gate circuits $\mathbf{19}_1$ and $\mathbf{19}_2$, a selector 20, and a defect detection/selector control circuit 21. Each of the above four registers is formed with a one-bit D-type flip-flop. Each of the gate circuits $\mathbf{19}_1$ and $\mathbf{19}_2$ is formed with an AND circuit or an OR circuit, as will be described in detail later. The gate circuit $\mathbf{19}_1$ receives the output signals of the registers $\mathbf{18}_1$ and $\mathbf{18}_2$, and the gate circuit $\mathbf{19}_2$ receives the output signals of the registers $\mathbf{18}_3$ and $\mathbf{18}_4$. The selector 20 selects either the output signal of the gate circuit $\mathbf{19}_1$ or the output signal of the gate circuit $\mathbf{19}_2$.

The defect detection/selector control circuit 21 detects, on the basis of the output signal of the gate circuit $\mathbf{19}_1$, whether or not one or both of the registers $\mathbf{18}_1$ and $\mathbf{18}_2$. When there is no defect in the registers $\mathbf{18}_1$ and $\mathbf{18}_2$, is defective the circuit 21 causes the selector 20 to select the output signal of the gate circuit $\mathbf{19}_1$. If a defect causing an abnormal output exists in one or both of the registers $\mathbf{18}_1$ and $\mathbf{18}_2$, the circuit 21 causes the selector 20 to select the output signal of the gate circuit $\mathbf{19}_2$.

In short, the driving circuit according to the fifth embodiment of the present invention includes a plurality of stages, each of which stages is made up of a first pair of registers $\mathbf{18}_1$ and $\mathbf{18}_2$, a second pair of registers $\mathbf{18}_3$ and $\mathbf{18}_4$, the gate circuit $\mathbf{19}_1$ for selecting either the register $\mathbf{18}_1$ or $\mathbf{18}_2$, the gate circuit $\mathbf{19}_2$ for selecting either the register $\mathbf{18}_3$ or $\mathbf{18}_4$, the selector 20 for selecting either the gate circuit $\mathbf{19}_1$ or the $\mathbf{19}_2$, and the defect detection/selector control circuit 21 for controlling the selector 20. Further, the defect detection/selector control circuit 21 detects, on the basis of the output signal of the gate circuit $\mathbf{19}_1$, whether or not one or both of the registers $\mathbf{18}_1$ and $\mathbf{18}_2$. When there is no defect in the registers $\mathbf{18}_1$ and $\mathbf{18}_2$, the circuit 21 causes the selector 20 to select the output signal of the gate circuit $\mathbf{19}_1$. If a defect causing an abnormal output exists in one or both of the registers $\mathbf{18}_1$ and $\mathbf{18}_2$, the circuit 21 causes the selector 20 to select the output signal of the gate circuit $\mathbf{19}_2$.

Hence, even if one or both of the registers $\mathbf{18}_3$ and $\mathbf{18}_4$ have a defect causing an abnormal output, the correct operation can be automatically ensured under the condition that at least one of the registers $181_1$ and $18_2$ operates normally. Further, even if one or both of the registers $18_i$ and $18_2$ have a defect causing an abnormal output, the correct operation can be automatically ensured under the condition that at least one of the registers $18_3$ and $18_4$ operates normally. That is, even if one or more registers among the four registers $18_1$ through $18_4$ are defective, the correct operation can be automatically ensured under the condition that either the output signal of the gate circuit $19_1$ or the output signal of the gate circuit $19_2$ is normal. It will be noted that the fifth embodiment of the present invention does not need the process of cutting and connecting wiring lines.

Figure 16:
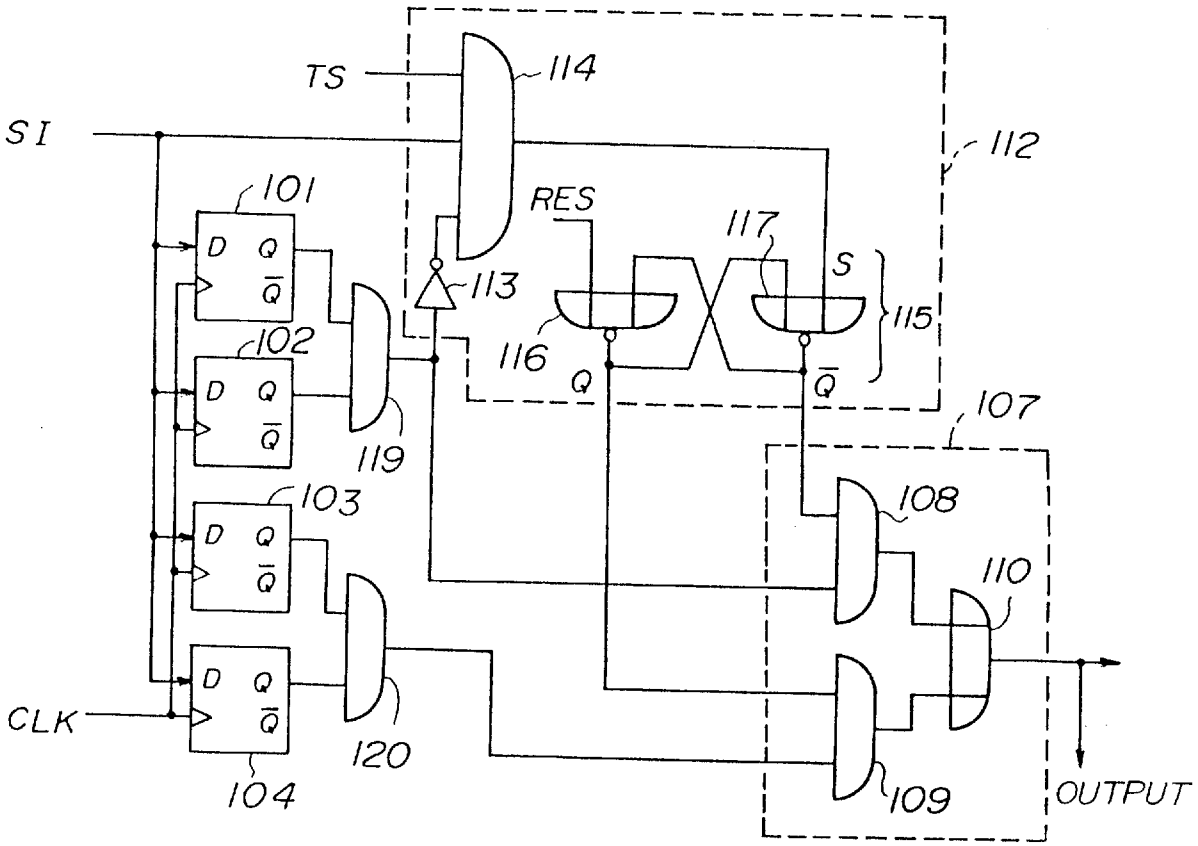
FIG. 16 is a block diagram of an essential part of the fifth embodiment of the present invention shown in FIG. 15.

FIG. 16 is a circuit diagram of an essential feature of the fifth embodiment of the present invention, and more particularly, a stage of the shift register.

The configuration shown in FIG. 16 is made up of four registers 101 through 104, two OR gates 105 and 106, a selector 107 and a defect detection/selector control circuit 112. The resistors 101 through 104 are formed with one-bit D-type flip-flops of the positive-edge trigger type. The selector 107 selects either the output signal of the OR circuit 105 or the output signal of the OR circuit 106. As shown in FIG. 16, the selector 107 is made up of AND circuits 108 and 109, and an OR circuit 110.

The defect detection/selector control circuit 112 detects a defect in which the registers 101 and 102 are defectively fixed to the high level, and controls the selector 107 on the basis of the result of the above detection. As shown in FIG. 16, the circuit 112 is made up of an inverter 113, an AND circuit 114, and an RS flip-flop 115 consisting of two NOR circuits 116 and 117. Symbol TS applied to the AND circuit 114 denotes a defect correction control signal.

Figure 17:
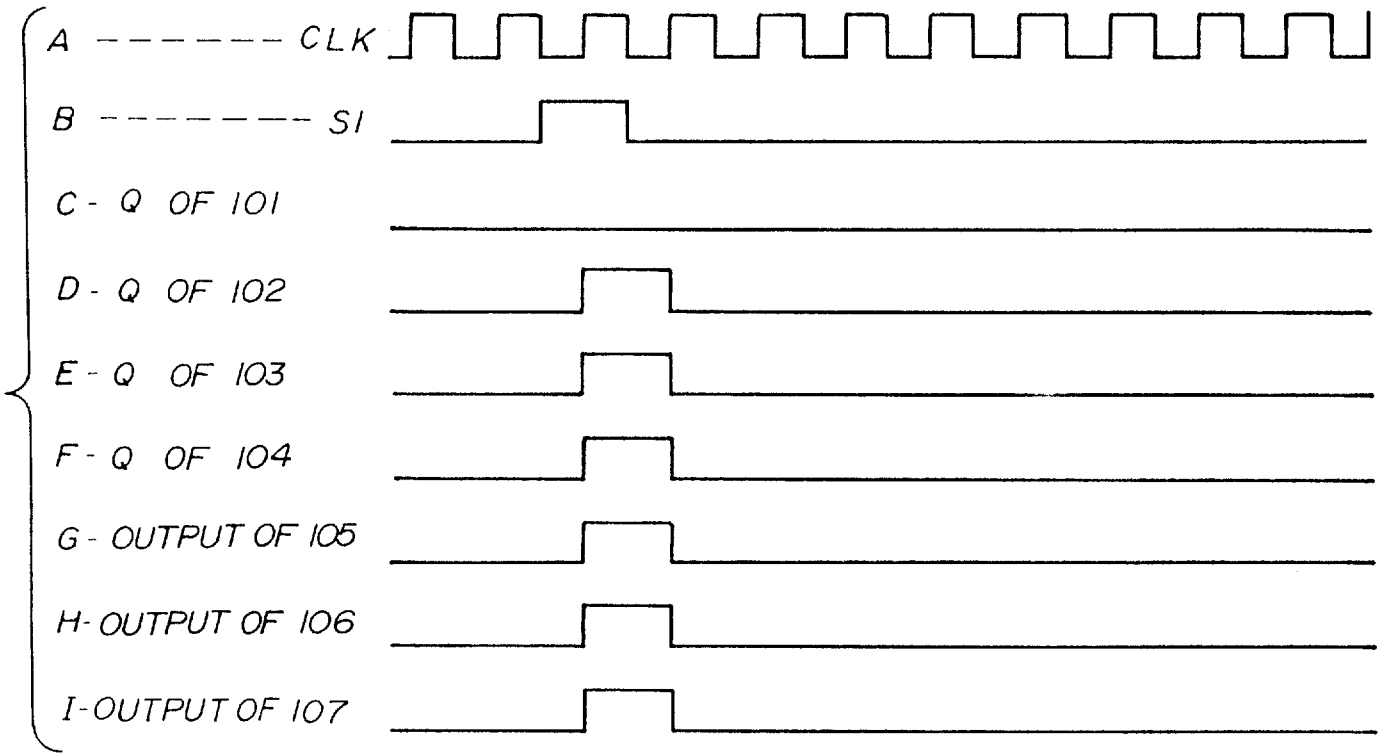
FIG. 17 is a waveform diagram showing the operation of the configuration shown in FIG. 16.

FIG. 17 is a waveform diagram showing an operation of the fifth embodiment of the present invention, in which the output signal of the register 101 is defectively fixed to the low level. More particularly, in FIG. 17, part A shows the clock signal CLK controlling the operation of the registers 101 through 104, part B shows the starting signal SI, part C shows the primary-phase output signal Q of the register 101, part D shows the primary-phase output signal Q of the register 102, part E shows the primary-phase output signal Q of the register 103, and part F shows the primary-phase output signal Q of the register 104. Further, part G of FIG. 17 shows the output signal of the OR circuit 105, part H shows the output signal of the OR circuit 106, and part I shows the output signal of the selector 107.

The OR circuit 105 performs an OR operation on the output signals of the registers 101 and 102. Hence, the correct operation can be automatically ensured even if either the register 101 or 102 has a defect causing its output signal to be fixed to the low level. Similarly, OR circuit 106 performs an OR operation on the output signals of the registers 103 and 104. Hence, the correct operation can be automatically ensured even if either the register 103 or 104 has a defect causing its output signal to be fixed to the low level.

Figure 18:
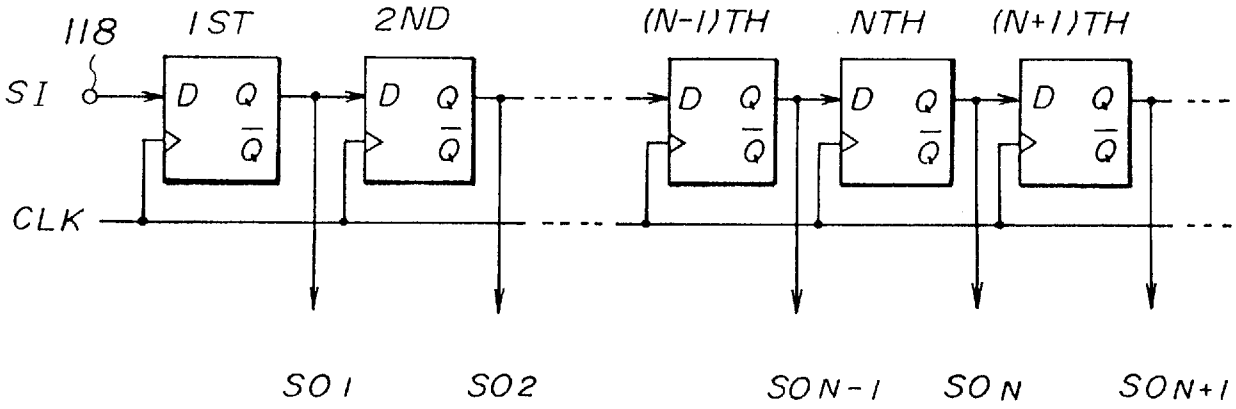
FIG. 18 is a block diagram of a shift register to which the fifth embodiment of the present invention is applied.

FIG. 18 shows a shift register including a plurality of circuits, each of which circuits has the configuration shown in FIG. 16. The shift register shown in FIG. 18 has an input terminal 118 to which the starting signal SI is applied.

Figure 19:
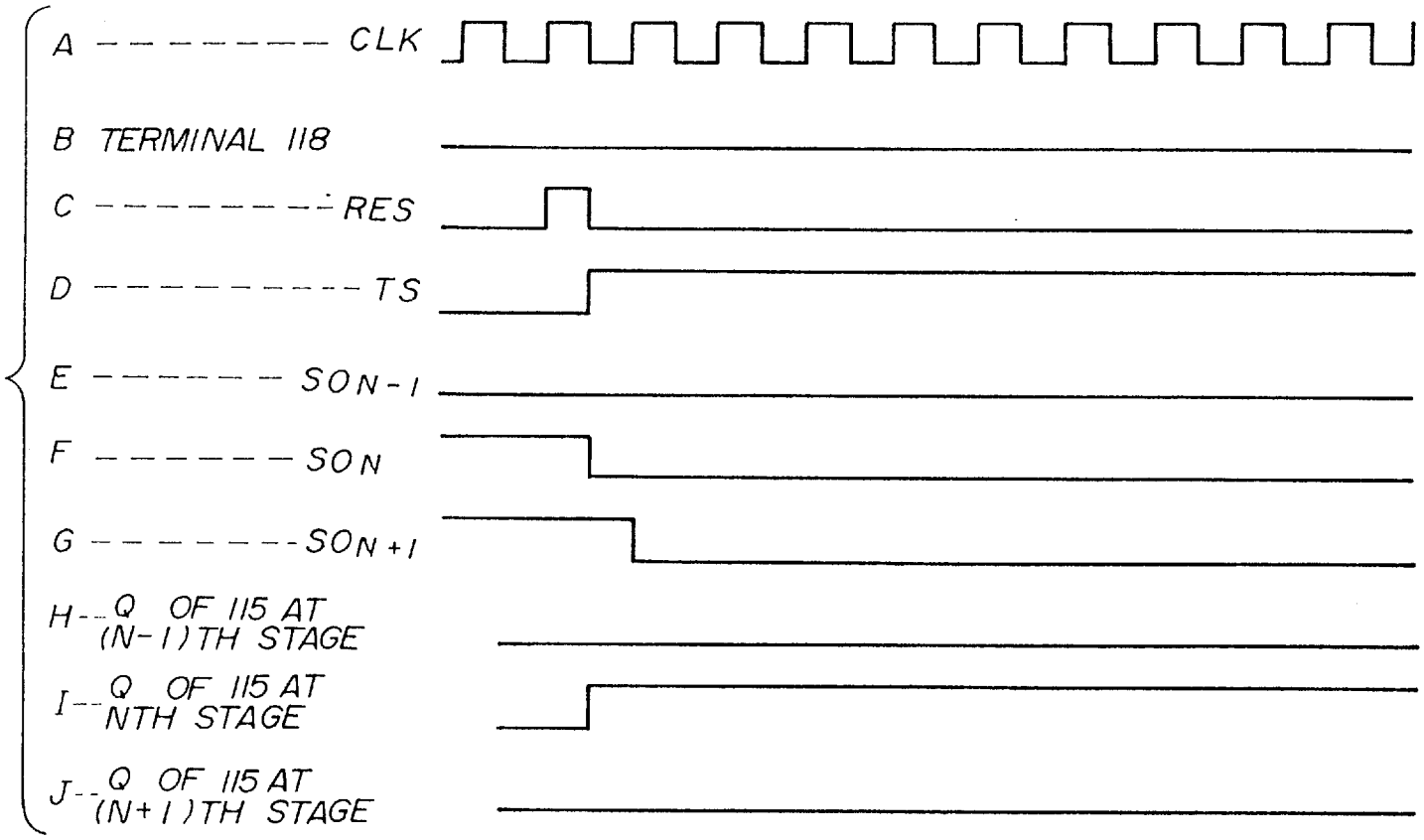
FIG. 19 is a waveform diagram of the shift register shown in FIG. 18.

FIG. 19 shows an operation of the shift register in which either the register 101 or 102 has a defect causing its output signal to be fixed to the high level. In FIG. 19, part A shows the clock signal CLK, part B shows the level of the input signal 118 to which the starting signal SI is applied. Further, part C shows the reset signal RES applied to the RS flip-flop 115, part D shows the defect correction control signal TS applied to the AND circuit 114, part E shows an output signal $SO_{N-1}$ of the (N−1)th stage, part F shows an output signal $SO_N$ of the Nth stage, and part G shows an output signal $SO_{N+1}$ of the (N+1)th stage. Further, part H shows the primary-phase output signal Q of the RS flip-flop 115 of the (N−1)th stage, part I shows the primary-phase output signal Q of the RS flip-flop 115 of the Nth stage, and part J shows the primary-phase output signal Q of the RS flip-flop 115 of the (N+1)th stage.

The input terminal 118 to which the starting signal SI is applied is set to the low level until a high-level fixing defect is corrected. Then, the reset signal RES applied to the RS flip-flop 115 of all the stages is set to the high level, and the primary-phase output signals Q are set to the low level, and the secondary-phase output signals /Q are set to the high level. Hence, the selector 107 selects the output signal of the OR circuit 105.

The defect correction control signal TS is switched to the high level immediately after the reset signal RES is switched to the low level. The defect correction control signal TS is maintained at the high level until the correcting operation is completed. In this state, the output signals $SO_1$ through $SO_{N+1}$ are at the high level. As has been described, it is assumed that the Nth stage has a defect in either the register 101 or 102, the defect causing its output signal to be fixed to the high level. Hence, the output signal of the OR circuit is at the high level, and the output of the AND circuit 114 is at the high level. Hence, the RS flip-flop 115 is set, and the output signals Q and /Q are switched to the high level and the low level, respectively. As a result, the selector 107 selects the output signal of the OR circuit 106.

In this case, if either the register 103 or 104 has a defect causing its output signal to be fixed to the high level, the output signal of the OR circuit 106 has the correct level, as has been described previously. If the registers 101 and 102 do not have a defect causing their output signals to be fixed to the high level, the RS flip-flop 115 is not set. Hence, the selector 107 selects the output signal of the OR circuit 105. In this case, even if either the register 101 or 102 has a defect causing its output signal to be fixed to the low level, the output signal of the OR circuit 105 has the correct level, as has been described previously.

As described above, according to the fifth embodiment of the present invention, even if one or both of the registers 101 and 102 has a defect causing its output signal to be fixed to the high level, the correct operation can be ensured under the condition that either the register 103 or 104 does not have a defect causing its output signal to be fixed to the high level irrespective of whether or not either the register 103 or 104 has a defect causing its output signal to be fixed to the low level. Further, even if one or both of the registers 103 and 104 has a defect causing its output signal to be fixed to the high level, the correct operation can be ensured under the condition that either the register 101 or 102 does not have a defect causing its output signal to be fixed to the high level irrespective of whether or not either the register 101 or 102 has a defect causing its output signal to be fixed to the low level.

In the above manner, the correct operation can be automatically ensured even if one or both of the registers 101 and 102 or one or both of the registers 103 and 104 have a defect causing their output signals to be fixed to the high level under the condition that either the OR circuit 105 or 106 is capable of outputting the correct output level. It will be noted that the above process does not need to cut and connect wiring lines and use the select signal supplied from an external device.

Figure 20:
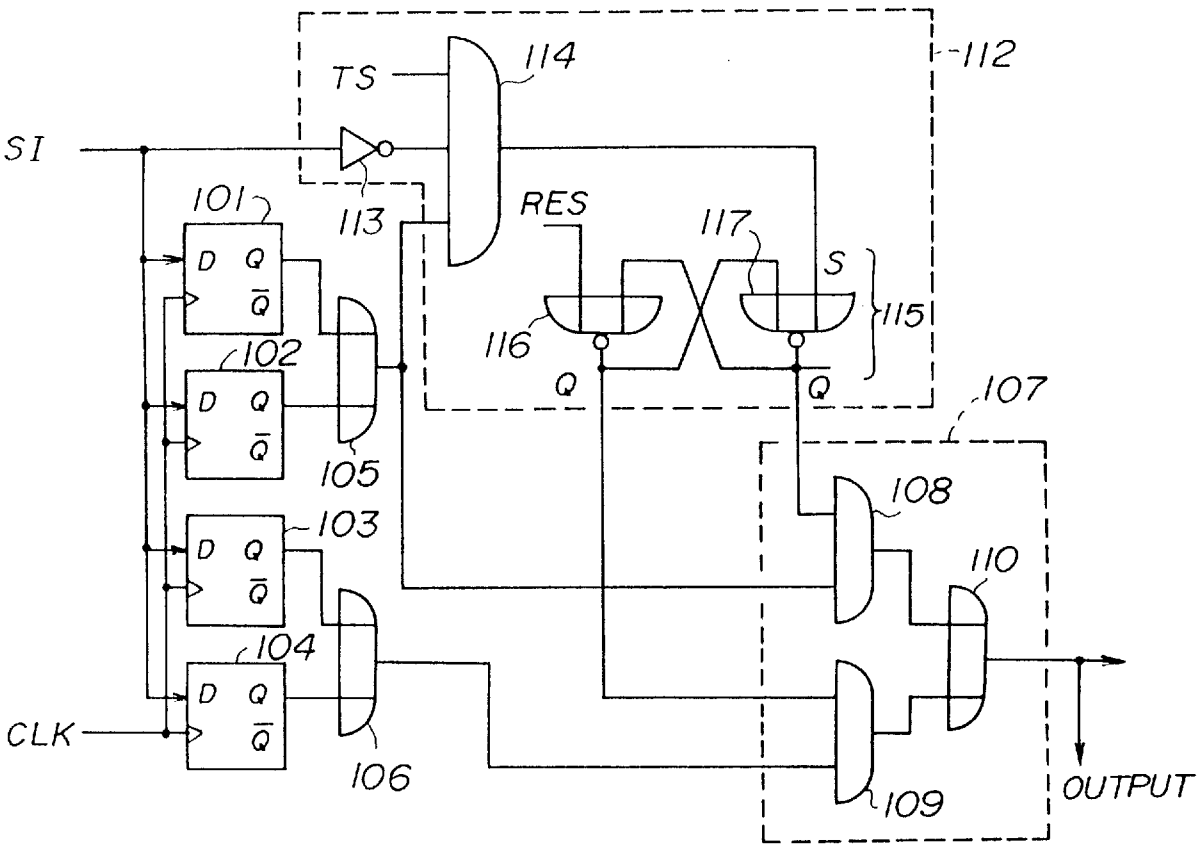
FIG. 20 is a block diagram of another configuration of the fifth embodiment of the present invention shown in FIG. 15.

FIG. 20 shows another configuration of the essential part of the fifth embodiment of the present invention, and more particularly shows a stage of the shift register. The configuration shown in FIG. 20 differs from that shown in FIG. 16 in that AND circuits 119 and 120 are used instead of the OR circuits 105 and 106 and an inverter 113 is connected between the AND circuit 119 and the AND circuit 114. The parts of the configuration shown in FIG. 20 are the same as those of the configuration shown in FIG. 16.

The configuration shown in FIG. 20 can ensure the correct operation even if one or both of the registers 101 and 102 have a defect causing its output signal to be fixed to the low level under the condition that one of the registers 103 and 104 does not have a defect causing its output signal to be fixed to the low level irrespective of whether or not one of the registers 103 and 104 has a defect causing its output signal to be fixed to the high level. Further, the configuration shown in FIG. 20 can ensure the correct operation even if one or both of the registers 103 and 104 have a defect causing its output signal to be fixed to the low level under the condition that one of the registers 101 and 102 does not have a defect causing its output signal to be fixed to the low level irrespective of whether or not one of the registers 101 and 102 has a defect causing its output signal to be fixed to the high level.

In the above manner, the correct operation can be automatically ensured even if one or both of the registers 101 and 102 or one or both of the registers 103 and 104 have a defect causing their output levels to be fixed to the low level under the condition that either the AND circuit 110 or 120 can output the correct output level. It will be noted that the configuration does not need to cut and connect wiring lines and does not need the select signal SEL supplied from an external device.

SIXTH EMBODIMENT

A description will now be given of a sixth embodiment of the present invention.

Figure 21:
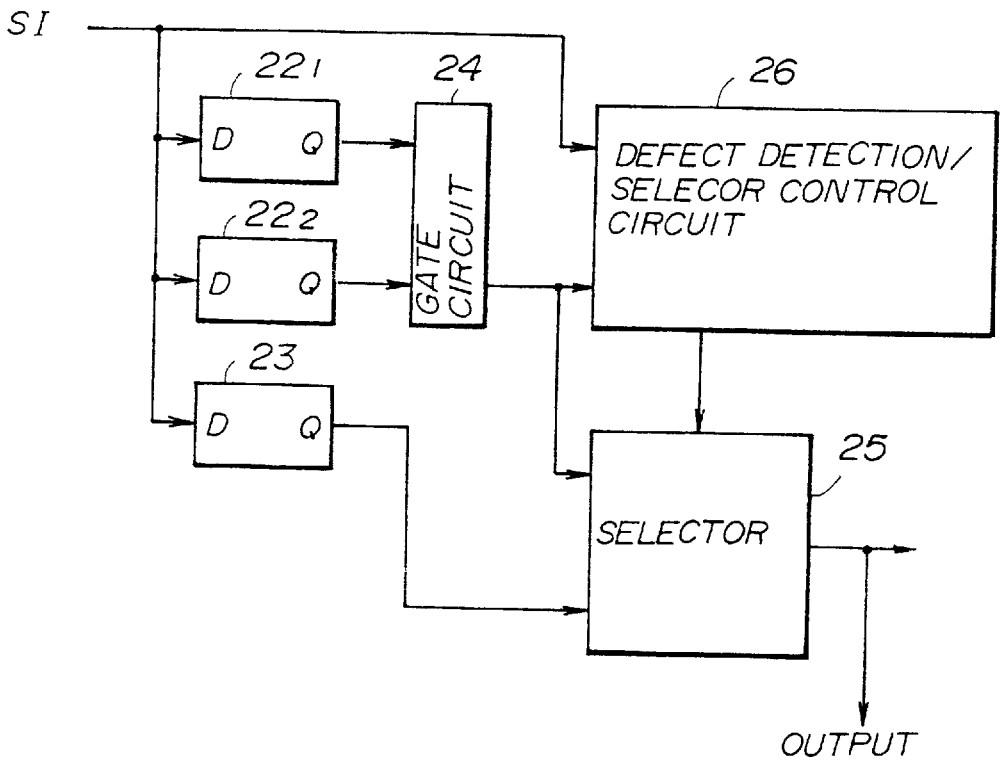
FIG. 21 is a block diagram of a sixth embodiment of the present invention.

FIG. 21 shows an overview of the sixth embodiment of the present invention, and more particularly a stage of a shift register of the serial input/parallel output type, to which the starting signal SI necessary for the horizontal or vertical scanning operation.

The stage show n in FIG. 21 is made up of registers $\mathbf{22}_1$, $\mathbf{22}_2$ and 23, a gate circuit 24, a selector 35 and a defect detection/selector control circuit 26. Each of the registers $\mathbf{22}_1$, $\mathbf{22}_2$ and 23 is formed with a one-bit D-type flip-flop. The gate circuit 24 selects either the output signal of the register $\mathbf{22}_1$ or the output signal of the register $\mathbf{22}_2$. The selector 25 selects either the output signal of the gate circuit 24 or the output signal of the register 23 under the control of the defect detection/selector control circuit 26. The circuit 26 determines, on the basis of the output signal of the gate circuit 24, whether or not one or both of the registers $\mathbf{22}_1$ and $\mathbf{22}_2$ have a defect causing abnormal output signals. When there is no defect in the registers $\mathbf{22}_1$ and $\mathbf{22}_2$, the circuit 26 causes the selector 25 to select the gate circuit 24. When one or both of the registers $\mathbf{22}_1$ and $\mathbf{22}_2$ have a defect causing abnormal output signals, the circuit 26 causes the selector 25 to select the output signal of the register 23.

In short, the driving circuit according to the sixth embodiment of the present invention has a plurality of stages, each of which stages is made up of a pair of (grouped) registers $\mathbf{22}_1$ and $\mathbf{22}_2$, the register 23 (not grouped), the gate circuit 24 selecting either the register $\mathbf{22}_1$ or the register $\mathbf{22}_2$, the selector 25 for selecting either the output signal of the gate circuit 24 or the output signal of the register 23 under the control of the circuit 26, and the control circuit 26 causing the selector 25 to select the output signal of the register 23 when one of the registers $\mathbf{22}_1$ and $\mathbf{22}_2$ has a defect and causing the selector 25 to select the output signal of the gate circuit 24 when there is no defect in the registers $\mathbf{22}_1$ and $\mathbf{22}_2$.

Hence, even if the register 23 has a defect causing an abnormal output, the correct operation can be automatically ensured under the condition that one of the registers $\mathbf{22}_1$, and $\mathbf{22}_2$ does not have a defect causing the output signal of the selector to be abnormal. Further, even if one or both of the registers $\mathbf{22}_1$ and $\mathbf{22}_2$ has a defect causing an abnormal output signal of the selector signal, the correct operation can be automatically ensured under the condition that the register 23 does not have a defect causing the output signal of the selector to be abnormal. That is, if the output signal of the gate circuit 24 or the register 23 is normal, the correct operation can be automatically ensured without cutting and connecting wiring lines.

SEVENTH EMBODIMENT

A description will now be given of a seventh embodiment of the present invention.

Figure 22:
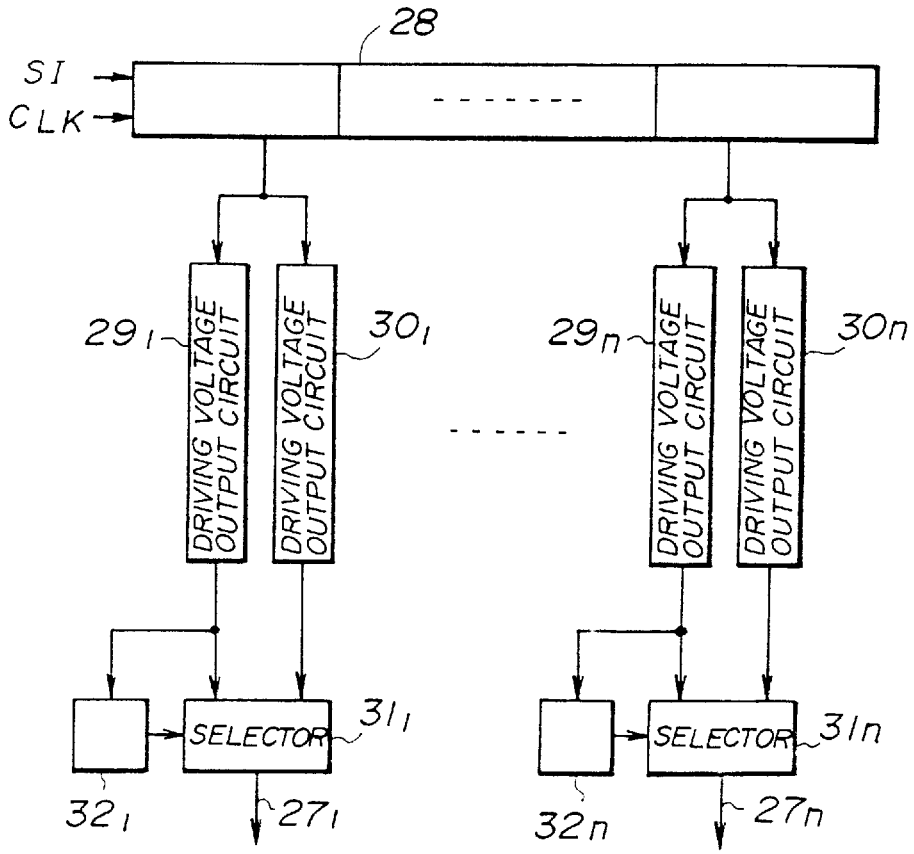
FIG. 22 is a block diagram of a seventh embodiment of the present invention.

FIG. 22 shows an overview of the seventh embodiment of the present invention. The configuration shown in FIG. 22 is made up of a shift register 28, driving voltage output circuits $\mathbf{29}_1$ through $\mathbf{29}_n$, driving voltage output circuits $\mathbf{30}_1$ through $\mathbf{30}_n$, selectors $\mathbf{31}_1$ through $\mathbf{31}_n$) and defect detection/selector control circuits $\mathbf{32}_1$ through $\mathbf{32}_n$. Signal lines $\mathbf{27}_1$ through $\mathbf{27}_n$ extend from the selectors $\mathbf{31}_1$ through $\mathbf{31}_n$, respectively. In FIG. 22, the signal lines $\mathbf{27}_1$ through $\mathbf{27}_n$ are data lines corresponding to the data lines DL shown in FIG. 1.

The shift register 28 is a shift register of the serial input/parallel output type and receives the starting signal SI and the clock signal CLK. The driving voltage output circuits $\mathbf{29}_1$ through $\mathbf{29}_n$ are provided for the data lines $\mathbf{27}_1$ through $\mathbf{27}_n$, respectively. Similarly, the driving voltage output circuit $\mathbf{30}_1$ through $\mathbf{30}_n$ are provided for the data lines $\mathbf{27}_1$ through $\mathbf{27}_n$, respectively. The selector $\mathbf{31}_1$ selects either the output signal of the circuit $\mathbf{29}_1$ or the output signal of the circuit $\mathbf{30}_1$ under the control of the defect detection/selector control circuit $\mathbf{32}_1$. Similarly, the selector $\mathbf{31}_n$ selects either the output signal of the circuit $\mathbf{29}_n$ or the output signal of the circuit $\mathbf{30}_n$ under the control of the defect detection/selector control circuit $\mathbf{32}_n$. The defect detection/selector control circuit $\mathbf{32}_1$ detects a defect that has occurred in the driving voltage output circuit $\mathbf{29}_1$ by determining whether or not a reference voltage is output from the driving voltage output circuit $\mathbf{29}_1$ when the reference voltage is applied to the circuit $\mathbf{29}_1$. When it is determined that the output circuit $\mathbf{29}_1$ does not have any defect, the defect detection/selector control circuit $\mathbf{32}_1$ selects the output circuit $\mathbf{29}_1$. If it is determined that the output circuit $\mathbf{29}_1$ has defect, the defect detection/selector control circuit $\mathbf{32}_1$ selects the output circuit $\mathbf{30}_1$.

In short, the driving circuit of the liquid-crystal display device according to the seventh embodiment of the present invention has driving voltage output circuits $\mathbf{29}_i$ and $\mathbf{30}_i$ (i is a positive integer) for outputting driving voltages, the selector $\mathbf{31}_i$ for selecting either the circuit $\mathbf{29}_i$ or $\mathbf{30}_i$, and the defect detection/selector control circuit $\mathbf{32}_1$ for determining whether or not the reference voltage is output from the circuit $29_i$ when the reference voltage is applied thereto and causing the selector $31_i$ to select the circuit $29_i$ when it is determined that the reference voltage is duly output from the circuit $29_1$.

Even if the driving voltage output circuit $29_i$ has a defect, the output signal of the circuit $30_i$ is output to the data line $27_i$ under the condition that the circuit $30_i$ does not have any defect, whereby the correct operation can be automatically ensured. Further, even if the driving voltage output circuit $30_i$ has a detect, the output signal of the circuit $29_i$ is output to the data line $27_i$ under the condition that the circuit $29_i$ does not have any defect, whereby the correct operation can be automatically ensured. That is, the correct operation can be automatically ensured when either the driving voltage output circuit $29_i$ or $30_i$ operates normally. It will be noted that the above process does not need to cut and connect wiring lines.

Figure 23:
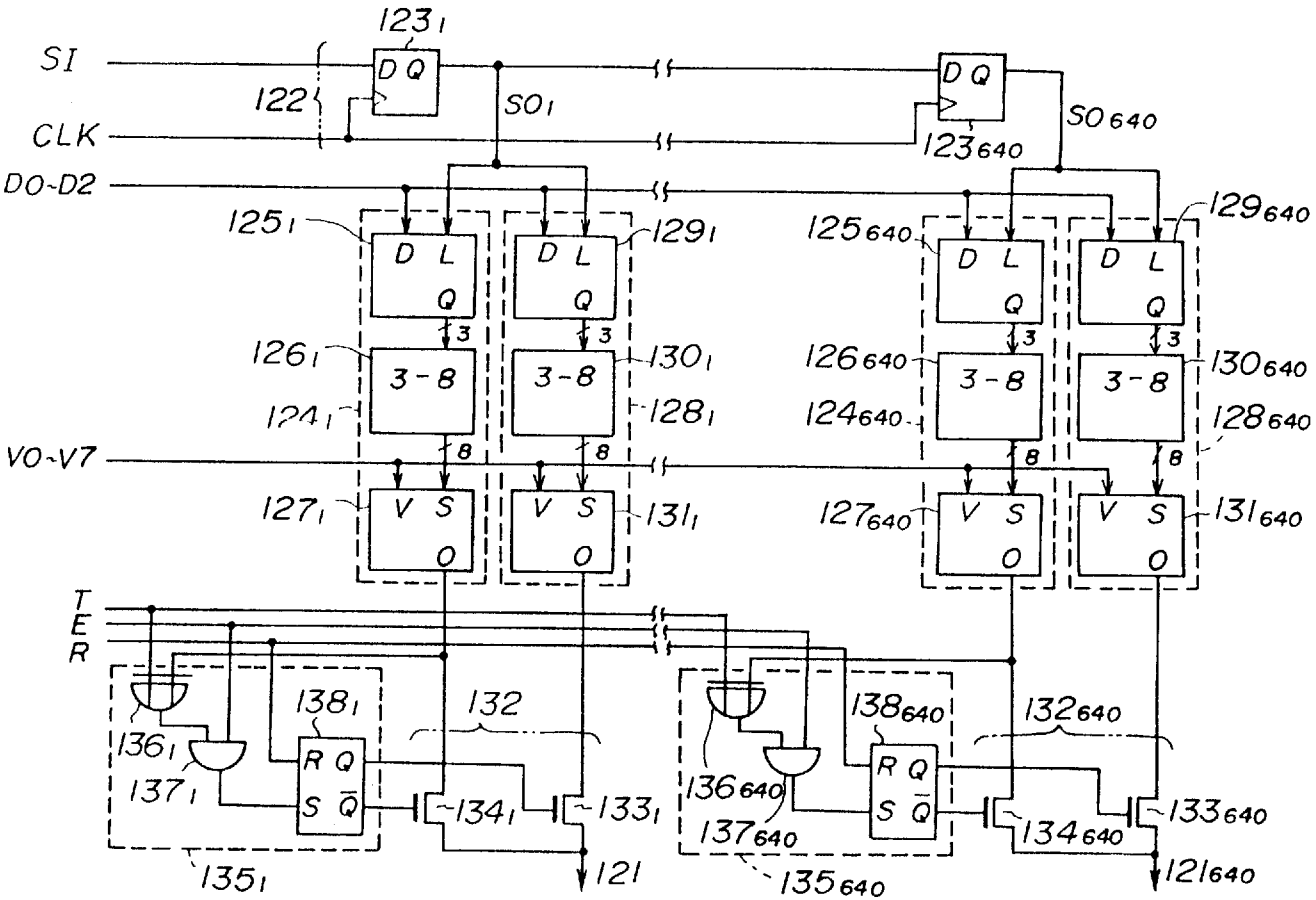
FIG. 23 is a block diagram of an essential part of the present invention shown in FIG. 22.

FIG. 23 shows an essential part of the seventh embodiment of the present invention, and more particularly a part of driving data lines. In FIG. 23, reference numbers $121_1$ and $121_{640}$ indicate data lines, a reference number 122 indicate a shift register of the serial input/parallel output type, and reference numbers $123_1$ and $123_{640}$ indicate D-type flip-flops. Reference numbers $124_1$ and $124_{640}$ indicate primary driving voltage output circuits, and reference numbers $125_1$ and $125_{640}$ indicate three-bit shift registers, which latch display data D0–D2 in synchronism with timing signals $SO_1$ through $SO_{640}$ output from the D-type flip-flops $123_1$ and $123_{640}$. Reference numbers $126_1$ and $126_{640}$ indicate 3–8 decoders, which respectively decode the three-bit display data D0–D2 latched in the three-bit registers $125_1$ an $125_{640}$. Reference numbers $127_1$ and $127_{640}$ indicate selectors, each of which selectors selects one of driving voltages V0–V7 corresponding to the display data D0–D2 on the basis of a decoded signal output by the corresponding 3–8 decoder 126. The driving voltages V0–V7 are obtained by equally diving a voltage range between 2 [V] and 4.8 [V].

Reference numbers $128_1$ and $128_{640}$ indicate secondary (spare) driving voltage output circuits, and reference numbers $129_1$ through $129_{640}$ respectively indicate 3-bit registers, which respectively latch three-bit display data D0–D2 in synchronism with the timing signals $SO_1$ and $SO_{640}$ output from the D-type flip-flops $123_1$ and $1234_{640}$. Reference numbers $130_1$ and $130_{640}$ respectively indicate 3–8 decoders, which decode the three-bit display data D0–D2 latched in the three-bit registers $129_1$ and $129_{640}$, respectively. Reference numbers $131_1$ and $131_{640}$ respectively indicate selectors, each of which selectors selects one of the driving voltages V0–V7 corresponding to the display data D0–D2 on the basis of the decoded signal output from the corresponding 3–8 decoder 130.

Reference number $132_1$ indicate a selector, which selects either the driving voltage output by the primary driving voltage output circuit $124_1$ or the driving voltage output by the secondary driving voltage output circuit $128_1$. Reference numbers $133_1$ and $134_1$ respectively indicate nMOS transistors, which function as switching elements. Reference number $132_{640}$ indicate a selector, which selects either the driving voltage output by the primary driving voltage output circuit $124_{640}$ or the driving voltage output by the secondary driving voltage output circuit $128_{640}$. Reference numbers $133_{640}$ and $134_{640}$ respectively indicate nMOS transistors, which function as switching elements.

A reference number $135_1$ indicates a defect detection/selector control circuit, which detects a defect of the primary driving voltage output circuit $124_1$, and controls the operation of the selector $132_1$. A reference number $136_1$ indicates an EOR circuit, $137_1$ an AND circuit, and $138_1$ an RS flip-flop. Further, T, E and R denote defect correction control signals. A reference number $135_{640}$ indicates a defect detection/selector control circuit, which detects a defect of the primary driving voltage output circuit $124_{640}$, and controls the operation of the selector $132_{640}$. A reference number $136_{640}$ indicates an EOR circuit, $137_{640}$ an AND circuit, and $138_{640}$ an RS flip-flop.

Figure 24:
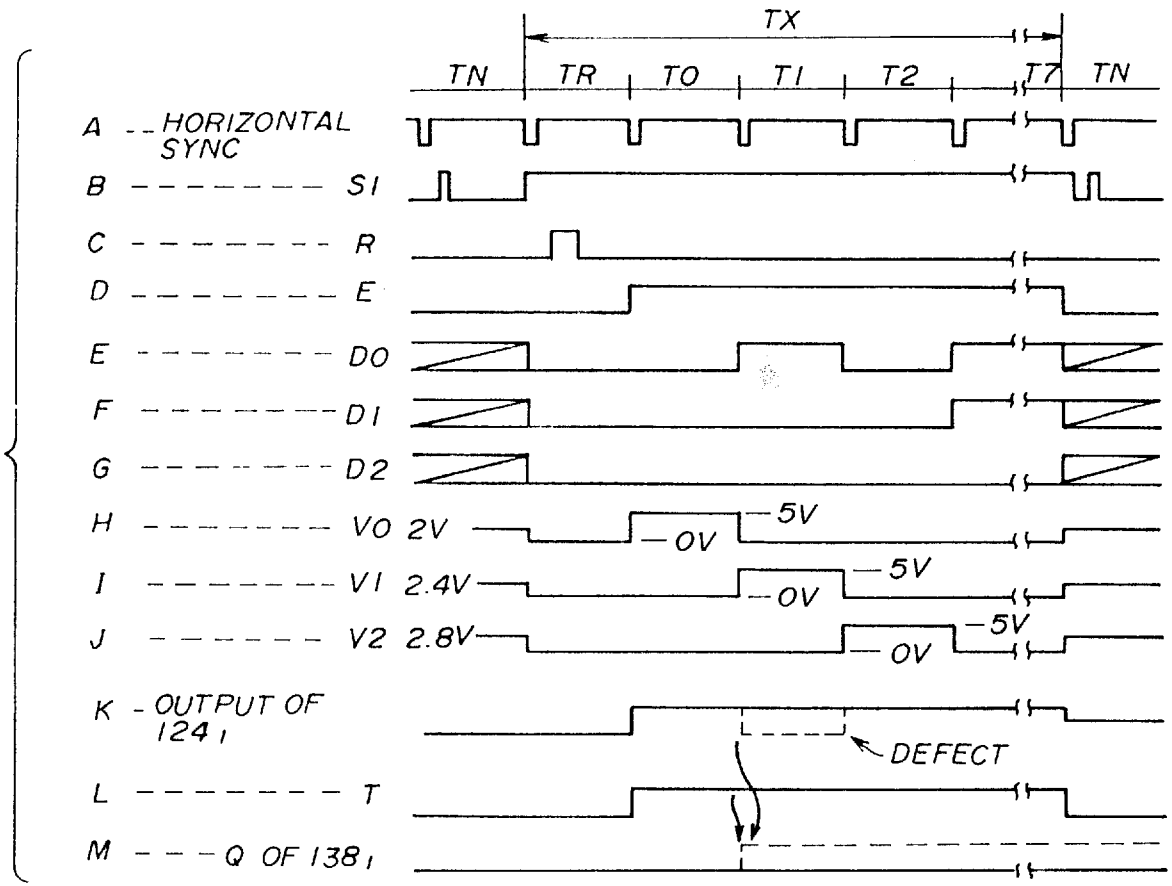
FIG. 24 is a waveform diagram showing the operation of the seventh embodiment of the present invention.

FIG. 24 is a waveform diagram of the operation of the seventh embodiment of the present invention, and more particularly the operation of a circuit part for driving the data line $121_1$. The other circuit parts of the seventh embodiment of the present invention are the same as the circuit part relating to the data line $121_1$. In FIG. 24, part A shows a horizontal synchronizing signal, part B shows the starting signal SI, part C shows the defect correction control signal R, and part D shows the defect correction control signal E. Further, part E shows display data DO, part F shows display data D1, part G shows display data D2, part H shows the driving voltage Vo, part I shows the driving voltage V1 and part J shows the driving voltage V2. Furthermore, part K shows the output signal of the driving voltage output circuit $124_1$, part L shows the defect correction control signal T, and part M shows the primary-phase output signal Q of the RS flip-flop $138_1$. TN denotes a normal operation period, TX denotes a defect detection and correction period, and TR denotes an initializing period for defect detection. Further, T0 through T7 denote periods in which it is determined whether or not the driving voltages V0–V7 are duly output and a defect is corrected if such a defect is detected.

In the normal operation period TN, the starting signal SI like a high-level pulse is supplied every horizontal scanning period. The driving voltage output circuits $124_1$ and $128_1$ output the corresponding driving voltages out of the driving voltages V0–V7 corresponding to the display data D0–D2 latched in synchronism with the timing signal $SO_1$ output by the D-type flip-flop $123_1$. In this case, if the driving voltage output circuit $124_1$ does not any defect and hence the defect correcting operation is not carried out, the RS flip-flop $124_1$ is in the reset state. In this case, the output signals Q and /Q of the RS flip-flop $124_1$ are respectively at the low and high levels, and the nMOS transistors $133_1$ and $134_1$ are OFF and ON, respectively. Hence, the output signal of the driving voltage output circuit $124_1$ is supplied to the data line $121_1$.

In the defect detection period TX, the starting signal SI is switched to the high level, and the D-type flip-flop $123_1$ is set so that the three-bit registers $125_1$ and $129_1$ simultaneously latch the display data D0–D2. In the initializing period TR for the defect detecting operation, the defect correction control signal R is switched to the high level, so that the RS flip-flop $138_1$ is reset.

In the period T0 in which it is determined whether or not the driving voltage V0 output by the driving voltage output circuit $124_1$ is normal, the defect correction control signals E and T are switched to the high level, and the display data [D0, D1, D2] are set to [0, 0, 0]. Hence, the selectors $127_1$ and $131_1$ are made to select the driving voltage V0. In this case, the driving voltage V0 is set to, for example, 5 [V], and the driving voltages V1–V7 are set to 0 [V]. If the selector $127_1$ outputs the voltage 5 [V], the output signal of the EOR circuit $136_1$ is at the low level, and the output signal of the AND circuit $137_1$ is at the low level. Hence, the RS flip-flop $138_1$ is maintained in the reset state.

In the period T1 in which it is determined whether or not the driving voltage V1 output by the driving voltage output circuit $124_1$ is normal, the display data [D0, D1, D2] are set to [1, 0, 0], and the selector $127_1$ is made to select the driving voltage V1. In this case, the driving voltage V1 is set to 5 [V], and the driving voltages V0 and V2–V7 are set to 0 [V]. If the selector $127_1$ outputs the voltage 5 [V], the output signal of the EOR $136_1$ is at the low level, and the output signal of the AND circuit $137_1$ is at the low level. Hence the RS flip-flop 1381 is maintained in the reset state.

In the meantime, if the driving voltage output circuit $124_1$ has a defect, and outputs a voltage $_0$ [V], the output signal of the EOR circuit $136_1$ is switched to the high level, and the output signal of the AND circuit $137_1$ is also switched to the high level. Hence, the RS flip-flop $138_1$ is set, and the output signals Q and /Q thereof are changed to the high and low levels, respectively. As a result, in the selector $132_1$, the nMOS transistor $133_1$ is turned ON and the nMOS transistor $134_1$ is turned OFF. Hence, the output voltage of the driving voltage output circuit $128_1$ is output to the data line $121_1$. In this case, the RS flip-flop $138_1$ is not reset as long as the next defect detection and correction period TX comes, in other words, the defect correction control signal R is not switched to the high level. Hence, the selector $132_1$ continues to select the driving voltage output circuit $128_1$.

In the above manner, according to the seventh embodiment of the present invention, the secondary driving voltage output circuit $128_1$ is automatically selected and its output voltage is applied to the corresponding data line $121_1$ even if a defect has occurred in the primary driving voltage output circuit $124_1$. Hence, the correct operation can be automatically ensured. Further, the primary driving voltage output circuit $124_1$, is automatically selected and its output voltage is applied to the data line $121_1$ even if a defect has occurred in the secondary driving voltage output circuit $128_1$. According to the seventh embodiment of the present invention, the correct operation can be ensured without the process of cutting and connecting the wiring lines.

EIGHTH EMBODIMENT

A description will now be given, with reference to FIG. 25, of an eight embodiment of the present invention.

Figure 25:
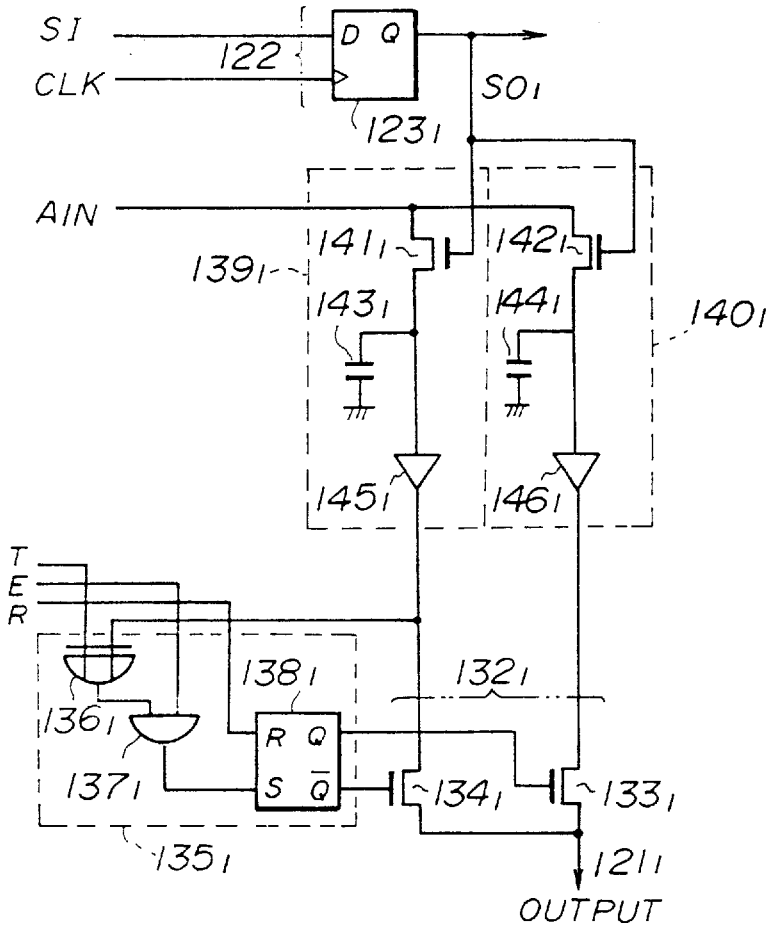
FIG. 25 is a block diagram of an eighth embodiment of the present invention.

FIG. 25 shows a circuit part for driving a data line according to the eight embodiment of the present invention. The eight embodiment of the present invention differs from the seventh embodiment thereof in that a primary driving voltage output circuit $139_1$ and a secondary driving voltage output circuit $140_1$ are provided instead of the primary driving voltage output circuit $124_1$ and the secondary driving voltage output circuit $18_1$ used in the seventh embodiment. The other parts of the eight embodiment of the present invention are the same as those of the seventh embodiment thereof.

The primary driving voltage output circuit $139_1$ is made up of an nMOS transistor $141_1$, a capacitor $143_1$ and a buffer $145_1$. Similarly, the secondary driving voltage output circuit $140_1$ is made up of an nMOS transistor $142_1$, a capacitor $144_1$ and a buffer $146_1$. The nMOS transistors $141_1$ and $142_1$ are turned ON and OFF by the output signal SO1 of the D-type flip-flop $123_1$ of the shift register 122. The capacitors $143_1$ and $144_1$ hold analog voltages at the sources of the nMOS transistors $141_1$ and $142_1$, respectively.

Figure 26:
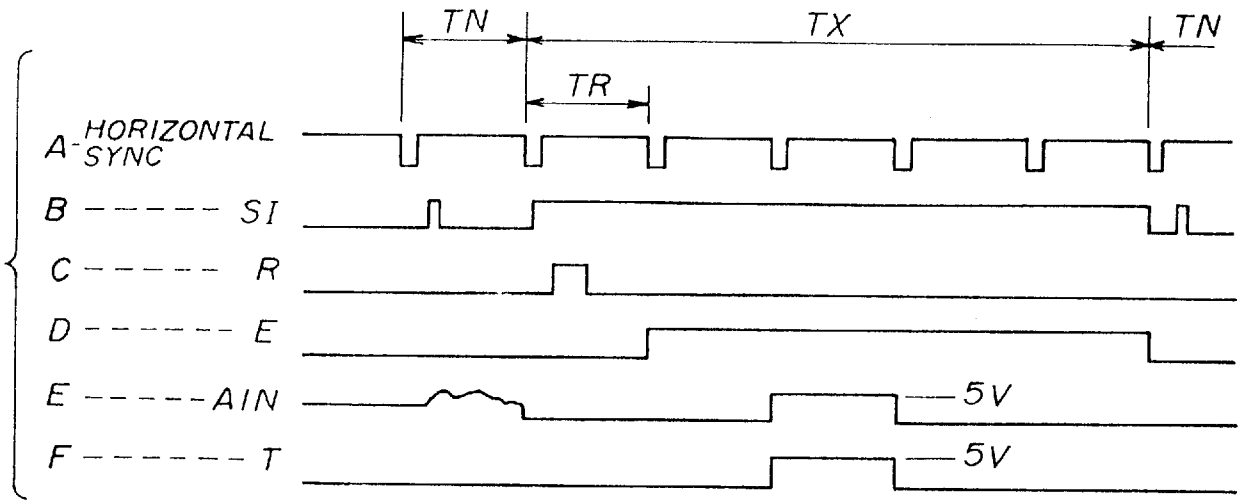
FIG. 26 is a waveform diagram showing the operation of the eighth embodiment of the present invention.

FIG. 26 is a waveform diagram showing the operation of the eighth embodiment of the present invention. More particularly, part A of FIG. 26 shows the horizontal synchronizing signal, part B shows the starting signal SI, part C shows the defect correction control signal R, part D shows the defect correction control signal E, part E shows an analog input voltage AIN, and part F shows the defect correction control signal T.

The following operation of the eight embodiment of the present invention relates to the circuit part for driving the data line $121_1$. As shown in FIG. 26, the defect detection and correction period TX is provided. In the initializing period TR, the defect correction control signal R is switched to the high level to set the RS flip-flop $138_1$ to the reset state. Then, the defect correction control signal E is switched to the high level. In this state, a reference voltage of 5 [V] is supplied instead of the analog input voltage AIN. During the above period, the defect correction control signal T is set to 5 [V] (high level). In this manner, the driving voltage output circuit $139_1$ can be corrected. According to the eighth embodiment of the present invention, the correction operation can be automatically ensured without cutting and connecting wiring lines.

NINTH EMBODIMENT

A description will now be given of a ninth embodiment of the present invention.

Figure 27:
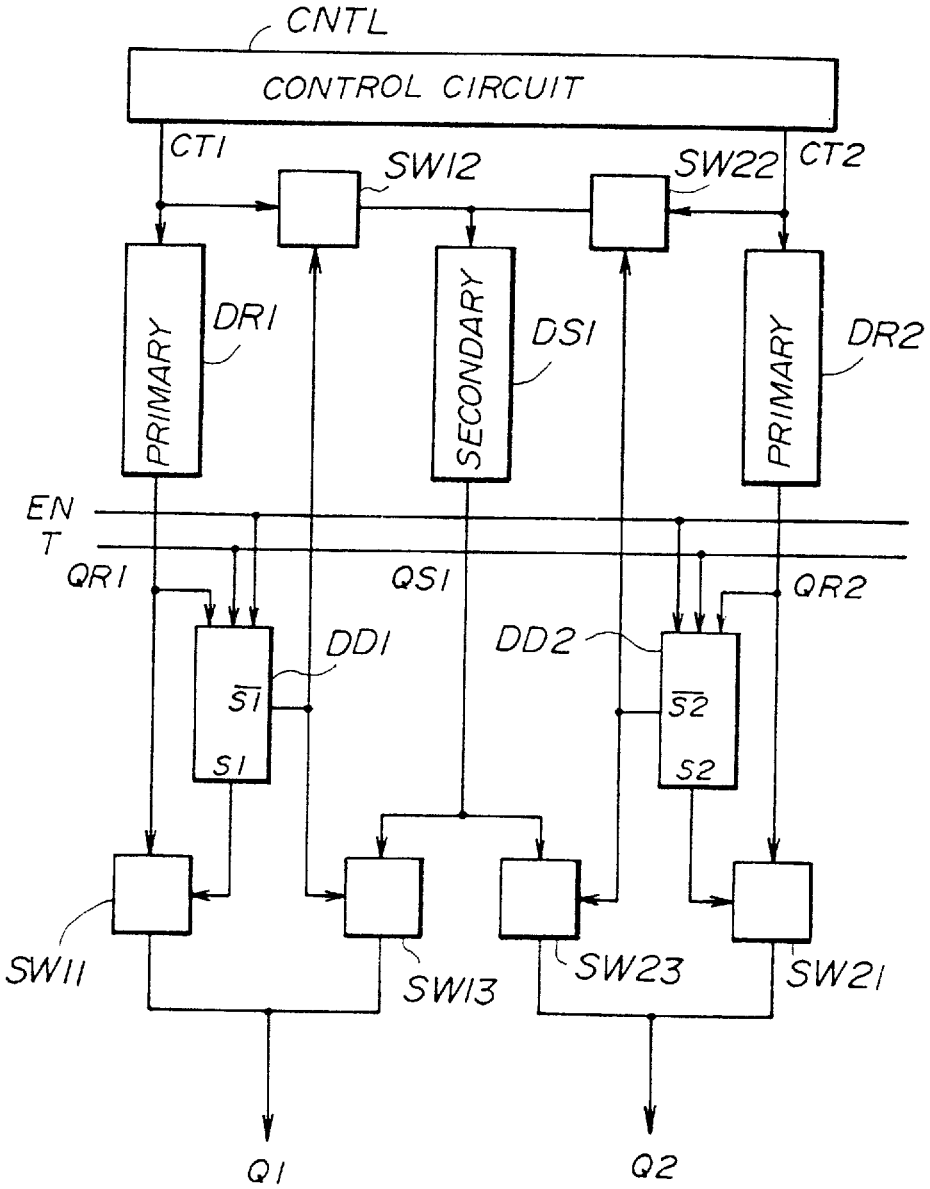
FIG. 27 is a block diagram of a ninth embodiment of the present invention.

Referring to FIG. 27, primary driving voltage output circuits DR1 and DR2, which output driving voltages QR1 and QR2, are provided for output nodes Q1 and Q2 connected to the data lines (columns) or scanning lines (rows). A secondary driving voltage output circuit is provided every group of two primary driving voltage output circuits DR1 and DR2, and outputs a driving voltage QS1. A control circuit CNTL performs a selection among the output voltages of the driving voltage output circuits DR1, DR2 and DS1, and generates control signals CT1 and CT2 indicating operation timings. Switch circuits SW11 and SW21 selectively apply the output voltages of the driving voltage output circuits DR1 and DR2 to the output nodes Q1 and Q2. Switch circuits SW12 and SW22 select either a control signal CT1 or CT2, and applies the selected control signal to the secondary driving voltage output circuit DS1. Switch circuits SW13 and SW23 function to switch the driving voltage QS1 to either the output node Q1 or Q2. A defect detection circuit DD1, which is provided for the primary driving voltage output circuit DR1, detects a defect of the primary driving voltage output circuit DR1 and holds information concerning the detected defect. Further the defect detection circuit DD1 controls the switches SW11, SW12 and SW13. A defect detection circuit DD2, which is provided for the primary driving voltage output circuit DR2, detects a defect of the primary driving voltage output circuit DR2 and holds information concerning the detected defect. Further the defect detection circuit DD2 controls the switches SW21, SW22 and SW23.

In operation, an enable signal EN resets the defect detection circuits DD1 and DD2, and then the control signals CT1 and CT2 controls the primary driving voltage output circuits DR1 and DR2 so that the driving voltages QR1 and QR2 are equal to the reference voltages T. Then, the defect detection circuits DD1 and DD2 compare the driving voltages QR1 and QR2 with the reference voltage T, and hold information concerning the results of the above comparing operation. If the comparison results shows that the primary driving voltage output circuit DR1 (DR2) is normal, the detect detection circuit DD1 (DD2) turns ON the switch circuit SW11 (SW21) ON, and turns OFF the switch circuits SW12 and SW13 (SW22 and SW23). Hence, the driving voltage QR1 (QR2) is applied to the output node Q1 (Q2). If the primary driving voltage output circuit DR2 is defective, the defect detection circuit DD2 turns OFF the switch circuit SW21, and turns ON the switch circuits SW22 and SW23. Hence, the secondary driving voltage output circuit DS1 operates, and its driving voltage QS1 is applied to the output node Q2. In the above manner, it is possible to avoid a defect by adding a simple circuit and to improve the yield rate.

Figure 28:
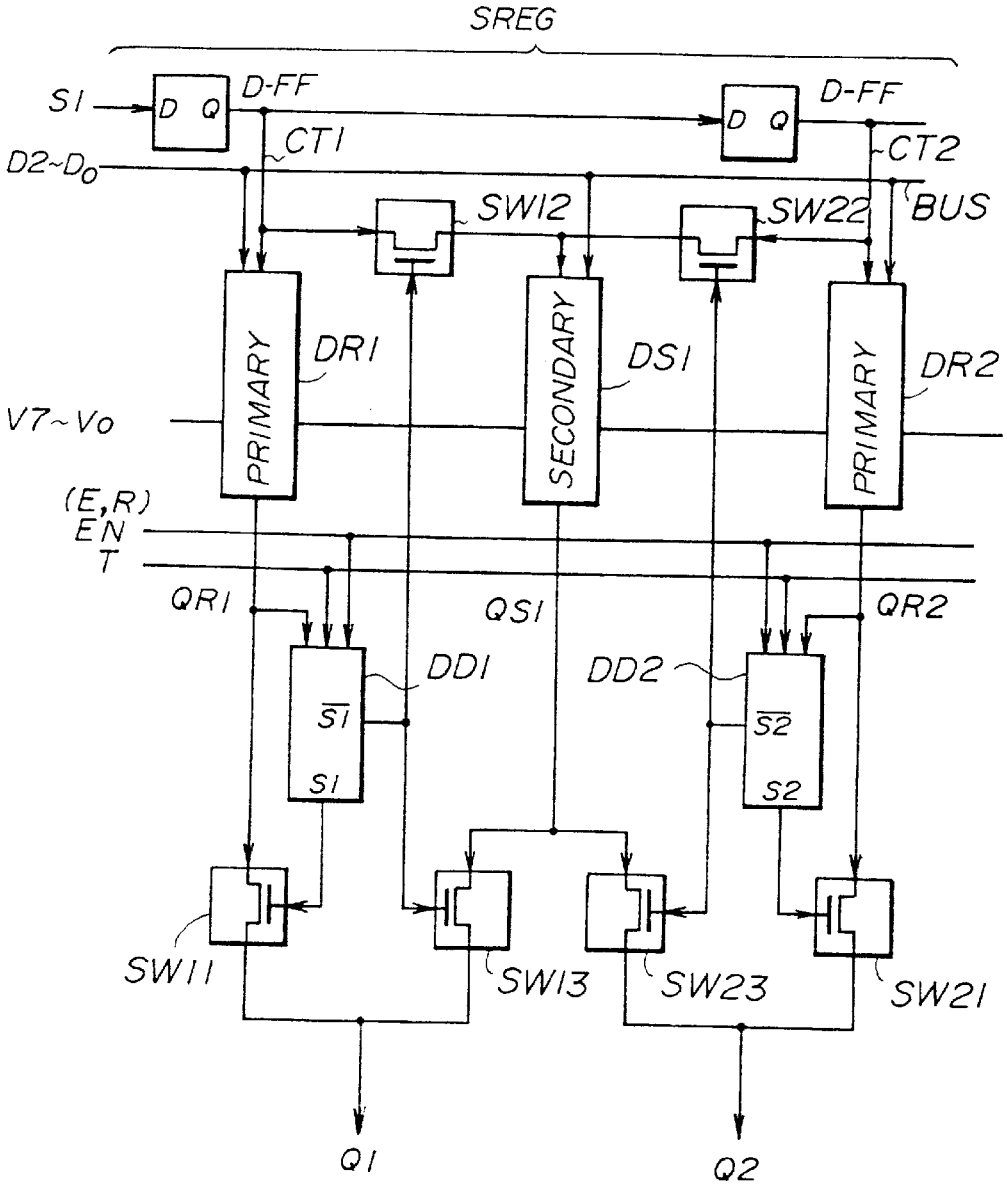
FIG. 28 is a block diagram of an essential feature of the ninth embodiment of the present invention shown in FIG. 27.

FIG. 28 shows an essential feature of the ninth embodiment of the present invention. The control circuit CNTL is made up of a shift register SREG including D-type flip-flops, and a bus BUS carrying the display data D2–D0. The switches SW11, SW12, SW13, SW21, SW22 and SW23 are respectively formed with transfer gates of MOS transistors.

Figure 29:
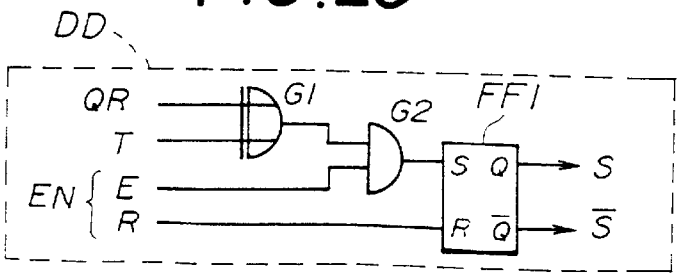
FIG. 29 is a block diagram of a defect detecting circuit shown in FIG. 28.

Further, as shown in FIG. 29, each (DD) of the defect detection circuits DD1 and DD2 is made up of an EOR (exclusive-OR) gate G1, an AND gate G2 and an RS-type flip-flop FF1. The XOR gate G1 performs an XOR operation on the driving voltage QR1 (QR2) and the reference voltage T. The AND gate G2 performs an AND operation of the output signal of the XOR gate G1 and the enable signal E, and the result of the AND operation is applied to a set input terminal S of the flip-flop FF1. The reset signal R is applied to a reset input terminal R of the flip-flop FF1. Each of the driving voltage output circuits DR1, DR2 and DS1 is formed with a conventional digital data driver, which selects one of the driving voltages V7–V0 on the basis of the display data D2–D0.

Figure 30:
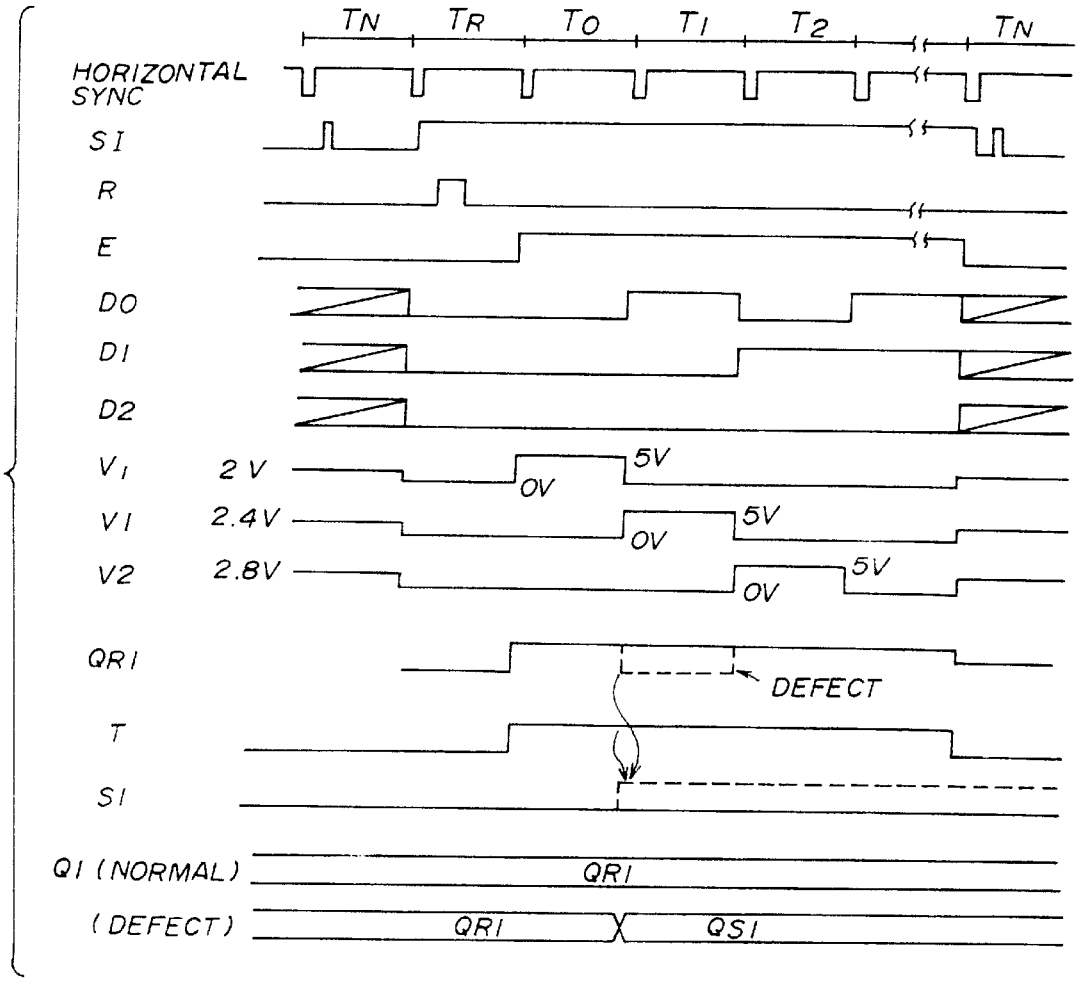
FIG. 30 is a waveform diagram showing the operation of the ninth embodiment of the present invention.

FIG. 30 is a waveform diagram showing the operation of the ninth embodiment of the present invention. As has been described previously, TN denotes the normal operation period, TR denotes the initializing period for the defect detecting operation, and T0–T2 denote defect detection periods.

In the normal operation TN, the starting signal SI is a pulse signal, and the driving voltages V7–V0 are voltages obtained by equally dividing the voltage range between 4.8 [V] and 2 [V]. One of the driving voltages V7–V0 is selected according to the display data D2–D0. At this time, the defect detection circuits DD1 and DD2 are controlled by the enable signal E in order to prevent the contents held therein from being changed. In the initializing period TR in which the defect detection circuits DD1 and DD" are initialized, the starting signal SI is switched to the high level so that the display data D2–D0 are input to the driving voltage output circuits DR1 and DR2. The defect detection circuits DD1 and DD2 are reset by the reset signal R.

In the period T0, it is determined whether or not the driving voltage V0 is correctly output. During the period T0, the display data D2–D0 causes the driving voltage output circuits DR1 and DR2 to output the driving voltage V0. Further, the voltage V0 is set to 5 [V], and the voltages V1–V7 are set to 0 [V]. When the primary driving voltage output circuits DR1 and DR2 operate normally, the driving voltages QR1 and QR2 are equal to 5 [V]. Hence, the defect detection circuits DD1 and DD2 compares the driving voltages QR1 and QR2 with the reference voltage 5 [V]. When the primary driving voltage output circuits DR1 and DR2 do not have any defect, the RS flip-flop FF1 (FIG. 29) is maintained in the reset state. The period T1 is provided for determining whether or not the driving voltage V1 is correctly output. During the period T1, the same operation as that during the period T0 is carried out. As indicated by broken lines shown in FIG. 30, if the driving voltage QR1 (QR2) is not equal to 5 [V], the RS flip-flop FF1 is set, and is never reset thereafter.

In the above-mentioned manner, the driving circuits DR1, DR2 and DS1 are checked. If the primary driving voltage output circuits DR1 and DR2 operate normally, the switch circuit SW11 (SW21) is turned ON, and the switch circuits SW12 and SW 13 (SW22 and SW23) are turned OFF. Hence, the driving voltage QR1 (QR2) is output to the output node Q1 (Q2). For example, if the primary driving voltage output circuit DR2 is defective, the switch circuits SW22 and SW23 are turned ON and the switch SW21 is turned OFF. Hence, the driving voltage QS1 is output to the output node Q2. Hence, the correct operation can be ensured unless two of the driving voltage output circuits DR1, DR2 and DS1 are simultaneously defective. Further, the configuration shown in FIG. 29 is simple.

TENTH EMBODIMENT

Figure 31:
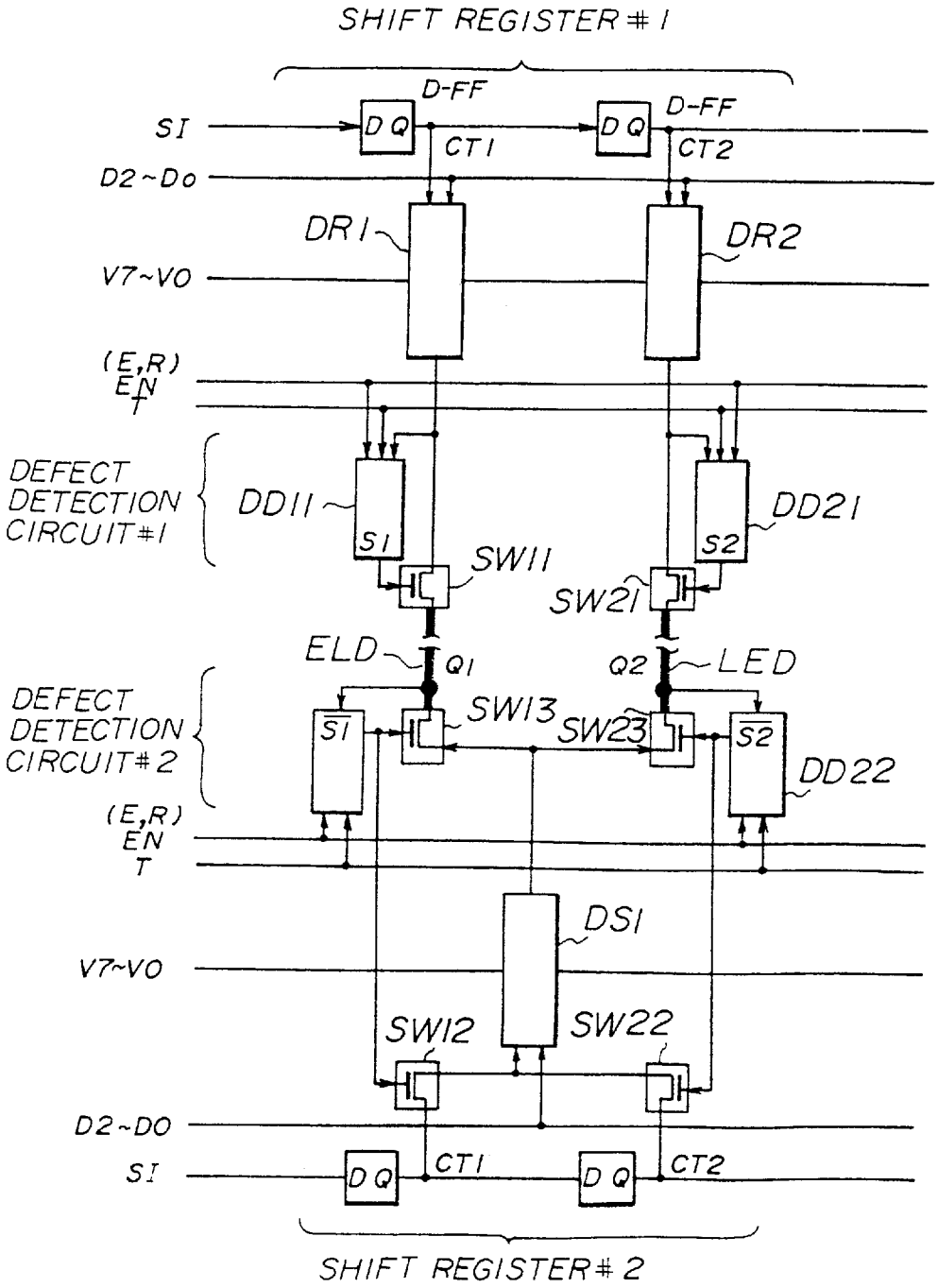
FIG. 31 is a block diagram of a tenth embodiment of the present invention.

A description will now be given, with reference to FIG. 31, of a tenth embodiment of the present invention. The tenth embodiment of the present invention differs from the ninth embodiment thereof in that a shift register #1, the primary driving voltage output circuits DR1 and DR2, a defect detection circuit group #1 (DD11 and DD21), and switch circuits SW11 and SW21 are located on ends of row electrodes (column electrodes) ELD (signal lines), and a shift register #2, the secondary deriving circuit DS1, a defect detection circuit group (DD12 and DD22), and switch circuits SW12, SW22, SW13 and SW23 are provided on the other ends of the electrodes ELD. The shift registers #1 and #2 have the same configuration, and the defect detection circuit groups #1 and #2 have the same configuration.

According to the tenth embodiment of the present invention, a defect of the primary driving voltage output circuit DR1 (DR2) is detected and held by the defect detection circuits DD11 and DD12 (DD21 and DD22). Then, the circuit DD11 (DD21) controls the switch circuit SW11 (SW21), and the circuit DD12 (DD22) controls the switch circuits SW12 and SW13. Hence, it is possible to ensure the correct operation with a simple circuit.

Further, the tenth embodiment of the present invention has the following particular advantage. The defect detection circuit groups #1 and #2 are provided on the respective sides of the electrodes ELD. Hence, it is possible to correct not only defects of the driving voltage output circuits but also defects of the electrodes ELD. That is, if an electrode ELD (data line) is defective (broken) in the configuration shown in, for example, FIG. 28, while the driving voltage output circuit DR1 (DR2) is normal, the driving voltage is not transferred to the display elements. Hence, image information displayed on the above display elements is lost. In this case, according to the tenth embodiment of the present invention, a defect of the electrode ELD can be detected by the defect detection circuit DD12 (DD22), and the driving voltage is applied to the electrode from the other side thereof. Hence, image information is not lost.

In the ninth and tenth embodiments of the present invention, the digital data drivers DR1, DR2 and DS2 are used. Alternatively, the configurations of the ninth and tenth embodiments of the present invention can be applied to a conventional analog data driver, which holds and output display data in analog form. In this case, voltages 0 [V] and 5 [V] are applied, and the reference voltage T is selectively set to 0 [V] and 5 [V].

Further, it is possible to apply the ninth and tenth embodiments of the present invention to a conventional scan driver, to which a select voltage and a non-select voltage are applied. Normally, either the select voltage or the non-select voltage is selected on the basis of the output levels of the shift register. The starting signal SI is set to the high level to determine whether or not the select voltage is output, and is then set to the low level to determine whether or not non-select voltage is output.

ELEVENTH EMBODIMENT

Figure 32:
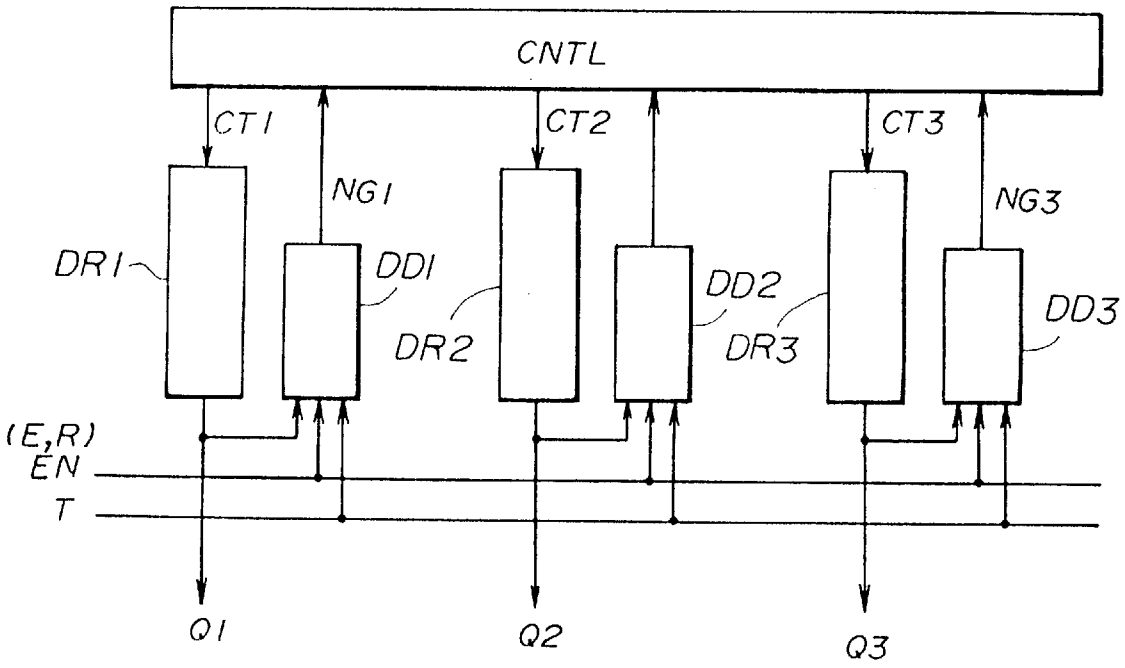
FIG. 32 is a block diagram of an eleventh embodiment of the present invention.

A description will now be given of an eleventh embodiment of the present invention with reference to FIG. 32.

According to the eleventh embodiment of the present invention, there is a larger number of row (columns) electrodes than the number of rows (columns) of images. Further, driving voltage output circuits DR1, DR2, . . . are provided for the respective electrodes, and defect detection circuits DD1, DD2, . . . are provided for the driving voltage output circuits DR1, DR2, . . . , respectively. Further, a control circuit CNTL is provided which controls the control signals CT1, CT2, . . . on the basis of output signals NG1, NG2, . . . of the defect detection circuits DD1, DD2, . . . respectively. If a defect is detected, display data which is originally displayed at the line at which the above defect is detected is shifted to the adjacent normal driving voltage output circuit.

According to the eleventh embodiment of the present invention, it is possible to prevent display information from being lost while a defective row or column cannot be recovered.

Figure 33:
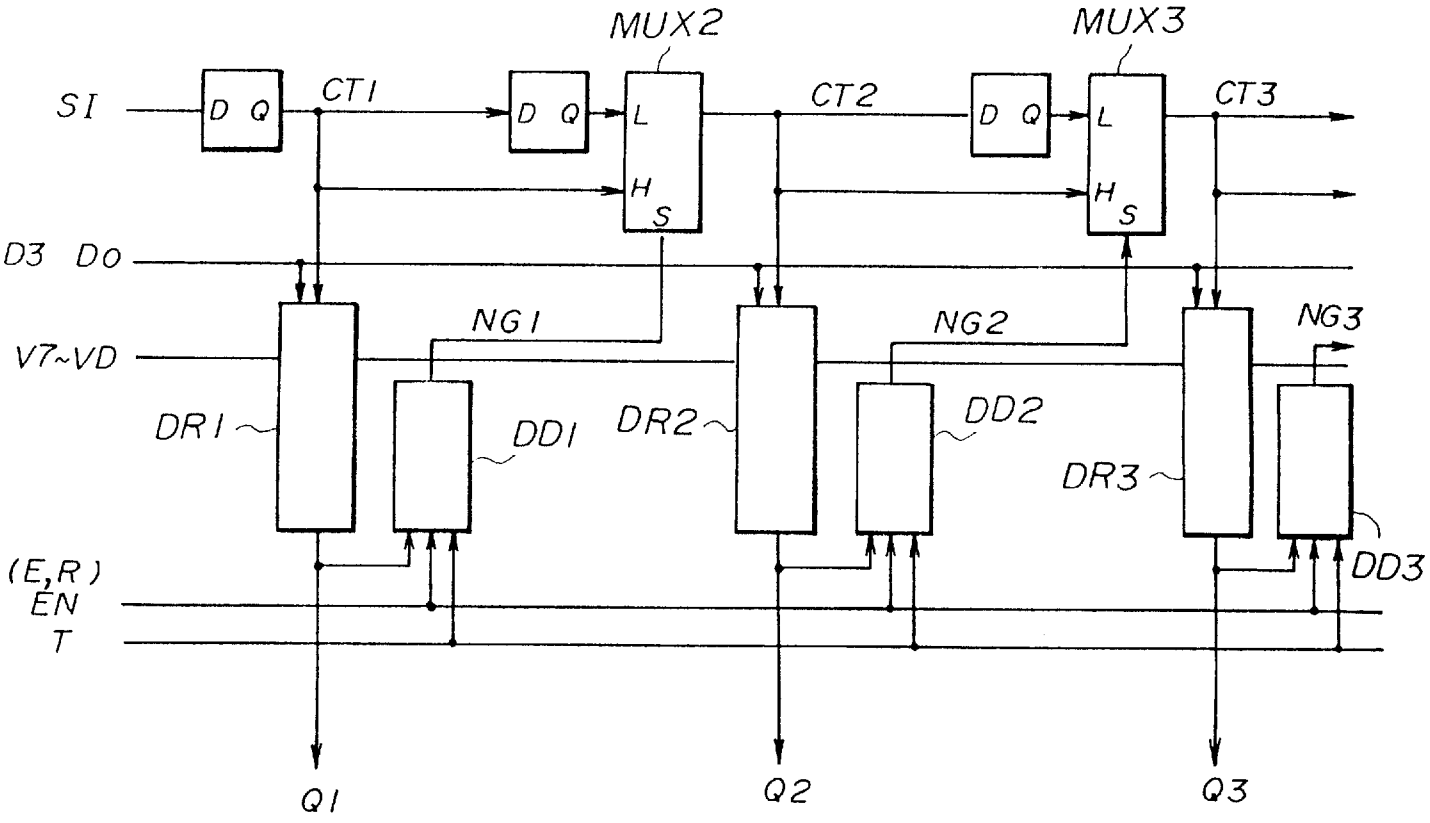
FIG. 33 is a block diagram of an essential part of the eleventh embodiment of the present invention shown in FIG. 32.

FIG. 33 shows an essential part of the eleventh embodiment of the present invention. The control circuit CNTL is formed with a shift register, in which multiplexers (MUX2, MUX3, . . . ) are provided at respective stages of the shift register. An output signal $NG_n$ of the defect detection circuit $DD_n$ at the nth stage is input to a control input terminal S of the multiplexer $MUX_{n+1}$ of the (n+1) th stage. When the control input terminal S is at the low level, the multiplexer $MUX_{n+1}$ selects the (n+1) th bit of the shift register. When the control input terminal S is at the high level, the multiplexer $MUX_{n+1}$ selects the nth bit of the shift register.

Figure 34:
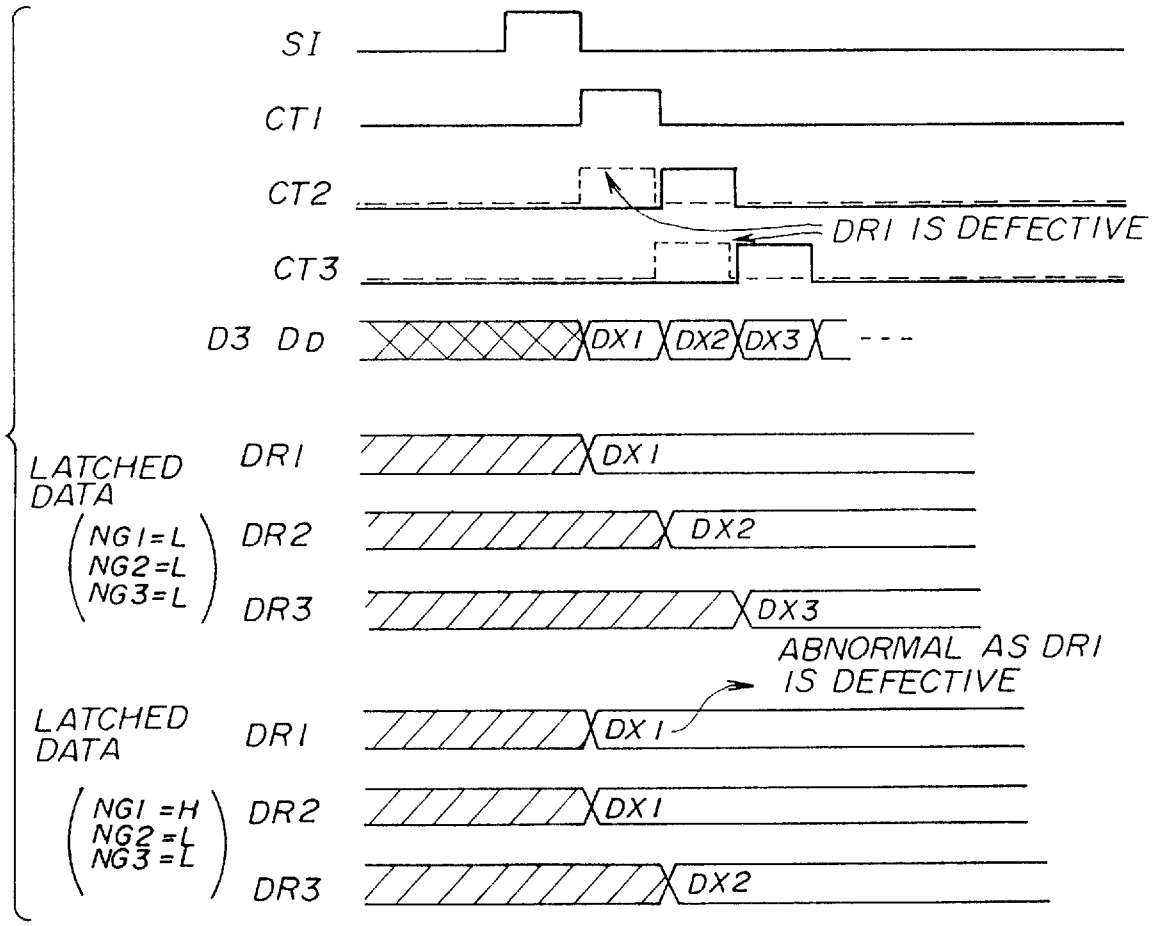
FIG. 34 is a waveform diagram showing the operation of the eleventh embodiment of the present invention.

FIG. 34 shows the operation of the eleventh embodiment of the present invention in a case where the digital data drivers are used as the driving voltage output circuits. When the output signals CT, CT2, . . . are at the high level, display data D3–D0 are input to the driving voltage output circuits DR1, DR2, . . . , which output the corresponding driving voltages.

If there are no defects in the driving voltage output circuits DR1, DR2, . . . (NG1=L, NG2=L, NG3=L, . . . ), the multiplexer MUX2 selects the second bit of the shift register, and outputs it as the control signal CT2. The multiplexer MUX3 selects the third bit of the shift register and outputs it as the control signal CT3. Hence, the control signals $CT_n$ are obtained by sequentially shifting the starting signal SI, as indicated by solid lines in FIG. 34. Hence, display data DXL, DX2 and DX3 are sequentially input to the driving voltage output circuits DR1, DR2 and DR3.

For example, if the driving voltage output circuit DR1 has a defect (NG1=H, NG2=L, NG=L, . . . ), the multiplexer MUX2 selects the first bit of the shift register. Hence, as shown by broken lines shown in FIG. 34, the output signal CT2 of the shift register is switched to the high level at the same timing as the output signal CT1. Then, the output signals CT3, CT4, . . . are output one shift timing earlier than the original output timings thereof. As a result, display data DX1 (incorrect), DX1 and DX2 are sequentially input to the driving voltage output circuits DR1, DR2 and DR3, respectively. According to the prior art, the display data DX1 is not displayed due to a defect of the driving voltage output circuit DR1. According to the eleventh embodiment of the present invention, the display data is displayed by the driving voltage output circuit DR2, and display data subsequent to the display data DX1 are sequentially shifted and applied to the driving voltage output circuits located after the original driving voltage output circuits to which the display data are originally applied.

Figure 35A:
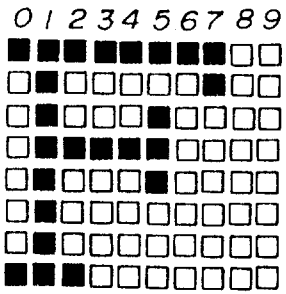
FIGS. 35A, 35B and 35C are diagrams showing examples of a display.

FIG. 35A shows a display of character "F" in a case where the driving voltage output circuits do not have any defects at all. The ninth and tenth columns are not used for display, and are redundant. Dummy data (white display data) is supplied to the eight and ninth columns. If the eleventh embodiment is applied to the data line driving circuit DDC shown in FIG. 1, dummy data is output every horizontal period. If the eleventh embodiment is applied to the scanning line driving circuit SDC shown in FIG. 1, the dummy data is output every vertical period.

Figure 35B:
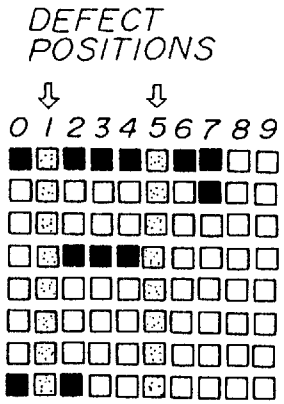

FIG. 35B shows a conventional display of character "F" in which the driving voltage output circuits corresponding to the first and fifth columns have defects. As shown in FIG. 35B, display data to be displayed in the first and fifth columns are lost.

Figure 35C:
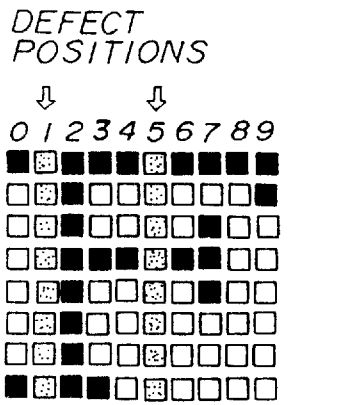
PRIOR ART FIG.35C

FIG. 35C shows a display of character "F" according to the eleventh embodiment of the present invention. As shown in FIG. 35C, display data to be originally displayed in the first column is shifted to the second column, and display data to be originally displayed in the second and third columns are shifted to the third and fourth columns. Further, display data to be originally displayed in the fourth column is shifted to the sixth column because the first and fifth columns are defective. It will be noted that the display of character "F" in FIG. 35C is readable, while the display of character "F" in FIG. 35B is not readable.

TWELFTH EMBODIMENT

A description will now be given, with reference to FIG. 36, of a twelfth embodiment of the present invention.

Figure 36:
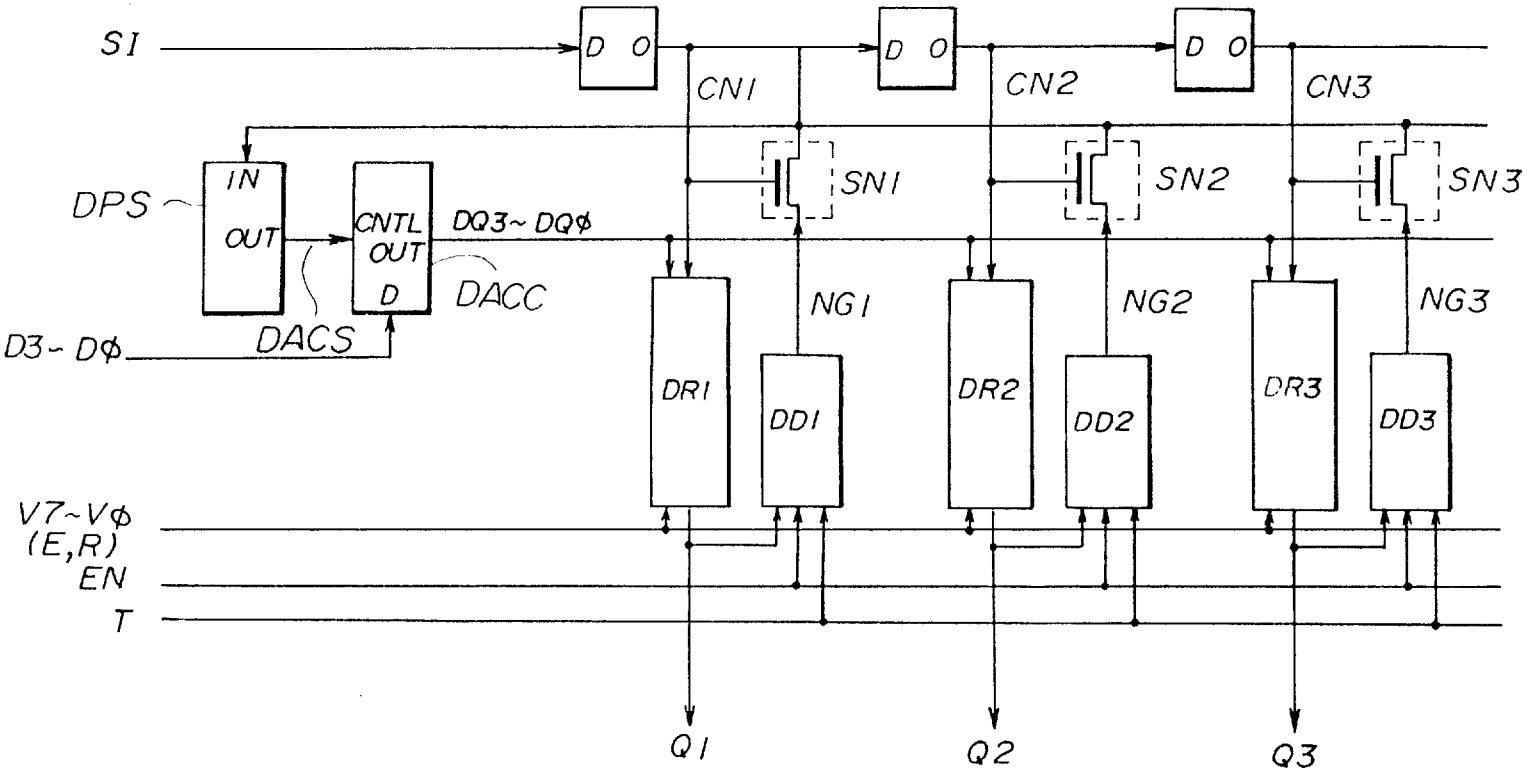
FIG. 36 is a block diagram of a twelfth embodiment of the present invention.

Referring to FIG. 36, the output signals of defect detection circuits DD1, DD2, . . . are sequentially transferred to a defect position storage circuit DPS via switch circuits SN1, SN2, . . . controlled by the one-bit output signals of the shift register. The defect position storage circuit DPS generates a data arrangement control signal DACS used to insert dummy data in a defective position and to insert dummy data corresponding to the number of defects in a row (column) before and after display data. When the configuration shown in FIG. 36 is applied to the data line driving circuit DDC shown in FIG. 1, dummy data is inserted on the left and right sides of an image. When the configuration shown in FIG. 36 is applied to the scanning line driving circuit SDC shown in FIG. 1, dummy data is inserted on the upper and lower sides of an image. A data arrangement control circuit DACC actually inserts the dummy data into the display data in response to the data arrangement control circuit DACS.

Figure 37:
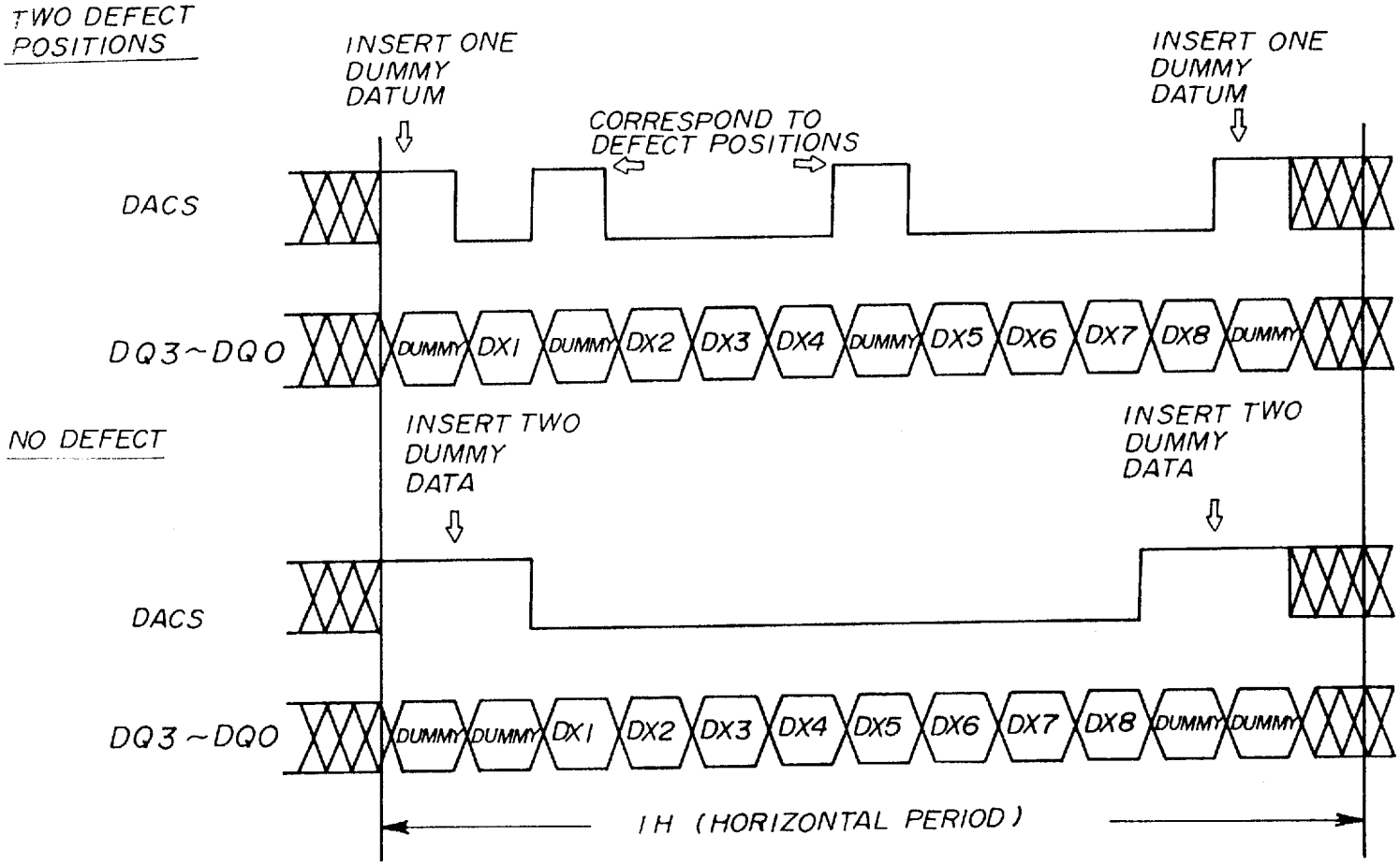
FIG. 37 is a waveform diagram showing the operation of the twelfth embodiment of the present invention.

FIG. 37 shows the operation of the twelfth embodiment of the present invention. As shown in FIG. 37, if two columns or rows are defective, dummy data is inserted into the display data D3–D0 at the defective positions and is inserted before and after the display data in one horizontal period H. When there is no defect, two pieces of dummy data are inserted before the display data in one horizontal period H, and are inserted after the above display data.

Figure 38:
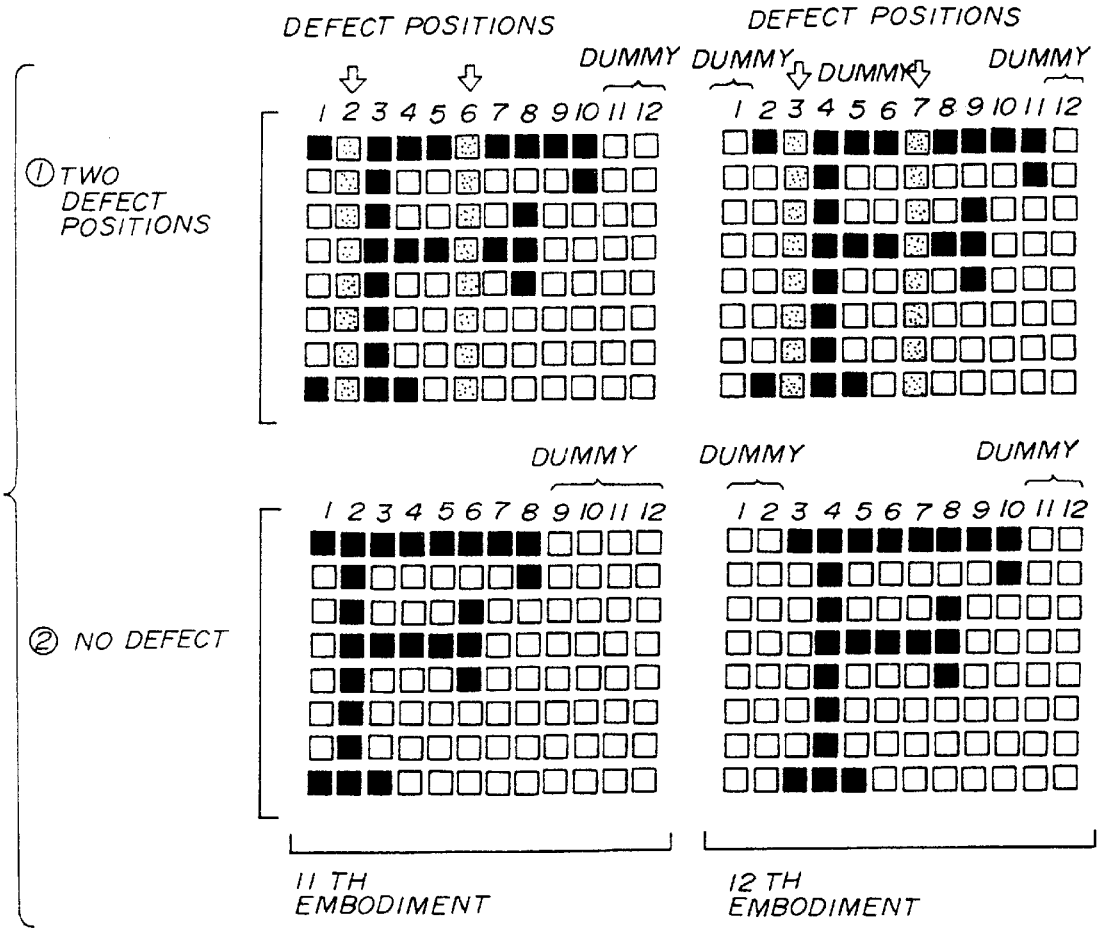
FIG. 38 is a diagram showing examples of a display.

FIG. 38 shows displays of character "F" obtained by the operations shown in FIG. 37. In the aforementioned eleventh embodiment of the present invention, the left ends of images are fixed irrespective of whether there is one defective driving voltage output circuit or a plurality of driving voltage output circuits, as shown on the left part of FIG. 38.

According to the twelfth embodiment of the present invention, the centers of images are located at the same position as each other irrespective of whether there is one defective driving voltage output circuit or a plurality of driving voltage output circuits, as shown on the right part of FIG. 38. As a result, the twelfth embodiment of the present invention is suitable for applications required to display images at the center of the display screen, for example, view finders and television sets.

The number of pieces of dummy data may be selected so that the number of pieces of dummy data on the left side of the screen is the same as or different from that on the right side thereof.

In the twelfth embodiment of the present invention, the digital data drivers are used. Alternatively, the configuration of the twelfth embodiment of the present invention can be applied to a conventional analog data driver, which holds and output display data in analog form. In this case, voltages 0 [V] and 5 [V] are applied, and the reference voltage T is selectively set to 0 [V] and 5 [V].

Further, it is possible to apply the twelfth embodiment of the present invention to a conventional scan driver, to which a select voltage and a non-select voltage are applied. Normally, either the select voltage or the non-select voltage is selected on the basis of the output levels of the shift register. The starting signal SI is set to the high level to determine whether or not the select voltage is output, and is then set to the low level to determine whether or not non-select voltage is output.

THIRTEENTH EMBODIMENT

A description will now be given of a thirteenth embodiment of the present invention.

Figure 39:
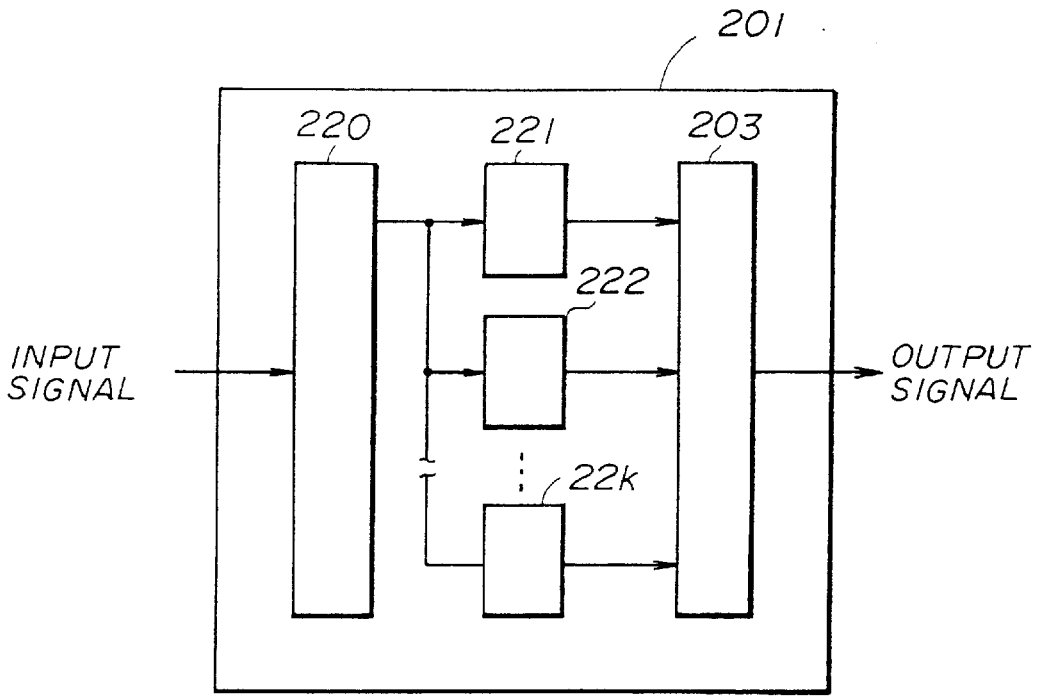
FIG. 39 is a block diagram of a thirteenth embodiment of the present invention.

FIG. 39 shows an overview of the thirteenth embodiment of the present invention, more particularly a stage of a shift register of the driving circuit. A reference number 201 indicates a functional block corresponding to a stage of the shift register. Some or all structural parts of the functional block 201 have redundant structures. For example, the functional block 201 has a plurality of identical circuits 221 through 22*k* multiplexed in parallel where k is a positive integer. The circuits 221 through 22*k* are, for example, registers formed with flip-flops. A circuit 220 is not multiplexed and has the function of distributing an input signal to the circuits 221 through 22*k*. A reference number 203 indicates a majority-based (decision by majority) processing circuit 203, which receives the output signals of the circuits 221 through 22*k* and determines which output value has a majority. Then, the circuit 203 outputs, as an output signal, the output value having a majority.

If there are not defects in the structural parts of the functional block 201, the circuits 221 through 22*k* outputs the same output value (correct value), and hence the majority-based processing circuit 203 outputs the above correct output value. In a case where there are defects in some of the circuits 221 through 22*k* (their output signals are fixed to the high or low levels), the circuit 203 outputs the correct output value if the number of defective circuits is less than k/2. With the above structure, the correct operation of the functional block can be automatically ensured without a display check.

It is preferable that the number k is an odd number in light of a decision by majority. However, the number k may be an even number if the probability that k/2 circuits are defective is low or if k is a large number taking into account the defect occurrence rate. Further, it is possible to employ a plurality of circuits 220 and/or a plurality of circuits 203.

Figure 40A:
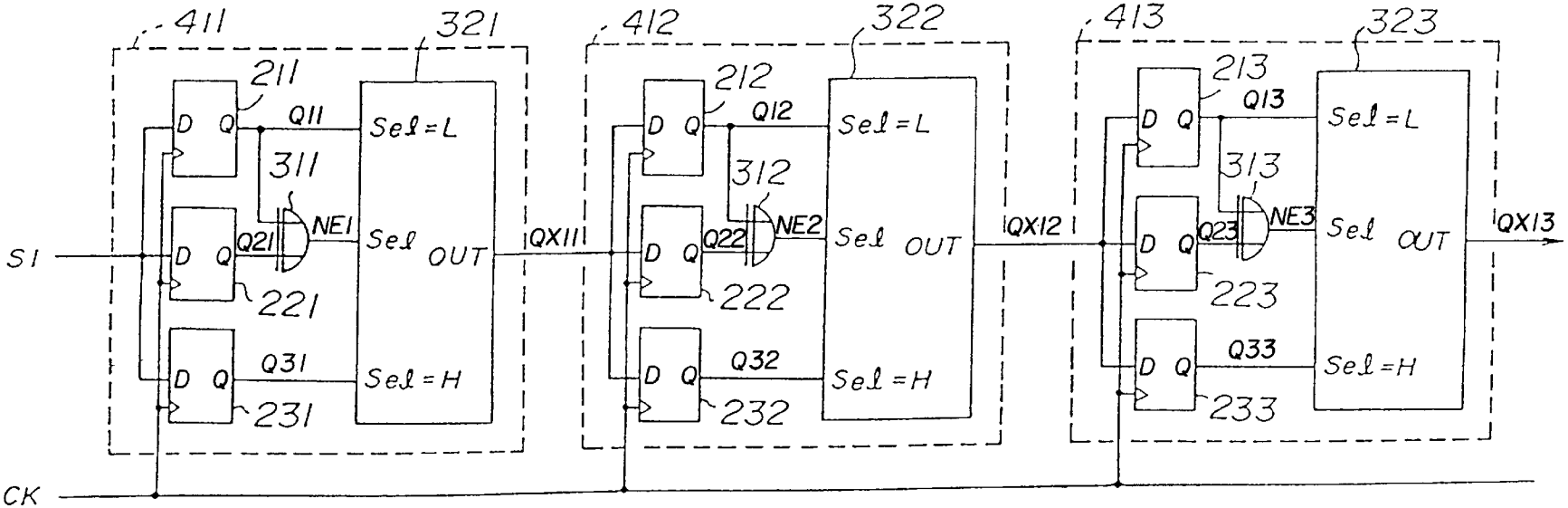
FIG. 40A is a block diagram of an essential part of the thirteenth embodiment of the present invention.

FIG. 40A shows an essential part of the thirteenth embodiment of the present invention, and more particularly shows three stages (three bits) 411, 412 and 413 of a shift register according to the thirteenth embodiment. Each of the three stages corresponds to the functional block 201 shown in FIG. 39, and D-type flip-flops correspond to the multiplexed structural parts 221 through 22*k*.

The circuits 411, 412 and 413 latch input signals SI, QX11 and QX12 in synchronism with the clock signal CK, and outputs them as QX11, QX12 and QX13 in synchronism therewith. Each of the circuits 411, 412 and 413 has the same structure as each other, and hence a description will now be given of only the circuit 411.

The circuit 411 includes three registers 211, 221 and 231 respectively formed with D-type flip-flops, which receive the starting signal SI. An XOR circuit 311 performs an XOR operation on an output signal Q11 of the register 211 and an output signal Q21 of the register 221, and outputs a mismatch (not-equal) signal NE1 to a terminal sel of a multiplexer 321. The output signal Q11 is applied to a sel=L terminal of the multiplexer 321, and an output signal Q31 of the register 231 is applied to a sel=H terminal thereof. The multiplexer 321 selects either the sel=L terminal or the sel=H terminal on the basis of the mismatch signal NE1 from the XOR circuit 311.

Figure 40B:
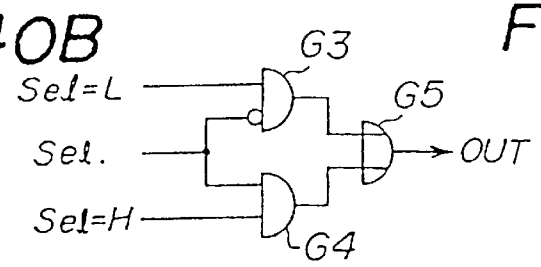
FIG. 40B is a block diagram of a multiplexer used in the thirteenth embodiment of the present invention shown in FIG. 40A.
Figure 40C:
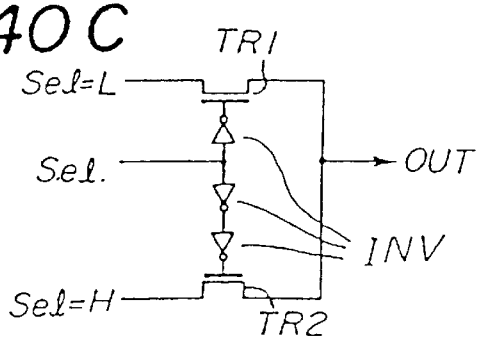
FIG. 40C is a block diagram of another configuration of the multiplexer used in the thirteenth embodiment of the present invention shown in FIG. 40A.

FIG. 40B shows a configuration of the multiplexer 321, which includes logic gates G3, G4 and G5. FIG. 40C shows another configuration of the multiplexer 321, which includes inverters INV and transfer gates TR1 and TR2 formed with MOS transistors. The configuration shown in FIG. 37C is simpler than that shown in FIG. 40B, but needs a voltage higher than he drain voltage of the transfer gates. Hence, the configuration shown in FIG. 40C needs an inverter circuit with a level shift function driven by another power source.

Figure 41:
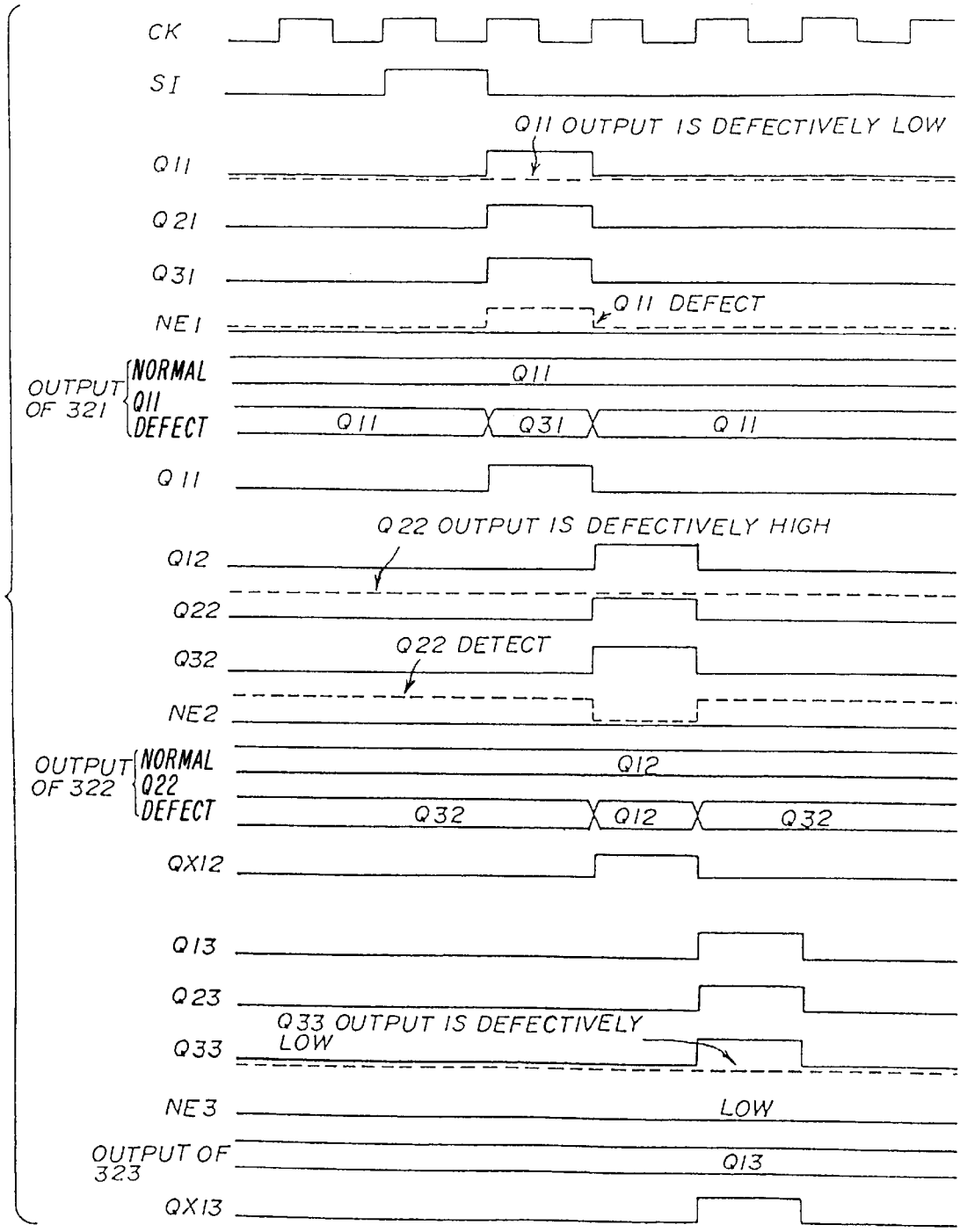
FIG. 41 is a waveform diagram showing the operation of the thirteenth embodiment of the present invention.

FIG. 41 shows the operation of the configuration shown in FIG. 40A. If there are no defects in the registers 211, 221 and 231, the output signals Q11, Q21 and Q31 have waveforms obtained by sequentially shifting the starting signal SI every clock CK, as indicated by the solid lines shown in FIG. 41. Since Q11 is equal to Q21, the mismatch signal is maintained at the low level (indicating that Q11=Q21). Hence, the multiplexer 321 continues to select the output signal Q11, and the output signal QX11 has the correct pulse waveform.

For example, if the register 211 has a defect causing its output signal Q11 to be fixed to the low level, as indicated by a broken line shown in FIG. 41, the output signal Q11 is not equal to the output signal Q21 during a period in which the output signal Q11 is originally high. Hence the mismatch signal NE1 is switched to the high level (mismatch), as indicated by a broken line shown in FIG. 41. Hence, the multiplexer 321 selects the output signal Q11 when the mismatch signal NE1 is high, and selects the output signal Q31 when the mismatch signal NE1 is low. As a result, the output signal Q31 (having a majority) is obtained during a period in which the output signal Q11 is not high, and the output signal QX11 has the correct pulse waveform.

For example, if a defect has occurred in the register 222 and the output signal thereof is permanently high, as indicated by a broken line shown in FIG. 41, the output signal Q22 is not equal to the output signal Q12 during a period in which the output signal Q22 is originally low. Hence, the mismatch signal NE2 is high (mismatch), as indicated by a broken line shown in FIG. 41. Hence, the multiplexer 322 selects the output signal Q12 during a period when the mismatch signal NE2 is low, and selects the output signal Q32 during a period when the mismatch signal NE2 is high. As a result, the output signal Q32 (having a majority) is obtained during a period in which the output signal Q22 is incorrect, and the output signal QX21 has the correct pulse waveform.

For example, if a defect has occurred in the register 233 and its output signal Q33 is permanently low, as indicated by a broken line shown in FIG. 41, the output signals Q13 and Q23 have the correct pulse waveforms. Hence, the mismatch signal NE3 is permanently low (match), and the multiplexer 323 selects the output signal Q13 having a majority. Hence, the output signal QX13 has the correct pulse waveform.

As described above, the output signal having a majority is output even if some of the multiplexed structural parts are defective. Hence, the display check is needed and the correct operation can be automatically ensured.

FOURTEENTH EMBODIMENT

A description will now be given of a fourteenth embodiment of the present invention with reference to FIGS. 42A, 42B, 42C and 42D, in which those parts that have the same name as those of the thirteenth embodiment thereof are given the same reference numbers as previously.

Figure 42A:
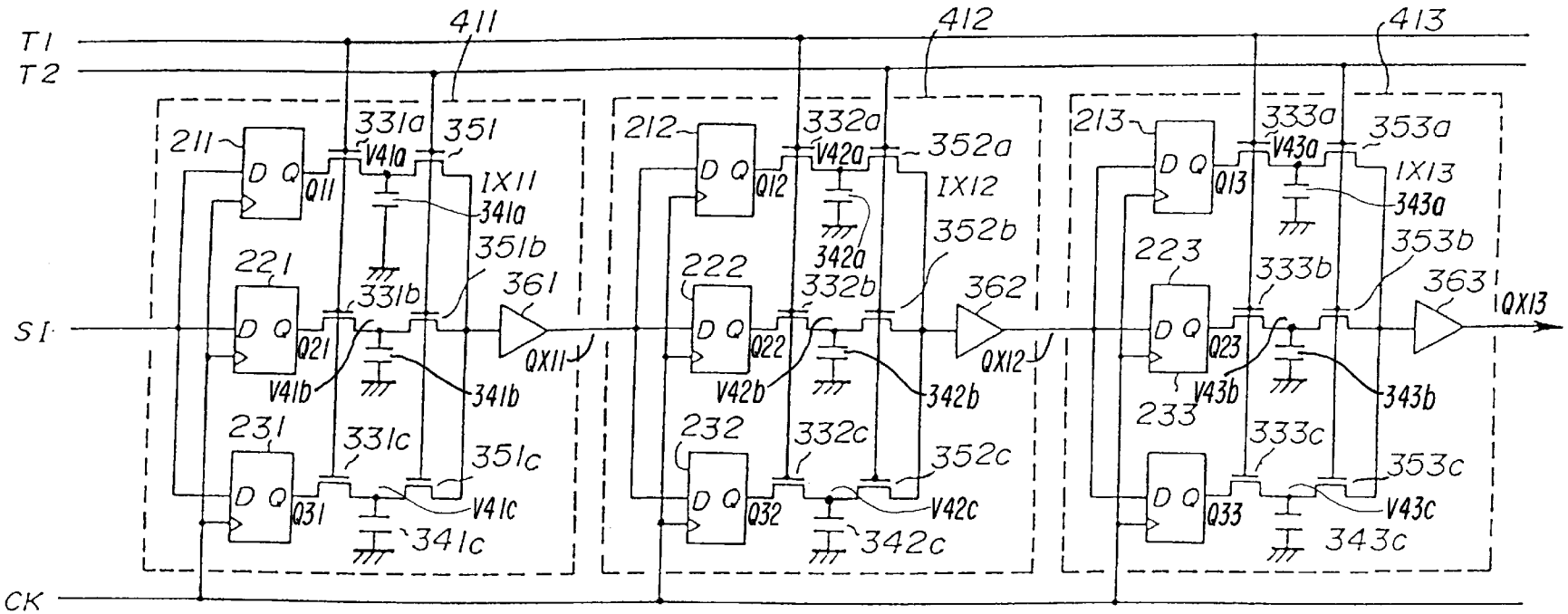
FIG. 42A is a block diagram of a fourteenth embodiment of the present invention.

Each of the stages (registers) 411, 412 and 413 shown in FIG. 42A has the same configuration as each other, and the following description relates to only the stage 411. The stage 411 includes switches 331*a*, 331*b* and 331*c*, which are turned ON and OFF in response to a first control signal T1. Further, the stage 411 includes switches 351*a*, 351*b* and 351*c*, which are turned ON and OFF in response to a second control signal T2. Furthermore, the stage 411 includes capacitance elements 341*a*, 341*b* and 341*c*, each having a grounded end. Moreover, the stage 411 includes an amplifier 361 having a characteristic shown in FIG. 42D, in which VH is the high level (equal to, for example, 5 [V]), and VL is the low level (equal to, for example, 0 [V]). The first and second control signals T1 and T2 are supplied from, for example, an external device.

Figure 42C:
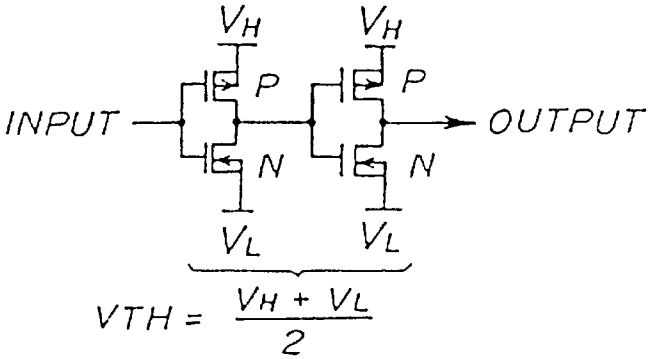
FIG. 42C is a circuit diagram of another configuration of the amplifier used in the configuration shown in FIG. 42A.
Figure 42B:
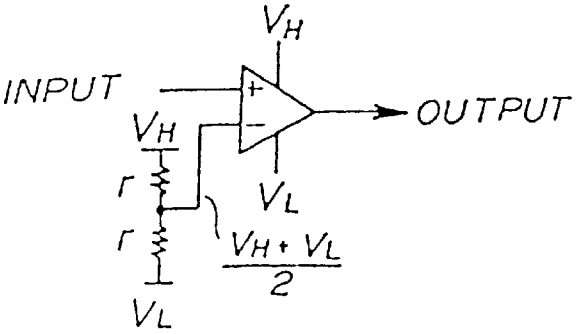
FIG. 42B is a circuit diagram of an amplifier used in the configuration shown in FIG. 42A.
Figure 42D:
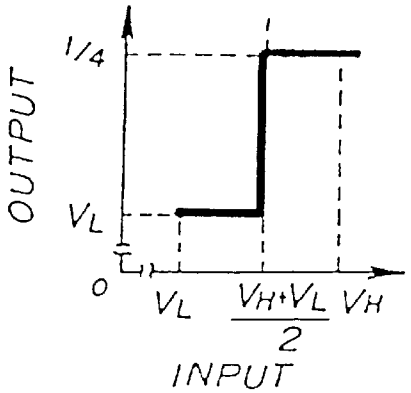
FIG. 42D is a graph of a characteristic of the amplifier used in the configuration shown in FIG. 42A.

The amplifier 361 has a configuration shown in FIG. 42B, in which an operational amplifier is used. A series circuit of two registers r is connected between the VH voltage line and the VL voltage line, and a connection node thereof is connected to the inverting input terminal of the operational amplifier. Thus, a voltage (VH+VL)/2 is applied to the inverting input terminal of the operational amplifier.

FIG. 42C shows another configuration of the amplifier 361, which includes two CMOS inverters connected in series. The threshold voltage of each of the CMOS inverters is set equal to (VH+VL)/2.

The registers 211, 221 and 231 formed with D-type flip-flops are connected to ends of the switches 331*a* 331*b* and 331*c*, respectively. The other ends of the switches 331*a* 331*b* and 331*c* are connected to ends of the capacitance elements 341*a*, 341*b* and 341*c* and ends of the switches 351*a*, 351*b* and 351*c*, respectively.

A description will now be given, with reference to FIG. 43, of the operation of the fourteenth embodiment of the present invention. If there are no defects in the registers 211, 221 and 231, the output signals Q11, Q21 and Q31 thereof have pulse waveforms obtained by sequentially shifting the starting signal SI in synchronism with the clock signal CK, as indicated by solid lines shown in FIG. 43. Then, the capacitance elements 341*a*, 341*b* and 341*c* latch the voltages of the output signals Q11, Q21 and Q31 in synchronism with the first control signal T1 (V41*a*, V41*b*, V41*c*). When the first and second control signals T1 and T2 are switched to the low and high levels so that the ends of the capacitance elements 341*a*, 34*b* and 341*c* are short circuited, the average voltage of V41*a*, V41*b* and V41*c* becomes equal to IX11. In this case, the output signal IX11 is a pulse waveform between VL and VH, and the amplifier having the threshold voltage (VH+VL)/2 outputs an output voltage having a pulse waveform QX11 between VL and VH.

Figure 43:
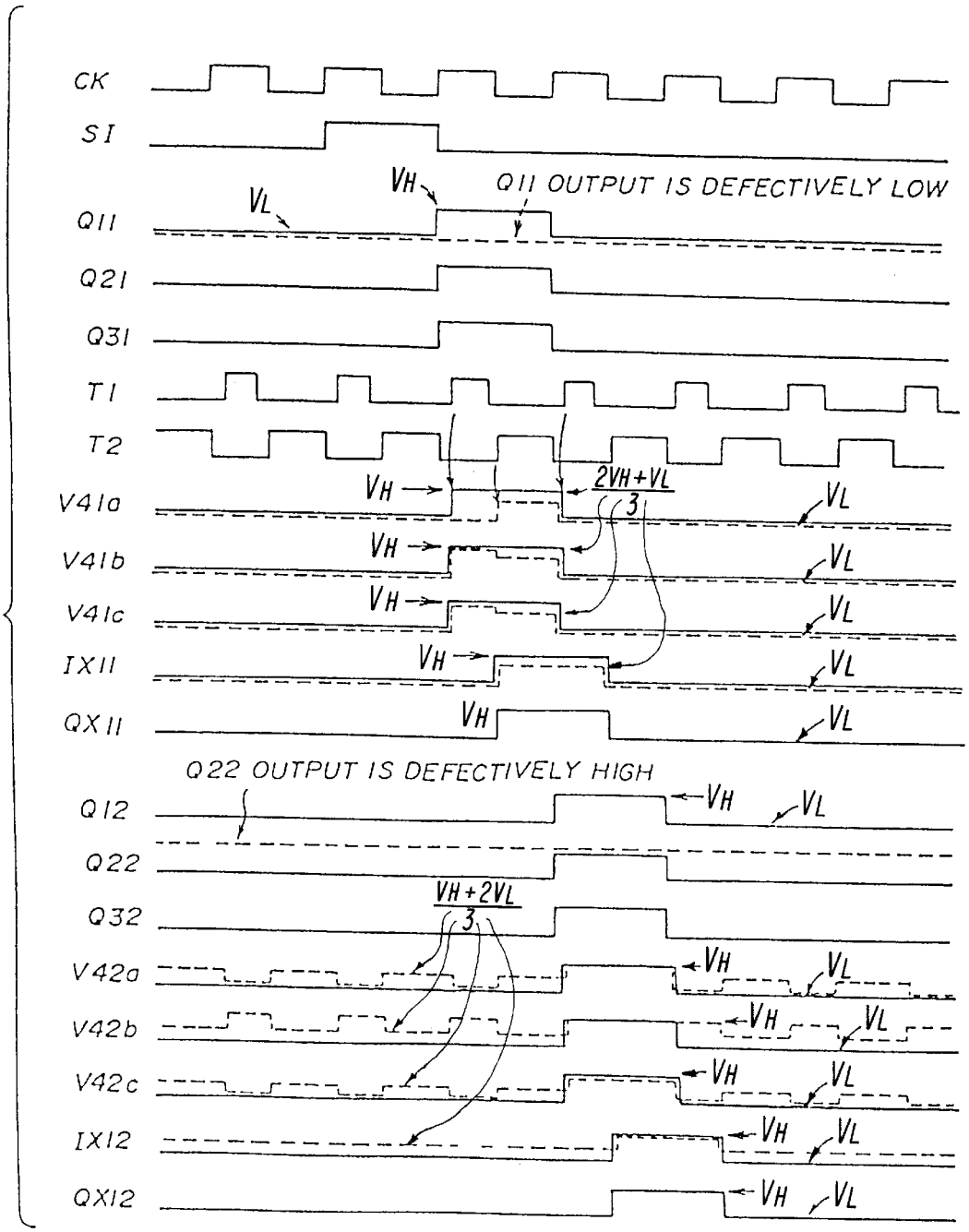
FIG. 43 is a waveform diagram showing the operation of the fourteenth embodiment of the present invention.

If a defect has occurred in the register 211 and its output signal Q11 is fixed to the low level, as indicated by a broken line shown in FIG. 43, the average voltage IX11 becomes equal to (2·VH+VL)/3 during a period in which T1=L and T2=H in which the output voltage Q11 is originally low. That is, the average signal IX11 has a pulse between V1 and (2·VH+VL)/3. When the average voltage IX11 equal to (2·VH+VL)/3 is applied to the amplifier 361, the voltage VL of the average voltage is output as VL, and the voltage (2·VH+VL)/3 is output as VH because (2·VH+VL)/3 is higher than the threshold voltage (VH+VL)/2 of the amplifier 361. Hence, the correct pulse waveform can be output as QX11 even if the register 211 has a defect causing its output signal Q11 to be fixed to the low level.

If a defect has occurred in the register 222 and its output signal Q22 is fixed to the high level, as indicated by a broken line shown in FIG. 43, the average voltage IX12 becomes equal to (VH+2·VL)/3 during a period in which T1=L and T2=H in which the output voltage Q22 is originally low. That is, the average signal IX22 has a pulse between (VH+2·VL)/3 and VH. When the average voltage IX12 equal to (VH+2·VL)/3 is applied to the amplifier 362, the voltage VH of the average voltage is output as VH, and the voltage (VH+2·VL)/3 is output as VL because (VH+2·VL)/3 is lower than the threshold voltage (VH+VL)/2 of the amplifier 362. Hence, the correct pulse waveform can be output as QX12 even if the register 211 has a defect causing its output signal Q11 to be fixed to the low level.

As described above, the output signal having a majority is output by averaging the output signals of the multiplexed structural parts and amplifying the average signal even if some of the multiplexed structural parts are defective. Hence, the display check is needed and the correct operation can be automatically ensured. Further, the decision-by-majority processing circuit used in the fourteenth embodiment of the present invention is simpler than that used in the thirteenth embodiment thereof.

The present invention is not limited to the specifically disclosed embodiments, and variations and modifications may be made without departing from the scope of the present invention.

What is claimed is:

1. A driving circuit for a liquid-crystal display device having display elements and n signal lines coupled to the display elements, where n is an integer, said driving circuit comprising:

a shift register which outputs n control signals that drive the n signal lines, respectively, the shift register having a plurality of cascaded stages, each preceding stage connected by a single output line to a next, successive stage and each of the plurality of cascaded stages corresponding to one of the control signals and including delay elements connected in parallel, each of the delay elements having a unit delay time and producing a corresponding output signal; and selector means for receiving the output signals of the delay elements, for selecting, in response to a select signal commonly supplied to the plurality of cascaded stages, at least one of the output signals of the delay elements and for outputting the at least one of the output signals as the one of the control signals corresponding to the respective stage via the single output line to the next, successive stage of the plurality of cascaded stages.

2. The driving circuit as claimed in claim 1, wherein:

each of the plurality of cascaded stages comprises two delay elements; and the selector means of each stage comprises a switch which selects one of the two delay elements in response to the select signal.

3. The driving circuit as claimed in claim 1, wherein the select signal comprises a signal which operates the selector means of the plurality of stages in a time division manner.

4. The driving circuit as claimed in claim 1, wherein the liquid crystal-display device includes a liquid-crystal display panel and the driving circuit is integrated on the liquid-crystal display panel.

5. A driving circuit for a liquid-crystal display device having display elements and n signal lines coupled to the display elements, where n is an integer, said driving circuit comprising:

a shift register which outputs n control signals that drive the n signal lines, respectively, the shift register having a plurality of cascaded stages, each preceding stage connected by a single output line to a next, successive stage and each of the plurality of cascaded stages corresponding to one of the control signals and including delay elements connected in parallel, each of the delay elements having a unit delay time and producing a corresponding output signal; and selector means for receiving the output signals of the delay elements, for selecting, in response to a select signal, at least one of the output signals of the delay elements and for outputting the at least one of the output signals as the one of the control signals corresponding to the respective stage via the single output line to the next, successive stage of the plurality of cascaded stages; and defect detecting means for detecting defects which occur in at least one of the delay elements and for generating the select signal in response thereto.

6. The driving circuit as claimed in claim 5, wherein:

each of the plurality of cascaded stages comprises first, second, third and fourth delay elements;

the driving circuit comprises a first gate circuit which generates a first gate signal based on states of the respective output signals of the first and second delay elements, and a second gate circuit which generates a second gate signal based on states of the respective output signals of the third and fourth delay elements; and the selector means comprises means for selecting either the first gate signal or the second gate signal and for outputting the selected gate signal as the control signal corresponding to the respective stage.

7. The driving circuit as claimed in claim 5, wherein:

each of the plurality of cascaded stages comprises first, second and third delay elements;

the driving circuit comprises a gate circuit which generates a gate signal based on states of output signals of the first and second delay elements; and the selector means comprises means for selecting either the gate signal or the output signal of the third delay element and for outputting the selected signal as the control signal corresponding to the respective stage.

8. A driving circuit for a liquid-crystal display device having display elements and n signal lines coupled to the display elements, where n is an integer, said driving circuit comprising:

n primary driving voltage output circuits which produce respective outputs and drive, respectively, the n signal lines;

n secondary driving voltage output circuits which produce respective outputs and correspond, respectively, to said n primary driving voltage output circuits, each primary driving voltage output circuit and a corresponding secondary driving voltage output circuit defining one of a plurality of cascading stages of the driving circuit, each preceding stage connected by a single output line to a next, successive stage;

control means for controlling operations of said n primary driving voltage output circuits;

defect detecting means for detecting defects in said n primary driving voltage output circuits and for generating n select signals in response thereto; and selector means for selecting, at each stage, either the a respective primary driving voltage output circuit or the corresponding secondary driving voltage output circuit of the respective stage in accordance with the n select signals and for providing the output thereof to the next, successive stage of the cascaded stages except for an output of a last stage of the cascaded stages.

9. The driving circuit as claimed in claim 8, wherein the liquid-crystal display device includes a liquid-crystal display panel and the driving circuit is integrated on the liquid-crystal display panel.

10. A driving circuit for a liquid-crystal display device having display elements and n signal lines coupled to the display elements, where n is an integer, the driving circuit comprising:

n primary driving voltage output circuits which respectively correspond to, and respectively drive, the n signal lines;

at least one secondary driving voltage output circuit, each secondary driving voltage output circuit corresponding to a respective group of m primary driving voltage output circuits, where m is less than n;

control means for respectively providing m control signals to the m primary driving voltage output circuits within a respective group to thereby control operations of the m primary driving voltage output circuits within the group;

first switch means for selectively and respectively connecting the n primary driving voltage output circuits to the n signal lines;

second switch means for selectively providing the m control signals of a respective group to the corresponding secondary driving voltage output circuit;

third switch means for selectively connecting, for the m primary driving voltage output circuits of each group, the corresponding secondary driving voltage output circuit to a respective signal line of the signal lines corresponding to the primary driving voltage output circuits in the group; and defect detecting means for detecting defects that occur in the m primary driving voltage output circuits of each group and for controlling the first, second and third switch means so that a signal line corresponding to a primary driving voltage output circuit, of the respective group, in which a defect is detected is driven by the secondary driving voltage output circuit of the respective group.

11. The driving circuit as claimed in claim 10, wherein each of the n signal lines is divided into a first portion and a second portion:

the first switch means is located on the first portions of the n signal lines, and the second and third switch means are located on the second portions of the n signal lines; and the defect detecting means comprises a first part located on the first portions of the n signal lines, and a second part located on the second portions of the n signal lines.

12. The driving circuit as claimed in claim 10, wherein the liquid-crystal display device comprises a liquid-crystal display panel and the driving circuit is integrated on the liquid-crystal display panel.

13. A driving circuit for a liquid-crystal display device having display elements, including redundant display elements, and n signal lines coupled to the display elements, where n is an integer, said driving circuit comprising:

n driving voltage output circuits respectively corresponding to and respectively driving the n signal lines upon serial activation at respective, different timings to display data on the liquid-crystal display device;

defect detecting means for detecting defects in the n driving voltage output circuits, thereby identifying defective driving voltage output circuits; and control means for controlling the n driving voltage output circuits so that, when a defective driving voltage output circuit is identified by the defect detection means, a non-defective driving voltage output circuit adjacent to the defective driving voltage output circuit, and a corresponding signal line of the non-defective driving voltage output circuit are used to display data which was to be displayed by the defective driving voltage output circuit.

14. The driving circuit as claimed in claim 13, further comprising means for applying dummy data to the n driving voltage output circuits based on a ratio of a number of defective display elements detected by the defect detecting means and the number of redundant display elements so that an image to be displayed is controlled.

15. The driving circuit as claimed in claim 13, wherein the liquid-crystal display device comprises a liquid-crystal display panel and the driving circuit is integrated on the liquid-crystal display panel.

16. A driving circuit for a liquid-crystal display device having display elements, including redundant display elements, and n signal lines coupled to the display elements, where n is an integer, said driving circuit comprising:

n driving voltage output circuits respectively corresponding to and respectively driving the n signal lines to display data on the liquid-crystal display device;

defect detecting means for detecting defects in said n driving voltage output circuits; and control means for supplying to the n driving voltage output circuits, timing signals to control successive operations of the voltage driving output circuits, so that where i represents an integer less than n, when a defect in an ith driving voltage output circuit is not detected by the defect detecting means, a successive timing signal of the ith driving voltage output circuit is provided as a timing signal for the (i+1)th driving voltage output circuit, and when a defect is detected in the ith driving voltage output circuit by the defect detecting means, a timing signal is provided to the (i+1)th driving voltage output circuit which is the timing signal provided to the ith driving voltage output circuit prior to the successive timing signal of the ith driving voltage output circuit, which was to be used to cause display of the display data by the ith driving voltage output circuit and a corresponding signal line.

17. A driving circuit for a liquid-crystal display device having display elements and n signal lines coupled to the display elements, where n is an integer, the driving circuit comprising:

a shift register which outputs n control signals to drive the n signal lines, respectively, the shift register having a plurality of cascaded stages, each stage corresponding to one of the n control signals and comprising:

first, second and third delay elements connected in parallel, each of the delay elements having a unit delay time and producing a corresponding output signal, a mismatch determining means, receiving the corresponding output signals of the first and second delay elements, for generating a mismatch signal by performing an XOR operation of the received output signals, and selection means, receiving the mismatch signal from the mismatch determining means and the outputs of the first and third delay elements, for outputting one of the output signals of the first and third delay elements based on the mismatch signal, the signal output by the selection means being the n control signal corresponding to the respective stage.

18. The driving circuit as claimed in claim 17, wherein the liquid crystal display device comprises a liquid-crystal display panel and the driving circuit is integrated on the liquid-crystal display panel.

19. A driving circuit for a liquid-crystal display device having display elements and n signal lines coupled to the display elements, where n is an integer, the driving circuit comprising:

a shift register which outputs n control signals to drive the n signal lines, respectively, the shift register having a plurality of cascaded stages, each stage corresponding to one of the n control signals and comprising:

first, second and third delay elements connected in parallel, each of the delay elements having a unit delay time and producing a corresponding output signal, first, second and third capacitances corresponding to, and respectively connected to, the corresponding outputs of the first, second and third delay elements, each thereof latching the voltage of the corresponding output; and an average value determining means, receiving the voltages latched by the capacitances, for generating a corresponding output signal based on the average value of the voltages across the capacitances, the output signal of the average value determining means being the n control signal corresponding to the respective stage.

20. The driving circuit as claimed in claims 19, wherein the liquid crystal display device comprises a liquid-crystal display panel and the driving circuit is integrated on the liquid-crystal display panel.

* * * * *

UNITED STATES PATENT AND TRADEMARK OFFICE

CERTIFICATE OF CORRECTION

PATENT NO. : 5,859,627
DATED : January 12, 1999
INVENTOR(S) : Takayuki HOSHIYA et al.

It is certified that error appears in the above-identified patent and that said Letters Patent is hereby corrected as shown below:

On the title page, [73] Assignee, change "Kanagawa" to --Kawasaki--.

On the title page, [56] References Cited:

U.S. Patent Documents, change "5,038,368" to --5,039,368--.

Foreign Patent Documents, insert the following:

| | | |
|---|---|---|
| 63-209139 | 08/30/88 | Japan |
| 02-195597 | 08/02/90 | Japan |
| 02-304800 | 12/18/90 | Japan |
| 04-211292 | 08/03/92 | Japan. |

Other Publications, line 4, begin a new listing with "IBM"

Col. 1, line 56, after "itself" insert --,--.

Col. 6, line 32, after "direction" insert --,--;
line 36, delete "," (second occurrence);
line 64, delete "for example".

UNITED STATES PATENT AND TRADEMARK OFFICE

CERTIFICATE OF CORRECTION

PATENT NO. : 5,859,627
DATED : January 12, 1999
INVENTOR(S) : Takayuki HOSHIYA et al.

It is certified that error appears in the above-identified patent and that said Letters Patent is hereby corrected as shown below:

Col. 8, line 21, delete "," (second occurrence);
line 33, change "$4_1$" to --41--;
line 58, delete "," (second occurrence).

Col. 9, line 10, delete ",";

Col. 15, line 2, change "181," to --$18_1$--.

Col. 21, line 8, change "1381" to --$138_1$--;
line 10, change "$_o$" to --0--.
line 58, change "SO1" to --$SO_1$--.

Col. 25, line 52, change "DXL" to --DX1--.

Signed and Sealed this

Twenty-ninth Day of June, 1999

*Attest:*

Q. TODD DICKINSON

*Attesting Officer*

*Acting Commissioner of Patents and Trademarks*